US009333540B2

(12) United States Patent
Bushaw et al.

(10) Patent No.: US 9,333,540 B2
(45) Date of Patent: May 10, 2016

(54) DEVICES AND METHODS FOR DISPENSING FLUIDS AND WIPING SURFACES

(71) Applicant: NORILLA LLC, Santa Fe Springs, CA (US)

(72) Inventors: Scott Martin Bushaw, La Habra, CA (US); Jeff Bushaw, La Habra, CA (US); Imran Zaman, Cumberland, MD (US)

(73) Assignee: NORILLA LLC, Santa Fe Springs, CA (US)

( * ) Notice: Subject to any disclaimer, the term of this patent is extended or adjusted under 35 U.S.C. 154(b) by 455 days.

(21) Appl. No.: 13/802,032

(22) Filed: Mar. 13, 2013

(65) Prior Publication Data

US 2014/0059790 A1 Mar. 6, 2014

Related U.S. Application Data

(60) Provisional application No. 61/757,032, filed on Jan. 25, 2013, provisional application No. 61/695,028, filed on Aug. 30, 2012.

(51) Int. Cl.

| | |
|---|---|
| ***B08B 1/00*** | (2006.01) |
| ***A47L 25/00*** | (2006.01) |
| ***A47L 13/12*** | (2006.01) |

(Continued)

(52) U.S. Cl.

CPC ..... *B08B 1/006* (2013.01); *A47L 13/12* (2013.01); *A47L 13/26* (2013.01); *A47L 13/50* (2013.01); *A47L 25/00* (2013.01); *B65D 1/04* (2013.01); *B65D 1/06* (2013.01); *B65D 47/42* (2013.01)

(58) Field of Classification Search

CPC ..... A47L 1/06; A47L 13/12; A47L 25/00; G02C 13/006

USPC ..... 401/5, 202; 15/118, 121, 208, 209.1, 15/210.1, 220.1, 231, 232

See application file for complete search history.

(56) References Cited

U.S. PATENT DOCUMENTS

| | | | | |
|---|---|---|---|---|
| 296,092 | A | 4/1884 | Weed | |
| 1,662,038 | A * | 3/1928 | Bodenhofer | A47L 1/06 15/147.2 |

(Continued)

FOREIGN PATENT DOCUMENTS

| | | |
|---|---|---|
| CN | 203030594 U | 7/2013 |
| EP | 1160313 | 12/2001 |

(Continued)

OTHER PUBLICATIONS

U.S. Appl. No. 29/466,807, filed Sep. 11, 2013, Bushaw, Scott Martin.

(Continued)

*Primary Examiner* — Mark A Laurenzi
*Assistant Examiner* — Bradley Oliver
(74) *Attorney, Agent, or Firm* — Knobbe Martens Olson & Bear LLP

(57) ABSTRACT

The disclosure herein provides devices and methods for dispensing fluids and wiping surfaces. A cleaning device comprises a housing having an internal cavity configured to retain a cleaning fluid, a dispenser in fluid communication with the internal cavity and having a dispensing surface configured to dispense at least a portion of cleaning fluid from the internal cavity, and a wiper having a wiping surface configured to wipe dispensed fluid from a surface being cleaned.

19 Claims, 53 Drawing Sheets

(51) Int. Cl.

| | |
|---|---|
| ***A47L 13/26*** | (2006.01) |
| ***A47L 13/50*** | (2006.01) |
| ***B65D 1/04*** | (2006.01) |
| ***B65D 1/06*** | (2006.01) |
| ***B65D 47/42*** | (2006.01) |

(56) References Cited

U.S. PATENT DOCUMENTS

| | | | | |
|---|---|---|---|---|
| 2,862,221 | A | 7/1955 | Hume | |
| 3,341,884 | A | 9/1967 | Pryor | |
| D215,817 | S | 11/1969 | Gorman | |
| 4,043,683 | A | 8/1977 | Costa et al. | |
| 4,338,366 | A | 7/1982 | Evans et al. | |
| 5,280,661 | A * | 1/1994 | Brown | 15/214 |
| 5,765,407 | A * | 6/1998 | Choo et al. | 401/18 |
| D414,690 | S | 10/1999 | Hutchinson et al. | |
| D415,020 | S | 10/1999 | Hutchinson et al. | |
| D415,021 | S | 10/1999 | Hutchinson et al. | |
| D541,161 | S | 4/2007 | Ames | |
| 7,546,657 | B2 | 6/2009 | Gurley | |
| D660,181 | S | 5/2012 | Nowacek et al. | |
| 8,225,928 | B2 | 7/2012 | Perrier et al. | |
| D669,274 | S | 10/2012 | Meurrens | |
| 8,281,735 | B2 | 10/2012 | Curtin | |
| 8,493,714 | B2 | 7/2013 | Visser et al. | |
| D689,253 | S | 9/2013 | Stachowski et al. | |
| 8,635,732 | B2 | 1/2014 | DeDominicis et al. | |
| D699,410 | S | 2/2014 | Stachowski et al. | |
| D705,509 | S | 5/2014 | Liu et al. | |
| 2005/0216293 | A1 | 9/2005 | Bushaw | |
| 2008/0244847 | A1 | 10/2008 | Richter et al. | |
| 2009/0003921 | A1 | 1/2009 | Francavilla | |
| 2009/0255074 | A1 * | 10/2009 | Huang | A47L 13/16 15/104.94 |
| 2010/0011524 | A1 | 1/2010 | Roeback et al. | |
| 2010/0257681 | A1 | 10/2010 | Lin | |
| 2012/0006911 | A1 | 1/2012 | Weng | |
| 2012/0138490 | A1 | 6/2012 | Hollander et al. | |
| 2013/0177261 | A1 | 7/2013 | Bushaw | |
| 2014/0059790 | A1 | 3/2014 | Bushaw et al. | |

FOREIGN PATENT DOCUMENTS

| | | |
|---|---|---|
| EP | 1726373 | 11/2006 |
| WO | WO 2009/029251 | 3/2009 |
| WO | WO 2009/065128 | 5/2009 |
| WO | WO 2013/009180 | 1/2013 |
| WO | WO 2013/131111 | 9/2013 |
| WO | WO 2015/042463 | 3/2015 |

OTHER PUBLICATIONS

International Search Report and Written Opinion for application No. PCT/US14/56648, which is a PCT application related to the present application, mailed on Mar. 3, 2015.

Photographs of product by Monster Cable Products, Inc., "Clean Touch." A printout of a webpage in which the Clean Touch product was offered for sale is also included. The printout indicates that the product was first offered for sale on Apr. 15, 2011; however, Applicant makes no representations as to the accuracy of this date or if the product has changed since that date. The printout was retrieved from Amazon.com on Apr. 2, 2015.

* cited by examiner

DEVICES AND METHODS FOR DISPENSING FLUIDS AND WIPING SURFACES

CROSS-REFERENCE TO RELATED APPLICATIONS

This application claims the benefit of U.S. Provisional Application No. 61/757,032, filed Jan. 25, 2013, and titled DEVICES AND METHODS FOR DISPENSING FLUIDS AND WIPING SURFACES, and U.S. Provisional Application No. 61/695,028, filed Aug. 30, 2012, and titled SELF CONTAINED CLEANING UNIT. Each of the foregoing applications is hereby incorporated by reference herein in its entirety.

BACKGROUND

1. Field

The present disclosure relates generally to the field of liquid and other fluid dispensers, and certain embodiments are particularly directed to, for example, cleaning fluid dispensers having dispensing and wiping surfaces.

2. Description

Various devices and objects tend to require periodic cleaning and/or sanitizing to maintain a satisfactory appearance, operating efficiency, and/or level of cleanliness. For example, various electronic devices, such as cell phones, smartphones, laptop computers, tablet computers, e-readers, computer keyboards, electronic displays, and the like, may become soiled with dust, dirt, germs, fingerprints, spilled liquids, etc. A user, however, has few convenient options for cleaning or sanitizing the device.

One option to clean and/or sanitize a device is to wipe the device with a disposable cleaning or sanitizing wipe that has been pre-impregnated with cleaning or sanitizing fluid. However, because typically the entire wipe is used and thrown away (even if only a small portion of the fluid in the wipe is required), such options may not be preferred.

Another option to clean and/or sanitize a device is to use a reusable cloth and a separate container of sanitizing or cleaning fluid, such as a spray bottle, to wet the cloth. This option may still leave a residue on the device and requires that a user carry or have available a spray bottle and cloth, which may be inconvenient. This option may also be inconvenient because it often requires that a user have both hands free, one to hold the cloth and one to hold the spray bottle. Additionally, once the user is finished cleaning the device, he or she may be left with a wet reusable cloth that must be stored somewhere. Accordingly, it can be advantageous to provide devices and methods for dispensing fluids, such as cleaning or sanitizing fluids, and wiping surfaces, such as surfaces being cleaned or sanitized.

SUMMARY

According to some embodiments, a cleaning device configured to selectively dispense a fluid (e.g., cleaning fluid, sanitizer, fragrance, gel, disinfectant, soap, cleaning agent, etc.) to a surface being cleaned (e.g., a screen or display or other portion of a television, a computer, a laptop, a keyboard, a smartphone, a tablet, glasses, glasses incorporating a computer, a watch, a computerized watch, other electronic devices, other devices or objects with surfaces to be cleaned, and/or the like) includes a housing. In one embodiment, the housing includes a first end and a second end, wherein at least one of the first end and the second end includes an opening (e.g., a slot, a hole, an elongated slot or hole, etc.). In some embodiments, the housing at least partially defines an internal cavity, the internal cavity being in fluid communication with the opening. In some embodiments, the housing is configured to be grasped and manipulated by a user (e.g., the housing is shaped to held in a user's hand) during a cleaning procedure, for example, to apply a cleaning fluid to a surface and/or to wipe the surface. In some embodiments, the housing is configured to attach to a holder and for a user to grasp and manipulate the holder during the cleaning procedure instead of directly grasping and manipulating the housing. In some embodiments, the internal cavity of the housing is configured to contain a volume of fluid (e.g., cleaning fluid, sanitizer, fragrance, gel, disinfectant, soap, cleaning agent, etc.). In one embodiment, an at least partially porous or fluid permeable dispenser (e.g., comprised at least partially of felt, synthetic felt, porous plastic, foam, sponge, microfiber, cotton, polyester, extruded polyester fibers and/or the like) at least partially covers the opening of the housing and includes an exterior surface configured to contact a surface being cleaned and to selectively deliver fluid to the surface being cleaned. The dispenser is configured to regulate, at least in part, a flow of fluid from the internal cavity to an exterior of the housing through the dispenser (e.g., by restricting a flow of the fluid through at least a portion of the dispenser). In some embodiments, the cleaning device includes at least one wiper having a wiping surface, the wiping surface being configured to wipe dispensed fluid from a surface being cleaned and/or to buff or polish or clean a surface with or without using fluid. In some embodiments, the wiping surface at least partially includes a fabric or cloth material (e.g., microfiber cloth, cotton cloth, terry cloth and/or the like). In some embodiments, at least a portion of the wiper is at least partially impregnated with a cleaning fluid. In some embodiments, the cleaning device is configured to dispense fluid in various forms, such as a liquid, a mist, a spray, a foam, drops, etc.

In some embodiments, the cleaning device further includes at least one internal reservoir positioned at least partially within the internal cavity of the housing. In some embodiments, at least a portion of the internal reservoir includes a surface configured to contact a surface being cleaned and to selectively deliver fluid to the surface being cleaned. The at least one internal reservoir can include a fluid-absorbing material (e.g., porous plastic, felt, synthetic felt, foam, fiber strands, cotton, sponge, microfiber, polyester, synthetic fiber, extruded polyester fibers, and/or the like). The at least one internal reservoir can include at least one void or cavity configured to retain a fluid therein. In some embodiments, the at least one internal reservoir is slidably or snugly positioned at least partially within the internal cavity of the housing through the opening. In some embodiments, the internal cavity of the housing has at least two compartments, with each of the at least two compartments being in fluid communication with the dispenser. Some of the at least one internal reservoirs can be positioned at least partially within the at least two compartments. In some embodiments, more than one of the at least one internal reservoirs are positioned within a single compartment. In some embodiments, each of the at least two compartments includes at least one separate internal reservoir positioned at least partially within the compartment. In one embodiment, a portion of the dispenser extends at least partially within the internal cavity of the housing. In some embodiments, a portion of the dispenser extends completely or substantially completely within the internal cavity of the housing. In some embodiments, the dispenser includes at least one protruding member or wicking portion that extends into the internal cavity of the housing, the at least one protruding member being configured to deliver fluid contained within the internal cavity to the exterior surface of the dispenser (e.g., through capillary or wicking action). In some embodiments, the at least one protruding member and the exterior surface of the dispenser are a unitary structure. In other embodiments, the dispenser can include multiple components, with at least some of them being in fluid communication with each other. In some embodiments, the dispenser includes at least one fabric layer (e.g., microfiber cloth, terry cloth, cotton cloth, and/or the like) configured to at least partially form the exterior surface of the dispenser. In some embodiments, the at least one fabric layer is configured to be removable (e.g., by releasing a fastener, overcoming a friction force, removing the dispenser from the housing, etc.). In some embodiments, the dispenser includes at least one compressible portion (e.g., sponge, foam, cloth, rubber, and/or the like) configured to allow the exterior surface of the dispenser to at least partially conform to a surface being cleaned.

In some embodiments, the wiper includes at least one fabric layer (e.g., microfiber cloth, cotton cloth, terry cloth, and/or the like) configured to at least partially form the wiping surface of the wiper. The at least one fabric layer is configured to be removable in some embodiments (e.g., by releasing a fastener, overcoming a friction force, removing the wiper from the housing, etc.). In some embodiments, the wiper comprises at least one compressible portion (e.g., sponge, foam, cloth, and/or the like) configured to allow the wiping surface of the wiper to at least partially conform to a surface being cleaned. In some embodiments, the housing comprises one or more internal reinforcing members (e.g., ribs, stiffening members, protrusions, dividers, etc.). In some embodiments, at least a portion of the housing is configured to be squeezable (e.g., by having flexible walls, compressible areas, a pump, and/or the like) to increase a flow rate of fluid from the internal cavity to the exterior of the housing through the dispenser. In some embodiments, the cleaning device further includes an elevator positioned within the internal cavity of the housing, the elevator including at least one elevating surface, and a handle configured to move the elevator within the internal cavity when the handle is rotated (or otherwise moved relative to the housing) to cause the elevating surface to increase a pressure in at least a portion of the internal cavity to increase a flow rate of fluid from the internal cavity to the exterior of the housing through the dispenser. In some embodiments, the cleaning device further includes a retainer configured to at least partially position the wiper and dispenser relative to the housing. For example, the wiper can be configured to fit at least partially within a cavity of the retainer, and a portion or portions of the retainer can be configured to mate against a surface or surfaces of the dispenser to hold the dispenser in position relative to the housing. In some embodiments, the wiper is positioned at the first end of the housing and the dispenser is positioned at the second end of the housing, with the first end being located substantially opposite to the second end. In other embodiments, the wiper is positioned at the first end of the housing and the dispenser is positioned at the second end of the housing, with the first end being located substantially perpendicular to the second end. In other embodiments, the first end and second ends can be located in various locations relative to each other. In some embodiments, the wiper is positioned adjacent to the dispenser. In some embodiments, the cleaning device further includes a dispenser cover configured to at least partially cover the dispenser and/or a wiper cover configured to at least partially cover the wiper. The dispenser cover and/or wiper cover can be configured to be removable from the housing, slidably attached to the housing, hingedly attached to the housing, etc. In some embodiments the exterior surface of the dispenser comprises at least one sharp edge and at least one rounded edge. In some embodiments, the wiping surface of the wiper comprises at least one sharp edge and at least one rounded edge.

According to some embodiments, a cleaning device configured to selectively dispense a fluid (e.g., cleaning fluid, sanitizer, fragrance, gel, disinfectant, soap, cleaning agent, etc.) to a surface being cleaned (e.g., a screen or display or other portion of a television, a computer, a laptop, a keyboard, a smartphone, a tablet, other electronic devices, other devices or objects with surfaces to be cleaned, and/or the like) includes a housing. In one embodiment, the housing includes a first end and a second end, wherein at least one of the first end and the second end includes an opening (e.g., a slot, a hole, an elongated slot or hole, etc.), and the housing at least partially defines an internal cavity. In some embodiments, the housing is configured to be grasped and manipulated by a user (e.g., the housing is shaped to be held in a user's hand) during a cleaning procedure, for example, to apply a cleaning fluid to a surface and/or to wipe the surface. In some embodiments, the cleaning device includes two or more disposable dispensers including at least partially porous or fluid permeable material (e.g., felt, synthetic felt, porous plastic, foam, sponge, microfiber, cotton, polyester, extruded polyester fibers and/or the like), with the two or more disposable dispensers being configured to be at least partially impregnated with a volume of fluid (e.g., cleaning fluid, sanitizer, fragrance, gel, disinfectant, soap, cleaning agent, etc.). In some embodiments, each of the two or more disposable dispensers includes at least one dispensing surface configured to contact a surface being cleaned and to selectively deliver fluid thereto. In some embodiments, the internal cavity of the housing is configured to at least partially contain the two or more disposable dispensers with at least one of the two or more dispensers protruding through the opening to an exterior of the housing. In some embodiments, the cleaning device includes at least one wiper having a wiping surface, the wiping surface being configured to wipe dispensed fluid from a surface being cleaned and/or to buff or polish or clean a surface with or without using fluid. In some embodiments, the wiping surface at least partially includes a fabric or cloth material (e.g., microfiber cloth, cotton cloth, terry cloth and/or the like). In some embodiments, at least a portion of the wiper is at least partially impregnated with a cleaning fluid. In some embodiments, at least some of the two or more disposable dispensers are connected along an edge to another of the two or more disposable dispensers such that at least some of the two or more disposable dispensers are configured to pull another of the two or more disposable dispensers at least partially through the opening of the housing when a user pulls on the at least some of the two or more disposable dispensers. In some embodiments, the disposable dispensers are connected at a perforated junction or tear joint. In some embodiments, the disposable dispensers do not have a perforated junction or tear joint. In some embodiments, the disposable dispensers are a single continuous sheet configured to be cut into individual dispensers by a user. In some embodiments, the cleaning device includes a cutting feature (e.g., a knife, scissors, a knife-like mechanism, a serrated surface and/or the like) configured to cut the disposable dispensers.

In some embodiments, the housing further includes a dispenser backing configured to apply a force to the surface being cleaned through the at least one of the two or more dispensers protruding through the opening of the housing. In some embodiments, the dispenser backing includes at least one compressible portion (e.g., sponge, foam, cloth, rubber, and/or the like) configured to allow the at least one of the two or more dispensers protruding through the opening in the housing to at least partially conform to a surface being cleaned. In some embodiments, the dispenser backing is configured to allow at least a portion of a volume of fluid contained within the housing to pass through the dispenser backing to be applied to the at least one of the two or more dispensers. In some embodiments, the two or more disposable dispensers form a stack slidably positioned at least partially within the internal cavity of the housing. In other embodiments, the two or more disposable dispensers form a roll positioned at least partially within the internal cavity of the housing. In some embodiments, the cleaning device further includes an elevator having at least one elevating surface positioned within the internal cavity of the housing, with at least one of the two or more disposable dispensers forming the stack being supported by the elevating surface. In some embodiments, the cleaning device further includes a handle configured to move the elevator within the internal cavity when the handle is rotated (or otherwise moved relative to the housing) to cause the stack to move relative to the opening of the housing. In some embodiments, the wiper includes at least one fabric layer (e.g., microfiber cloth, cotton cloth, terry cloth, and/or the like) configured to at least partially form the wiping surface of the wiper. The at least one fabric layer is configured to be removable in some embodiments (e.g., by releasing a fastener, overcoming a friction force, removing the wiper from the housing, etc.). In some embodiments, the wiper comprises at least one compressible portion (e.g., sponge, foam, cloth, and/or the like) configured to allow the wiping surface of the wiper to at least partially conform to a surface being cleaned. In some embodiments, the housing comprises one or more internal reinforcing members (e.g., ribs, stiffening members, protrusions, dividers, etc.).

In some embodiments, the wiper is positioned at the first end of the housing and the opening is positioned at the second end of the housing, with the first end being located substantially opposite to the second end. In other embodiments, the wiper is positioned at the first end of the housing and the opening is positioned at the second end of the housing, with the first end being located substantially perpendicular to the second end. In other embodiments, the first end and second end can be located in various locations relative to each other. In some embodiments, the wiper is positioned adjacent to the opening. In some embodiments, the cleaning device further includes a dispenser cover configured to at least partially cover the at least one of the two or more dispensers protruding through the opening in the housing. In some embodiments, the cleaning device further includes a wiper cover configured to at least partially cover the wiper. The dispenser cover and/or wiper cover can be configured to be removable from the housing, slidably attached to the housing, hingedly attached to the housing, etc. In some embodiments, the wiper is configured to be removable from the housing. In some embodiments, the wiping surface of the wiper includes at least one sharp edge and at least one rounded edge. In some embodiments, the cleaning device is configured to dispense fluid in various forms, such as a liquid, a mist, a spray, a foam, drops, etc.

According to some embodiments, a filling device for transferring fluid to a cleaning device includes a housing configured to rest on a surface. In some embodiments, the housing includes an internal cavity and a filling port, with the internal cavity being configured to contain a volume of fluid (e.g., cleaning fluid, sanitizer, fragrance, gel, disinfectant, soap, cleaning agent, etc.) and to be in fluid communication with the filling port to allow fluid to transfer from the internal cavity out of the housing through the filling port (or into the internal cavity of the housing through the filling port). In some embodiments, the filling port is defined at least partially by a void shaped to substantially conform to at least a portion of a dispenser of a cleaning device to allow at least a portion of the dispenser to be placed into fluid communication with the internal cavity to transfer fluid between the internal cavity and the dispenser. In some embodiments, the filling device further includes a gasket positioned within the filling port and configured to form a seal with a portion of a cleaning device. In some embodiments, the cleaning device further includes a valve (or other flow-limiting device) to allow fluid transfer between the filling port and internal cavity when the valve (or other flow-limiting device) is in an open configuration and to not allow fluid transfer between the filing port and internal cavity when the valve (or other flow-limiting device) is in a closed configuration. In some embodiments, the internal cavity is pressurized with reference to a pressure level exterior to the housing to aid in transferring fluid from the internal cavity to a dispenser positioned at least partially within the filling port. In some embodiments, the filling device further includes an evacuation pump configured to create a pressure differential to aid in transferring fluid from a cleaning device positioned at least partially within the filling port to the internal cavity.

In some embodiments, a cleaning device configured to dispense fluid (e.g., cleaning fluid, sanitizer, fragrance, gel, disinfectant, soap, cleaning agent, etc.) and clean surfaces (e.g., a screen or display or other portion of a television, a computer, a laptop, a keyboard, a smartphone, a tablet, other electronic devices, a whiteboard, other devices or objects with surfaces to be cleaned, and/or the like) includes a dispenser. In some embodiments, the dispenser is configured to contain a volume of fluid (e.g., in a reservoir, a porous material, a cavity, and/or the like) and to selectively dispense a portion of the volume of fluid through a dispensing surface (e.g., a cloth surface, a porous surface, a nozzle, etc.). In some embodiments, the cleaning device is configured to dispense fluid in various forms, such as a liquid, a mist, a spray, a foam, drops, etc. In some embodiments, the dispenser includes a first portion and a second portion, with the first portion being in fluid communication with the second portion (e.g., fluid can be transferred from the first portion to the second portion and/or from the second portion to the first portion). In some embodiments, the first portion and second portion of the dispenser include at least two separate components. In some embodiments, the first portion and second portion of the dispenser are a single unitary component. According to some embodiments, the dispenser includes a fluid-permeable material (e.g., felt, synthetic felt, porous plastic, foam, sponge, microfiber, cotton, polyester, extruded polyester fibers and/or the like). In some embodiments, the dispensing surface is located on the first portion of the dispenser. In other embodiments, the dispensing surface is located on the second portion of the dispenser. In other embodiments, the dispensing surface is located partially on the first portion and partially on the second portion of the dispenser. In some embodiments, the dispenser includes at least one fabric layer (e.g., microfiber cloth, cotton cloth, terry cloth and/or the like) configured to at least partially form the dispensing surface of the dispenser. According to some embodiments, the cleaning device includes a housing configured to encapsulate (e.g., to hold, position, capture, encircle, etc.) at least part of the dispenser. In some embodiments, the housing includes ribs or reinforcing members that at least partially hold or position the dispenser. In some embodiments, at least part of the dispenser is configured to be removable from the housing (e.g., by pulling on the dispenser, by opening an access flap, door, etc. in the housing, by disassembling the housing and/or dispenser, by removing one or more fasteners, etc.). In some embodiments, the entire dispenser is configured to be removable from the housing. In some embodiments, the dispenser is configured to be non-removable or permanently installed. In some embodiments, the housing is configured to be grasped and manipulated by a user (e.g., the housing is shaped to be held in a user's hand, includes indentations or other grasping or locating features, includes ergonomic features, and/or the like) to enable the user to direct the dispensing surface of the dispenser into contact with a surface being cleaned (e.g., to touch the dispensing surface to the surface being cleaned, to wipe the dispensing surface along the surface being cleaned, to scrub the surface being cleaned, etc.). In some embodiments, the second portion of the dispenser is positioned substantially within the housing (e.g., encapsulated, encircled, etc. by the housing), and the first portion of the dispenser is positioned substantially exterior to the housing (e.g., protruding from the housing). In some embodiments, the cleaning device includes a wiper having a wiping surface configured to wipe dispensed fluid from the surface being cleaned and/or to buff or polish or clean a surface with or without using fluid. In some embodiments, the wiping surface at least partially includes a fabric or cloth material (e.g., microfiber cloth, cotton cloth, terry cloth and/or the like). In some embodiments, the wiper is entirely, substantially, or partially made of a single fabric or cloth material (e.g., microfiber, cotton, terry, and/or the like). In other embodiments, the wiper includes a combination of more than one material (e.g., cloth, fabric, plastic, metal, etc.). In some embodiments, at least a portion of the wiper is at least partially impregnated with a cleaning fluid. In some embodiments, the wiper is positioned by the housing (e.g., attached to the housing, inserted at least partially into a cavity of the housing, engaged at least partially by the housing, etc.) to enable the user to direct the wiping surface of the wiper into contact with the surface being cleaned (e.g., to touch the surface being cleaned, to wipe the wiping surface along the surface being cleaned, to scrub the surface being cleaned, etc.) by grasping and manipulating the housing. In some embodiments, the wiper includes at least one fabric or cloth layer (e.g., microfiber cloth, cotton cloth, terry cloth and/or the like) configured to at least partially form the wiping surface of the wiper. In some embodiments, at least part of the wiper is configured to be removable from the housing (e.g., by pulling on the wiper, by opening an access flap, door, etc. in the housing, by disassembling the housing and/or wiper, by removing one or more fasteners, etc.). In some embodiments, the wiper is configured to be non-removable or permanently installed. In some embodiments, the at least one fabric or cloth layer of the wiper and/or dispenser is configured to be removable (e.g., by unwrapping the layer, removing one or more fasteners, etc.). In some embodiments, the at least one fabric or cloth layer of the wiper and/or dispenser is configured to be non-removable or permanently installed. In some embodiments, the dispensing surface and wiping surface are located at opposite ends of the cleaning device. In some embodiments, the dispensing surface and wiping surface are located at ends of the cleaning device that are perpendicular to each other.

According to some embodiments, a handheld cleaning device for cleaning surfaces (e.g., a screen or display or other portion of a television, a computer, a laptop, a keyboard, a smartphone, a tablet, other electronic devices, a whiteboard, other devices or objects with surfaces to be cleaned, and/or the like) includes a dispenser. In some embodiments, the dispenser includes an inner fluid-absorbing or fluid-permeable material (e.g., felt, synthetic felt, porous plastic, foam, sponge, microfiber, cotton, polyester, extruded polyester fibers and/or the like) and an outer fabric or cloth layer (e.g., microfiber cloth, cotton cloth, terry cloth and/or the like), and the inner fluid-absorbing material and the outer fabric layer are in fluid communication (e.g., fluid can be transferred from the inner fluid-absorbing material to the outer fabric layer and/or from the outer fabric layer to the inner fluid-absorbing material). In some embodiments, the dispenser does not include an outer fabric or cloth layer. In some embodiments, the inner fluid-absorbing material is completely encapsulated or enclosed within the outer fabric layer. In other embodiments, the outer fabric layer encapsulates, covers, and/or encloses only a portion of the inner fluid-absorbing material. In some embodiments, the dispenser is configured to contain (e.g., in a reservoir, a porous material, a cavity, and/or the like) a volume of fluid (e.g., cleaning fluid, sanitizer, fragrance, gel, disinfectant, soap, cleaning agent, etc.) and to dispense at least a portion of the fluid to a surface being cleaned through a dispensing surface of the outer fabric layer. In some embodiments, the cleaning device is configured to dispense fluid in various forms, such as a liquid, a mist, a spray, a foam, drops, etc. In some embodiments, the dispenser is configured to be in fluid communication with a reservoir configured to contain a volume of fluid. In some embodiments, the inner fluid-absorbing material is configured to at least partially regulate or restrict or meter or control a flow of fluid from the inner fluid-absorbing material to the dispensing surface of the outer fabric layer. In some embodiments, the cleaning device includes a housing at least partially encapsulating (e.g., holding, positioning, capturing, encircling, etc.) the dispenser, the housing being configured to be grasped and manipulated by a user (e.g., the housing is shaped to be held in a user's hand, includes indentations or other grasping or locating features, includes ergonomic features, and/or the like) to enable the user to direct the dispensing surface of the outer fabric layer into contact with the surface being cleaned (e.g., to touch the dispensing surface to the surface being cleaned, to wipe the dispensing surface along the surface being cleaned, to scrub the surface being cleaned, etc.). In some embodiments, the inner fluid-absorbing material of the dispenser is configured to at least partially resist deformation of the outer fabric layer of the dispenser when the outer fabric layer is directed into contact with the surface being cleaned (e.g., at least a portion of the inner fluid-absorbing material is harder, stiffer, more resistant to compression or bending, etc. than the outer fabric layer). In some embodiments, the dispenser includes one or more additional fabric layers positioned between the inner fluid-absorbing material and the outer fabric layer. In some embodiments, the dispenser includes a compressible or sponge or foam surface positioned between the inner fluid-absorbing material and the outer fabric layer. In some embodiment, the outer fabric layer of the dispenser is configured to be removable (e.g., by unwrapping the layer, by pulling the layer, by removing the dispenser from the housing, by removing one or more fasteners, etc.). In some embodiments, the cleaning device includes a reservoir positioned at least partially within an internal cavity of the housing, the reservoir being in fluid communication with the dispenser. In some embodiments, the reservoir can include, for example, plastic, metal, porous plastic, felt, synthetic felt, foam, fiber strands, cotton, sponge, microfiber, polyester, synthetic fiber, extruded polyester fibers, and/or the like. In some embodiments, the reservoir can include at least one void or cavity configured to retain a fluid therein. According to some embodiments, the reservoir is configured to contain a second volume of fluid for transfer through the dispenser for application to the surface being cleaned. In some embodiments, the cleaning device includes a wiper including a wiping surface, with the wiping surface being configured to wipe dispensed fluid from the surface being cleaned (e.g., by soaking up fluid, wiping the surface being cleaned, etc.) and/or to buff or polish or clean a surface with or without using fluid. In some embodiments, the wiping surface at least partially includes a fabric or cloth material (e.g., microfiber cloth, cotton cloth, terry cloth and/or the like). In some embodiments, at least a portion of the wiper is at least partially impregnated with a cleaning fluid. In some embodiments, the wiper is positioned by the housing to enable the user to direct the wiping surface of the wiper into contact with the surface being cleaned (e.g., to touch the surface being cleaned, to wipe the wiping surface along the surface being cleaned, to scrub the surface being cleaned, etc.) by grasping and manipulating the housing. In some embodiments, the wiper includes at least one wiping fabric layer, said wiping fabric layer (e.g., microfiber cloth, cotton cloth, terry cloth and/or the like) configured to at least partially form the wiping surface of the wiper. In some embodiments, the dispensing surface and wiping surface are located at opposite ends of the cleaning device. In some embodiments, the dispensing surface and wiping surface are located at ends of the cleaning device that are perpendicular to each other.

According to some embodiments, a method of cleaning a surface (e.g., a screen or display or other portion of a television, a computer, a laptop, a keyboard, a smartphone, a tablet, other electronic devices, a whiteboard, other devices or objects with surfaces to be cleaned, and/or the like) includes contacting the surface with a dispenser (e.g., including a fluid-permeable material, fluid-absorbing material, etc.) of a cleaning device. In some embodiments, the method includes dispensing a fluid (e.g., cleaning fluid, sanitizer, fragrance, gel, disinfectant, soap, cleaning agent, etc.) onto the surface, for example, by transferring a fluid from the dispenser to the surface. In some embodiments, the method includes dispensing fluid in various forms, such as a liquid, a mist, a spray, a foam, drops, etc. In some embodiments, the method includes moving the dispenser along the surface (e.g., to spread the fluid, scrub the surface, wipe the surface, clean the surface, etc.). In some embodiments, the method includes wiping the surface and/or absorbing at least a portion of the dispensed fluid from the surface with a wiper of the cleaning device. In some embodiments, the wiper includes a wiping surface at least partially including a fabric or cloth material (e.g., microfiber cloth, cotton cloth, terry cloth and/or the like). In some embodiments, the method includes flipping or turning or reorienting the cleaning device to contact the surface being cleaned with the wiper, with the cleaning device having a dispensing surface of the dispenser and the wiping surface of the wiper positioned at different locations of the cleaning device (e.g., opposite to each other, perpendicular to each other, etc.). In some embodiments, the method includes squeezing a housing of the cleaning device to increase a flow of fluid onto the surface.

For purposes of this summary, certain aspects, advantages, and novel features of the present application are described herein. It is to be understood that not necessarily all such advantages may be achieved in accordance with any particular embodiment. Thus, for example, those skilled in the art will recognize that the concepts disclosed herein may be embodied or carried out in a manner that achieves one advantage or group of advantages as taught herein without necessarily achieving other advantages as may be taught or suggested herein.

BRIEF DESCRIPTION OF THE DRAWINGS

These and other features, aspects and advantages of the present application are described with reference to drawings of certain embodiments, which are intended to illustrate, but not to limit, the various inventions disclosed herein. It is to be understood that the attached drawings are for the purpose of illustrating concepts and embodiments of the present application and may not be to scale.

DETAILED DESCRIPTION

Figure 1A:
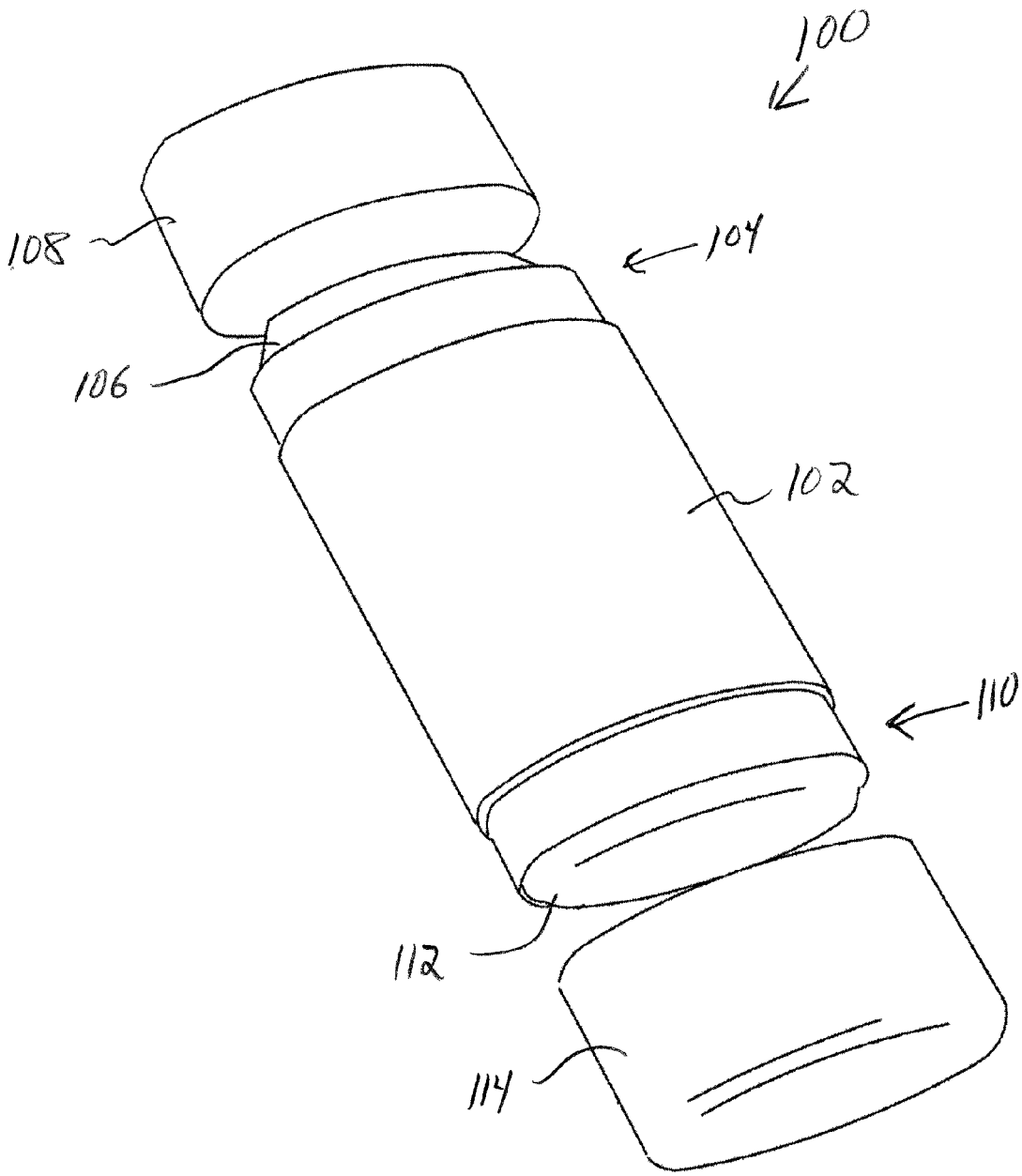
FIG. 1A illustrates a perspective view of an embodiment of a cleaning device.

Although several embodiments, examples and illustrations are disclosed herein, the various concepts described and/or illustrated herein extend beyond the specifically disclosed embodiments, examples, and illustrations and include other uses of the devices, systems and methods and modifications and equivalents thereof. Embodiments of the various concepts are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the various devices, systems and/or methods. In addition, the embodiments disclosed herein can comprise several novel features and no single feature is solely responsible for their desirable attributes or is essential to practicing the corresponding embodiments.

The embodiments disclosed herein include, among other things, cleaning devices that allow a user to dispense cleaning and/or sanitizing fluid stored at least partially in an internal cavity of the cleaning device onto a surface to be cleaned, such as a computer or phone (e.g., smartphone) or tablet displays. An increasing number of devices and objects that users touch, handle, or otherwise interact with periodically require cleaning and/or sanitizing. Consequently, better and more convenient options for dispensing cleaning, sanitizing and/or other fluids or substances and for wiping devices and/or other surfaces are desirable. Accordingly, described herein are various embodiments of devices for dispensing fluids and wiping surfaces.

Cleaning Devices

In some embodiments, a cleaning device comprises a housing (e.g., a shell, encapsulating member, etc.) configured to be handheld by a user. Such a device can comprise a dispensing end and a wiping end. The dispensing end can include a dispenser for dispensing cleaning fluid stored within an internal cavity of the housing, and the wiping end includes a wiper for wiping a surface of the device being cleaned. For example, when a user desires to clean a display (e.g., screen) of a laptop, smartphone or tablet, he or she can distribute cleaning fluid onto the display by touching the dispenser to (or coming in close proximity with) a surface of the display and optionally sliding or otherwise moving the dispenser relative to the surface. In some embodiments, the user uses the wiper of the device to wipe or absorb all or some of any remaining fluid or residue from the surface and/or to buff or polish the surface, as desired or required.

Various embodiments of the device are configured to store and dispense various cleaning and/or sanitizing fluids, such as, for example, alcohol or synthetic non-alcohol based cleaner or sanitizer. In some embodiments, the fluid comprises alcohol and one or more dilutants (e.g., water). The fluid can comprise one or more scents and/or other additives, as desired or required (e.g., to make the fluid more appealing to a person's sense of smell). Some embodiments include fluid intended to kill germs and bacteria, while other embodiments include fluid for other purposes, such as glass cleaner to remove streaks, smudges, fingerprints, etc. Some embodiments of a fluid contained within a device include a foaming agent, fluid and/or other material to help control a flow of the fluid exiting the device. In some embodiments, the fluid contained within a cleaning device comprises one or more other additives, components and/or substances, such as, for example, antibacterial fluids, fluids configured to leave an anti-glare or anti-fingerprint coating on the surface and/or the like. Alcohol-based cleaning fluids may be advantageous for use with electronics, because excess fluid evaporates relatively quickly.

The embodiments described herein have one or more advantages over existing methods and devices used to clean or sanitize surfaces. For instance, one advantage offered by at least some of the embodiments disclosed herein is the relatively compact, all-in-one cleaning solutions offered by the devices. A user can carry around a compact cleaning device, as described in various embodiments herein, in his or her pocket, backpack, purse, laptop bag, and the like. Accordingly, users of such devices are provided with an easy solution for cleaning a display, other surfaces and/or any other item conveniently and quickly. Some embodiments are configured to contain multiple uses of cleaning fluid, allowing a user to repeatedly clean a variety of surfaces without worrying about running out of cleaning fluid or having to find a trash receptacle to dispose, for example, a single-use cleaning wipe. Additionally, some embodiments of the devices disclosed herein are configured to be refillable. For example, some embodiments allow a user to fill or refill the cleaning device with one or more fluids and/or substances. Some embodiments allow a user to replace a dispenser and/or reservoir of the cleaning device to add fresh cleaning fluid and/or change the type of fluid dispensed by the device.

Various embodiments can enable a user to clean and/or sanitize a surface using only one hand. Other options for cleaning a surface, such as using a separate spray bottle and cleaning rag, often require the use of both of a user's hands.

However, some embodiments, such as those comprising an integrated dispenser, fluid cavity, and wiper, can advantageously permit a user to hold the device in one hand while using the other hand to dispense fluid onto a surface, clean the surface, and wipe the surface with the cleaning device.

Other methods of cleaning surfaces often have no easy way to control the amount of cleaning fluid used to clean a surface. For example, a pre-impregnated cleaning wipe may include too much or too little cleaning fluid, or a user may spray too much or too little cleaning fluid onto a cleaning rag. However, various embodiments described herein include a dispenser configured to dispense fluid at a predetermined flow rate defined at least partially by the dispenser's inherent resistance to fluid flow, such as through a known porosity or density of the dispenser material. Dispensers with different fluid flow characteristics may even be used to tailor a cleaning device to the particular fluid intended to be dispensed by that device. For example, one embodiment can use a dispenser comprising a porous material having relatively high porosity to dispense a fluid having a relatively high viscosity. Another embodiment can use a dispenser comprising a porous material having a relatively low porosity to dispense a fluid having a relatively low viscosity.

According to some embodiments, the devices comprise a removable cover that at least partially encapsulates or surrounds a dispenser and/or a wiper. This feature may be advantageous because, among other reasons, it can allow a user to store the cleaning device in his or her pocket, purse, computer bag, and the like without worrying about cleaning fluid leaking onto other items. A cover over the dispenser may additionally provide an air-tight or water-tight (or at least partially air-tight or water-tight) seal to help limit or reduce the likelihood of any loss of fluid while not using the cleaning device, such as through evaporation or leakage from the dispenser. Covers may additionally help to keep contaminants away from the dispenser and/or wiper when the cleaning device is not in use.

Cleaning devices as described herein may be valuable as advertising or promotional tools for businesses. For example, some embodiments include locations on the housing to add branding, images, text, etc. Some embodiments are even shaped to have an appearance of, for example, a corporate logo, a smartphone, a food item, etc.

Figure 1B:
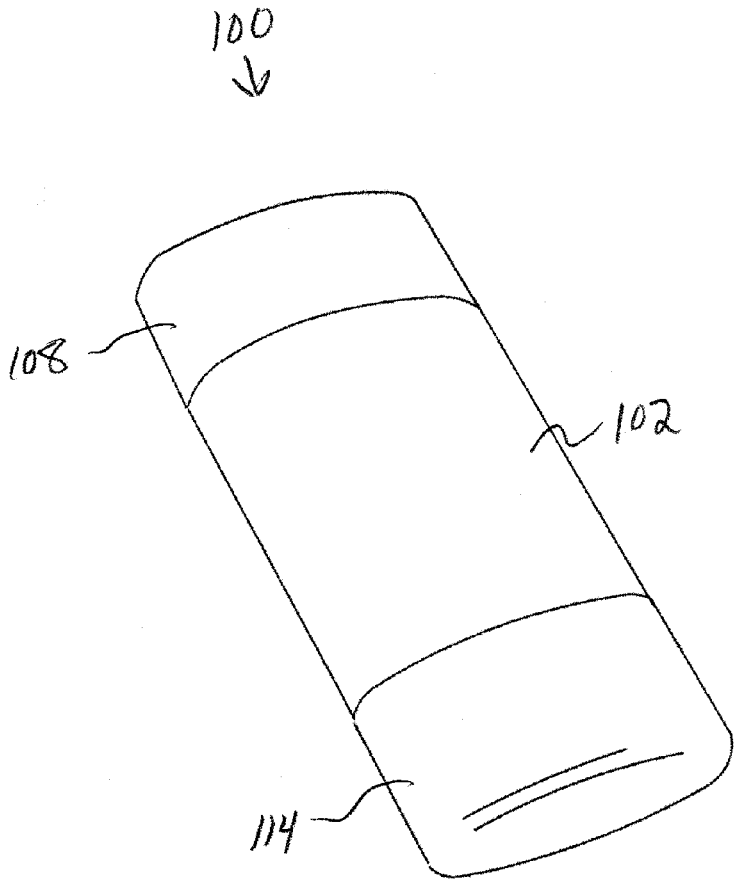
FIG. 1B illustrates a perspective view of the cleaning device of FIG. 1A.
Figure 1C:
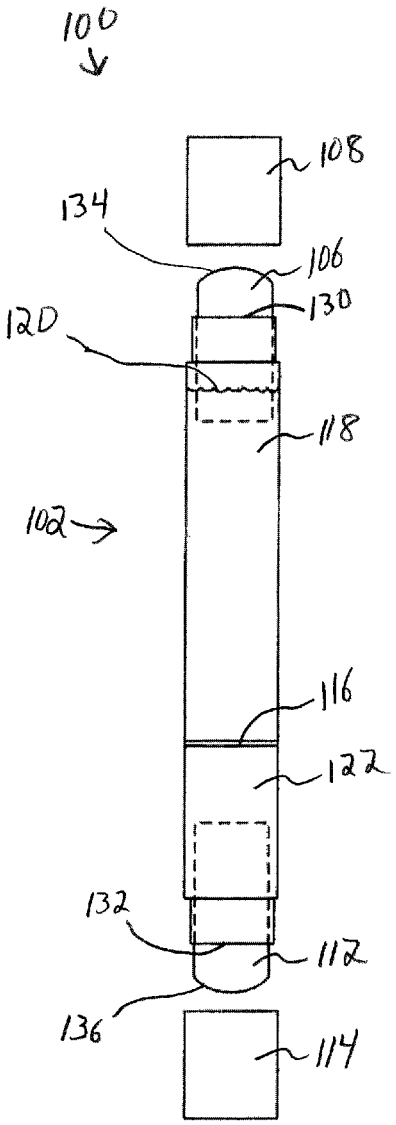
FIG. 1C illustrates a side view of the cleaning device of FIG. 1A.
Figure 1D:
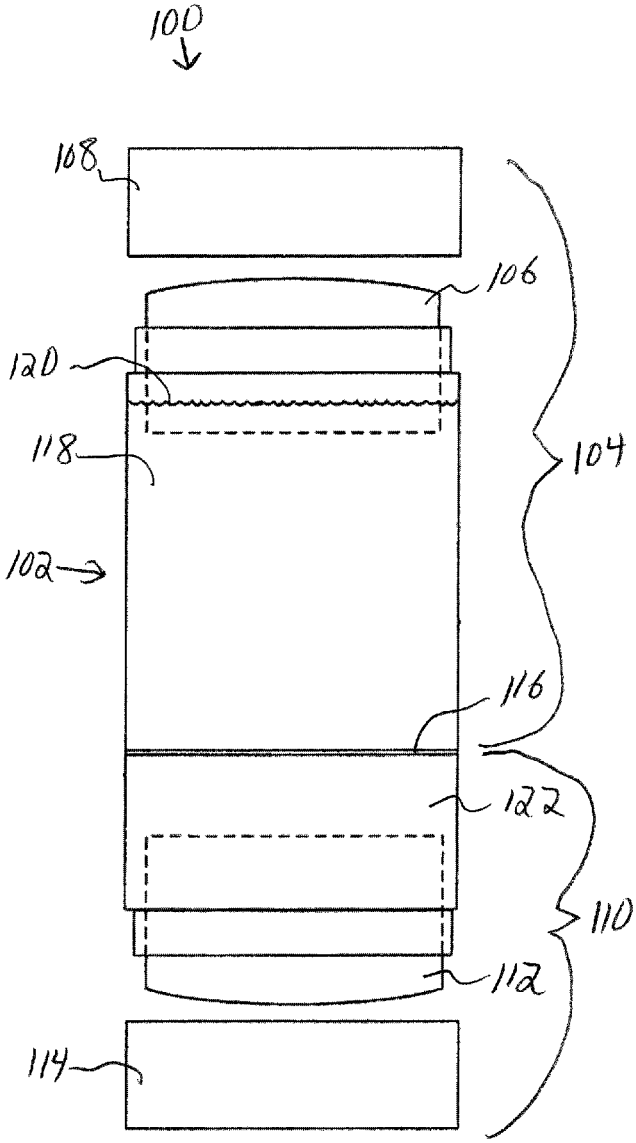
FIG. 1D illustrates a front view of the cleaning device of FIG. 1A.

FIGS. 1A through 1D illustrate an embodiment of a cleaning device 100. FIGS. 1A and 1B illustrate a perspective view of the cleaning device 100, FIG. 1C illustrates a side view of the cleaning device 100, and FIG. 1D illustrates a front view of the cleaning device 100. The illustrated cleaning device 100 comprises a housing 102, a dispenser cover 108 and a wiper cover 114. In the depicted embodiment, the cleaning device 100 additionally comprises a dispensing end 104 and a wiping end 110. As shown, the dispensing end 104 and wiping end 110 can be separated by one or more dividers 116.

In some embodiments, the wiping end 110 comprises a wiper cavity 122, a wiper opening 132, and a wiper 112. The wiper 112 comprises at least one wiping surface 136. The wiper 112 is positioned at least partially within the wiper cavity 122 and protrudes at least partially from the wiper opening 132 to an exterior of the housing 102. The wiping surface 136 may be used by a user to wipe a surface of for example, a screen or display (or other portion) of a television, a computer (e.g., laptop), a keyboard, a smartphone, a tablet or other electronic device with a display and/or the like to clean the surface, remove smudges or fingerprints, buff or polish the surface, etc. In some embodiments, the wiper 112 comprises an absorbent material configured to absorb, for example, excess cleaning fluid from a surface being cleaned.

With continued reference to the depicted embodiment, the dispensing end 104 comprises an internal cavity 118 and a dispenser 106. The dispensing end 104 additionally comprises a dispenser opening 130 through which the dispenser 106 at least partially protrudes. The dispenser 106 at least partially extends into the internal cavity 118 through the dispenser opening 130 and at least partially extends through the dispenser opening 130 to an exterior of the housing 102.

The dispenser 106 comprises an exterior surface or dispensing surface 134 configured to selectively dispense a cleaning fluid (and/or any other fluid or stored material) onto a surface to be cleaned. For example, a user may dispense cleaning fluid with the dispensing surface 134 onto a television screen, a computer screen, a keyboard, a smartphone, a tablet or any other surface requiring cleaning. The internal cavity 118 includes a volume of cleaning fluid 120 captured within the internal cavity 118. Such a fluid or other stored material can be in fluid communication with the dispenser 106. In some embodiments, the dispenser 106 comprises a fluid permeable material and/or an absorptive material. For example, the dispenser 106 can comprise felt, synthetic felt, porous plastic, foam, sponge, microfiber, cotton, polyester, extruded polyester fibers and/or the like. In some embodiments, the dispenser 106 is configured to absorb cleaning fluid 120 from within the internal cavity 118 and transfer at least a portion of the cleaning fluid 120 to the dispensing surface 134 for dispensing onto a surface to be cleaned.

In some embodiments, a dispenser is coated with one or more layers of a bonding agent that inhibits (or slows) growth of bacteria, viruses, and the like. This feature may be advantageous to extend the life of the dispenser, particularly since the dispenser is designed to come into contact with dirty and potentially contaminated surfaces. This feature may also be particularly useful when a dispenser is not totally impregnated with cleaning fluid (which can also help inhibit growth of bacteria, viruses, and the like), such as when a cleaning device is running out of fluid or has run out of fluid. Potential suppliers of such a bonding agent include, but are not limited to, Porex, Microban, and iFabric Corporation.

In some embodiments, the dispenser cover 108 is configured to fit over and encapsulate at least a portion of the dispenser 106 as shown in FIG. 1B. The wiper cover 114 is configured to fit over and encapsulate at least a portion of the wiper 112 as shown in FIG. 1B. In some embodiments, a housing comprises features (e.g., a ledge, a protrusion, etc.) configured to hold a dispenser cover and/or wiper cover while the cover is removed from its normal location encapsulating the dispenser and/or wiper. This can, for example, help a user to not lose a cover while the user is using the cleaning device to clean a surface.

In use, a user may use the cleaning device 100 to clean a variety of items or surfaces. For example, the user may wish to clean a smart phone, a computer screen, a keyboard, and the like. When a user wishes to clean a surface of an object, the user can remove the dispenser cover 108, revealing the dispensing surface 134 of the dispenser 106. The user can place the dispensing surface 134 against the surface to be cleaned to transfer cleaning fluid 120 from the dispensing surface 134 to the surface to be cleaned. Optionally, the user can slide the dispensing surface 134 around the surface to be cleaned to spread the cleaning fluid and/or to clean the surface. After applying cleaning fluid 120 to the surface to be cleaned, the user may replace the dispenser cover 108 and remove the wiper cover 114. The user may then place the wiping surface 136 on the surface to be cleaned and soak up any remaining cleaning fluid 120 or cleaning fluid residue, and/or buff or polish or dry the surface to be cleaned.

In some embodiments, the housing 102 is configured to be grasped by a user when cleaning a surface. In the embodiment shown in FIG. 1A, the cleaning device 100 comprises a housing 102 having a generally long and flat shape. However, in other embodiments the housing 102 may form a tapered design, a curved design, etc. For example, a design may include a tapered housing such that the dispenser is at a small end of the housing and the wiper is at a large end of the housing. This design may be advantageous when a user wants to dispense a small amount of cleaning fluid from the dispenser 106 but wants a large surface area of the wiper to soak up or wipe the remaining cleaning fluid and/or buff or polish the surface. In another example, the housing 102 may have a relatively long and skinny shape, for example a cylindrical shape similar to a pen.

The housing 102 can comprise plastic, metal, wood, and/or any other natural or synthetic material or combination of materials sufficient to perform the functions described herein. In some embodiments, the housing comprises a flexible material to allow a user to squeeze the housing to assist in dispensing cleaning fluid. In other embodiments, the housing comprises a substantially non-flexible material. In some embodiments, the housing 102 is configured to be rugged, and may, for example, comprise scratch proof, water proof, and/or rust proof materials. According to some embodiments, the wiper 112 comprises felt, porous plastic, microfiber cloth material, terry cloth material, plastic covered with a layer of microfiber cloth or terry cloth material, or any other material or combination of materials sufficient to perform the functions described herein. The dispenser 106 can comprise felt, porous plastic, microfiber material, plastic covered with a layer of microfiber cloth material, or any other material or combination of materials sufficient to perform the functions described herein.

In some embodiments, the dispenser 106 and/or the wiper 112 comprise one, two or more than two (e.g., a plurality of or multiple) layers. For example, the dispenser 106 may comprise a porous plastic or absorptive plastic material, but have a microfiber cloth layer forming at least a portion of the dispensing surface 134. Similarly, the wiper 112 may comprise a porous plastic material having a microfiber cloth material forming at least a portion of the wiping surface 136. In other embodiments the wiper 112 may primarily comprise a solid non-permeable material, such as plastic, metal, wood, and the like. In these embodiments, the wiper 112 may still have a layer of, for example, microfiber cloth material forming the wiping surface 136.

Figure 17:
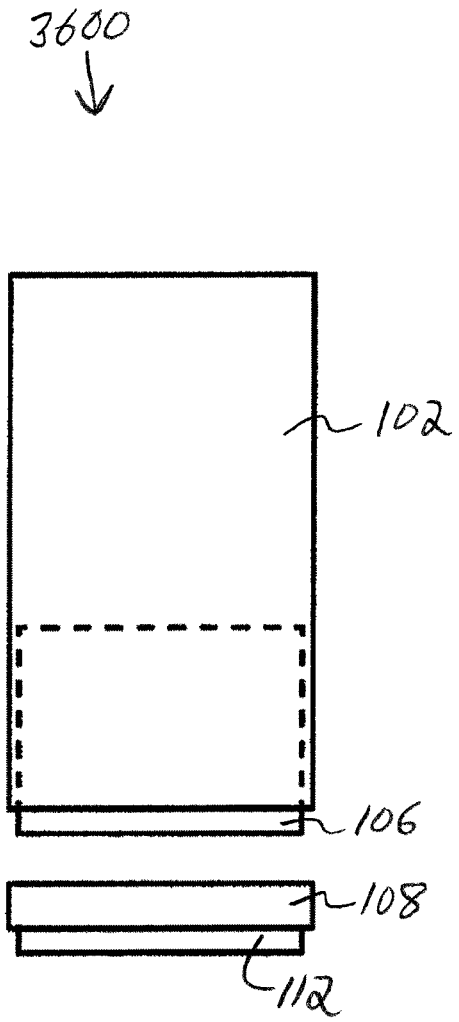
FIG. 17 illustrates a front view of an embodiment of a cleaning device.

In some embodiments, the wiper 112 is positioned on, along or near an exterior surface of the housing 102 rather than being positioned at least partially within a wiper cavity 122. For example, the wiper may be attached to an exterior surface of the housing an adhesive, a magnet, mechanical fasteners, etc. Although the cleaning device 100 illustrated in FIGS. 1A-1D shows an embodiment with the dispenser 106 positioned at an end of the housing 102 substantially opposite to an end of the housing 102 comprising the wiper 112, various other embodiments may position the dispenser 106 and wiper 112 differently. For example, the dispenser 106 may be positioned at a surface or end 90° from a surface or end comprising the wiper 112. The dispenser 106 may alternatively be positioned at a surface or end that is located at various other angles to an end or surface comprising the wiper 112. Additionally, as illustrated in FIG. 17, the wiper 112 may be located on the dispenser cover 108. In the embodiment shown in FIG. 17, the dispenser cover 108 can cover the dispenser 106 until a user is ready to dispense cleaning fluid onto a surface to be cleaned. Then, the user may remove the dispenser cover 108 and dispense cleaning fluid onto the surface to be cleaned using the dispenser 106. To wipe up any remaining cleaning fluid and/or to buff or polish the surface, the user may use the dispenser cover 108 as a single unit with the wiper 112 or the user may reposition the dispenser cover 108 back onto the housing 102 and then use the whole cleaning device 3600 with the wiper 112 to wipe up any remaining fluid and/or buff or polish the surface.

In some embodiments, a cleaning device comprises a housing 102, a dispenser 106, and a dispenser cover 108, but no wiper 112. For example, some embodiments are similar to the cleaning device illustrated in FIG. 17, but without the wiper 112. These embodiments may be advantageous to, among other things, minimize or reduce an overall size of the cleaning device.

Figure 16:
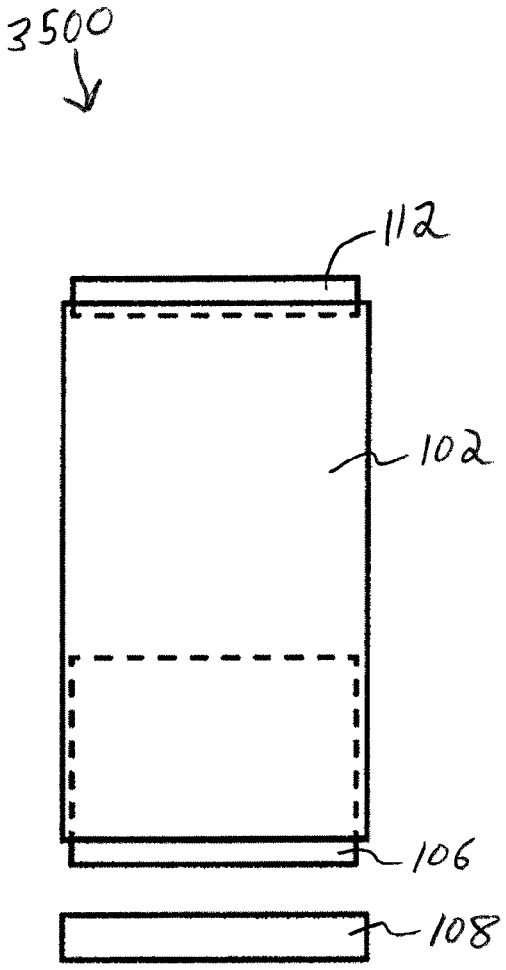
FIG. 16 illustrates a front view of an embodiment of a cleaning device.

In other embodiments the dispenser cover 108 and/or the wiper cover 114 is not included. For example, as shown in FIG. 16, a cleaning device 3500 includes a housing 102 comprising a wiper 112 and a dispenser 106. However, the cleaning device 3500 includes a dispenser cover 108 but no wiper cover 114. This configuration may be advantageous to minimize or reduce a size of the cleaning device, but to still retain the benefits of having a cover over the dispenser 106, such as helping to retain cleaning fluid in the housing 102 when the cleaning device 3500 is not in use. For example, in some embodiments, when the dispenser cover 108 is removed from the housing 102 the cleaning fluid 120 may tend to evaporate.

Although the cleaning device 100 illustrated in FIGS. 1A-1D illustrates a dispenser 106 extending into the dispenser opening 130 and at least partially into the internal cavity 118, some embodiments utilize a dispenser 106 positioned substantially exterior to the housing 102. For example, the dispenser 106 may be positioned over or adjacent to the dispenser opening 130 but not protrude into or through the dispenser opening 130. In other embodiments, the dispenser 106 may protrude a small amount into the dispenser opening 130 but be positioned mostly exterior to the housing 102.

In the embodiment shown in FIGS. 1A-1D, the dispenser 106 protrudes into the internal cavity 118 and is shown in contact with the cleaning fluid 120. In some embodiments the dispenser 106 may not always be in contact with the cleaning fluid 120. For example, if the internal cavity 118 is only one third full of cleaning fluid 120, the dispenser 106 may or may not be in contact with the cleaning fluid 120 depending on the orientation the housing 102 is held in. When the housing 102 is held in an orientation with the dispenser 106 pointing up, the dispenser 106 may not be in contact with the cleaning fluid 120 due to gravity pulling the cleaning fluid 120 to the bottom of the internal cavity 118. When the housing 102 is held in a position with the dispenser 106 pointing down, however, gravity may pull the cleaning fluid 120 into contact with the dispenser 106. In some embodiments, the internal cavity 118 includes a porous or absorbent material impregnated with fluid to at least partially maintain fluid contact between fluid in the internal cavity 118 and the dispenser 106 when the housing 102 is held in a position tending to pull the fluid away from the dispenser 106 under the force of gravity.

In some embodiments the dispenser 106 is configured to not allow cleaning fluid 120 to flow through it until a user forces the cleaning fluid 120 through the dispenser 106. For example, the dispenser 106 may be configured to have a resistance to fluid flow substantial enough that gravity cannot pull fluid through the dispenser 106. However, for example, the housing 102 may comprise a thin and/or flexible material configured to enable a user to squeeze the housing 102 to apply a pressure to the cleaning fluid 120 to force at least a portion of the cleaning fluid 120 through the dispenser 106 to the dispensing surface 134.

In some embodiments, the wiper 112 comprises a material impregnated, either partially or fully, with a cleaning fluid. The cleaning fluid can be the same cleaning fluid dispensed by the dispenser 106 or one or more different fluids. The wiper 112 can be configured to be impregnated or saturated with this fluid to different degrees or levels. For example, the wiper can be 0%-100% saturated, with 0% indicating no fluid, and 100% indicating full saturation. In some embodiments, the wiper 112 is configured to be saturated to a lower level than the dispenser 106. This may be advantageous, for example, for when a user requires a smaller amount of cleaning fluid than the dispenser 106 is configured to dispense. In some embodiments, the wiper 112 is configured to "dry out" or to reduce the level of saturation over time, such as through evaporation and/or application of the fluid to a surface being cleaned. In some embodiments, a fluid-impregnated wiper 112 is configured to be removable from the housing 102 to allow a user to, for example, replace the wiper 112 with a new wiper when the wiper 112 becomes insufficiently saturated or saturated below a certain level. In some embodiments, the wiper 112 comprises at least one layer or portion comprising porous plastic, synthetic felt, and/or the like, that is impregnated or saturated with a cleaning fluid. The at least one layer or portion can be configured to be in fluid communication with other portions of the wiper 112, to enable transfer or wicking of the fluid to other portions of the wiper 112 and/or to a surface being cleaned. In various embodiments including a wiper comprising fluid-impregnated material, in addition to various embodiments including a wiper not comprising fluid-impregnated material, the wiper can be configured to be used by a user either independently of the dispenser (e.g., to clean, buff, or polish a surface without first applying fluid from the dispenser) or in combination with the dispenser (e.g., to clean, buff, or polish a surface after applying fluid to the surface from the dispenser). Additionally, various embodiments can be configured to allow a user to use the dispenser independently of the wiper (e.g., to clean a surface using only the dispenser and not the wiper).

Figure 2A:
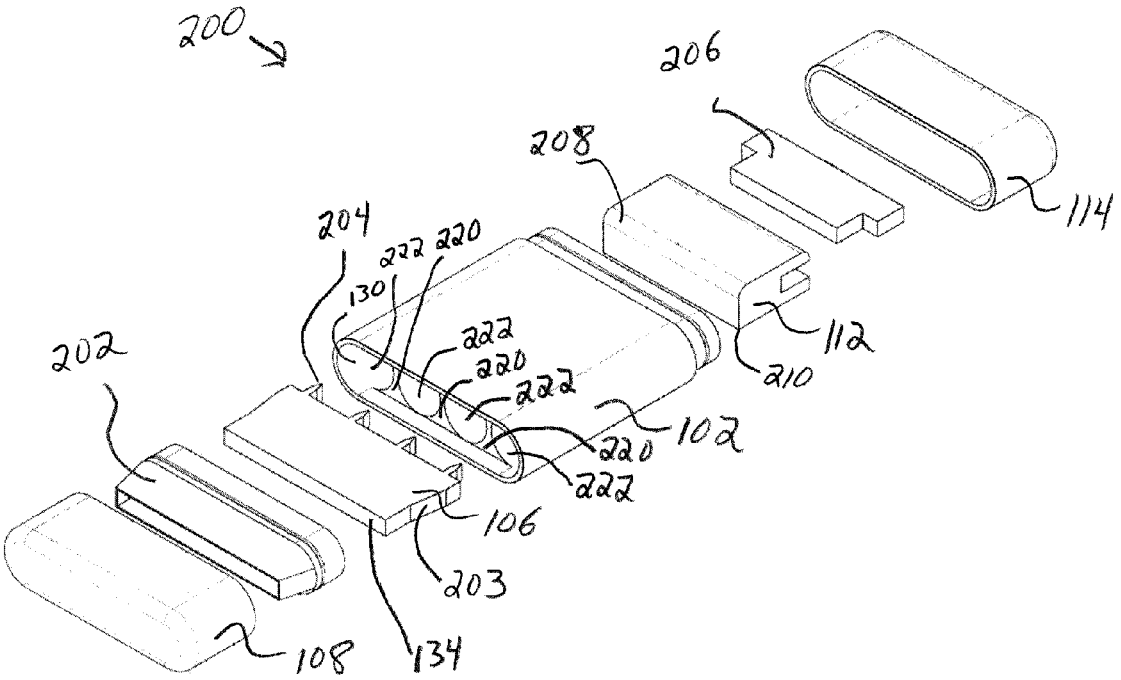
FIG. 2A illustrates an exploded view of an embodiment of a cleaning device.
Figures 2B, 2C:
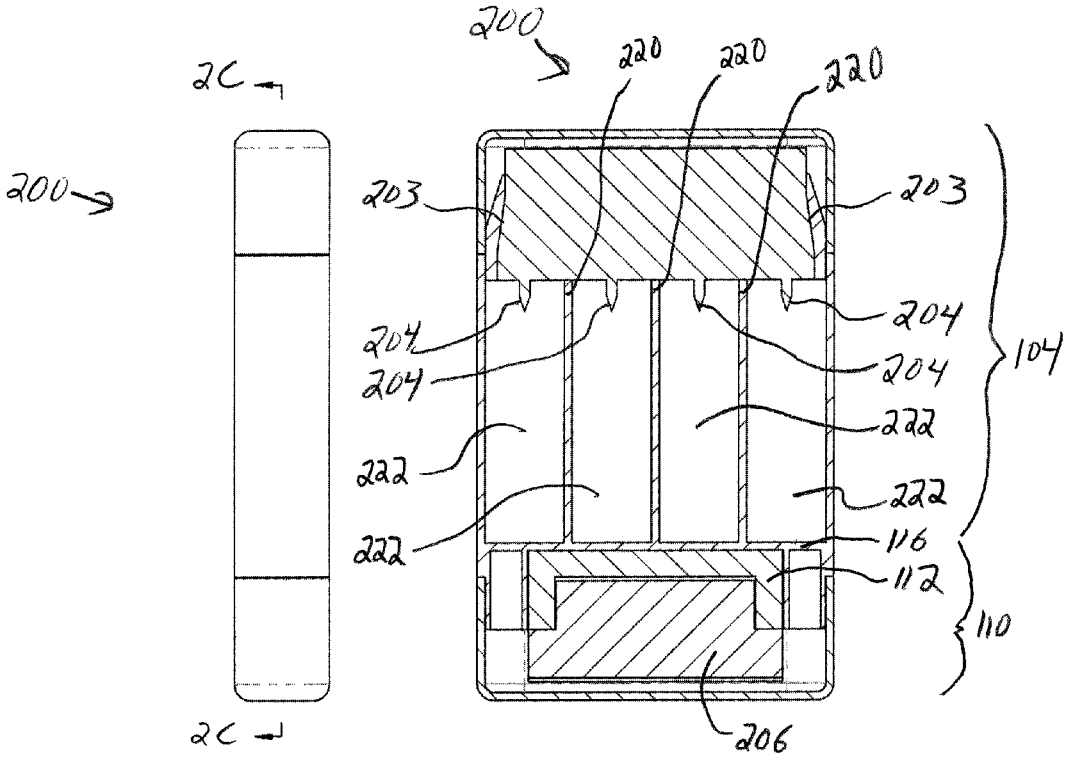
FIG. 2B illustrates a side view of the cleaning device of FIG. 2A.
FIG. 2C illustrates a cross sectional view of the cleaning device of FIG. 2A.
Figure 2D:
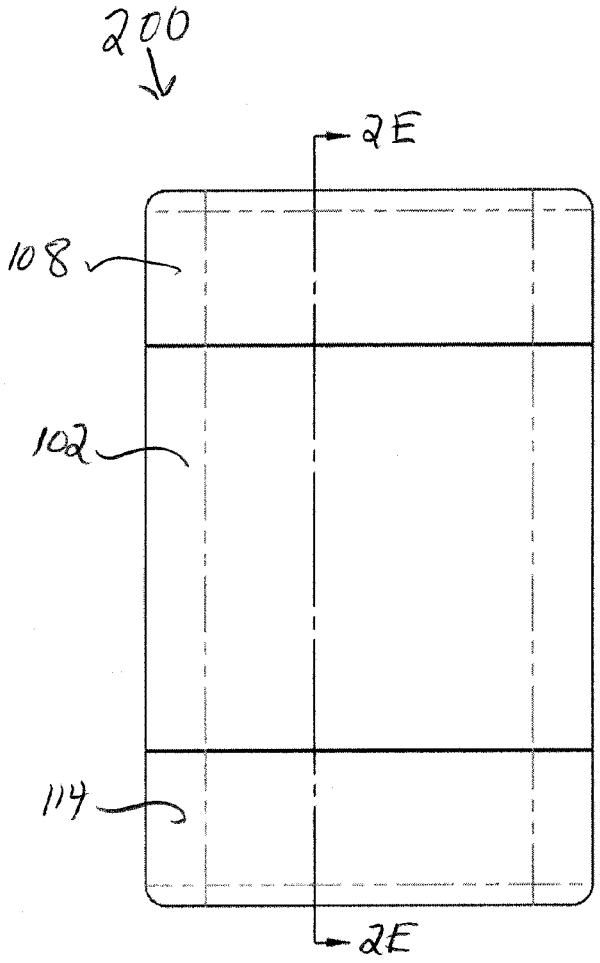
FIG. 2D illustrates a front view of the cleaning device of FIG. 2A.
Figure 2E:
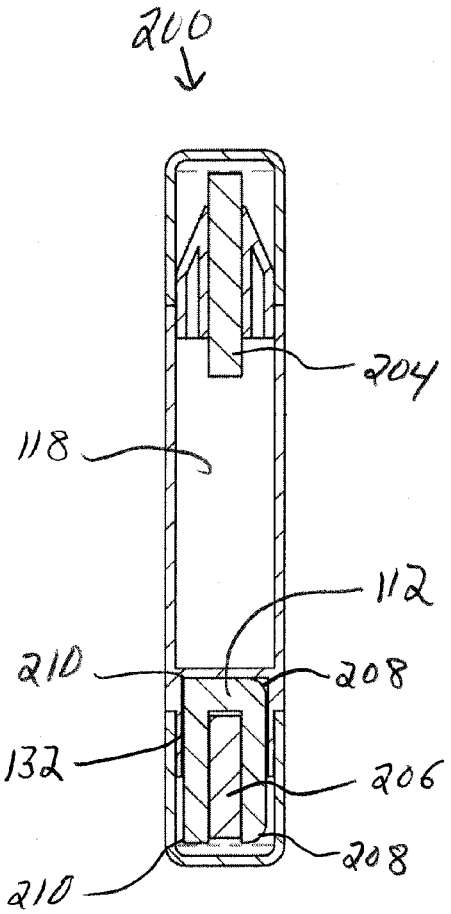
FIG. 2E illustrates a cross sectional view of the cleaning device of FIG. 2A.
Figure 2F:
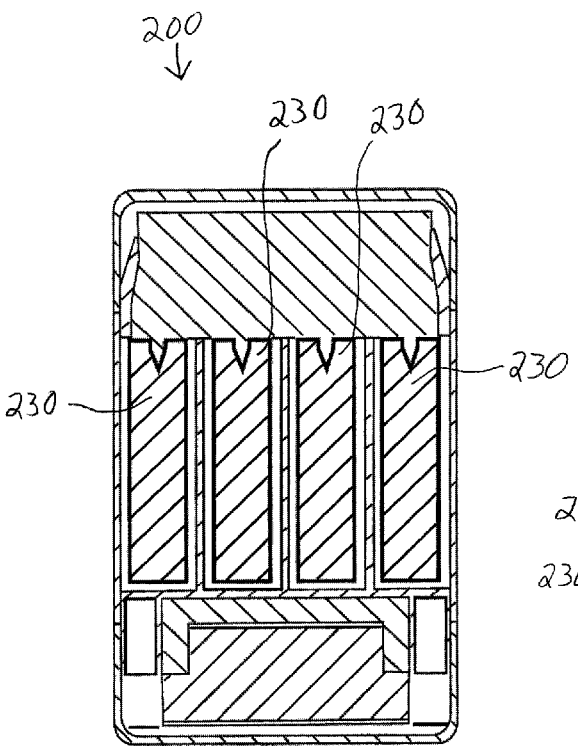
FIG. 2F illustrates a cross sectional view of the cleaning device of FIG. 2A.
Figure 2G:
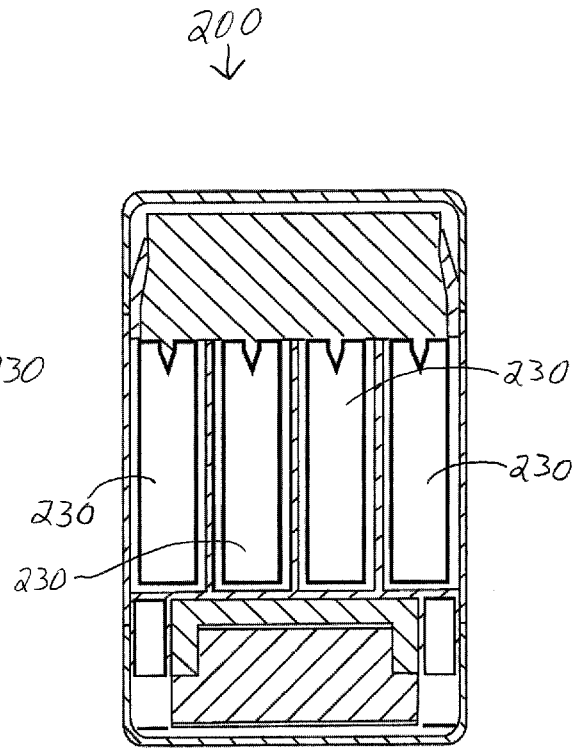
FIG. 2G illustrates a cross sectional view of the cleaning device of FIG. 2A.

FIGS. 2A-2G illustrate an embodiment of a cleaning device 200. FIG. 2A illustrates an exploded view of the cleaning device 200. FIG. 2B illustrates a side view of the cleaning device 200. FIG. 2C illustrates a cross sectional view of the cleaning device 200. FIG. 2D illustrates a front view of the cleaning device 200. FIGS. 2E-2G illustrate additional cross sectional views of the cleaning device 200.

The cleaning device 200 comprises a housing 102, a dispenser 106, a dispenser retainer 202, a dispenser cover 108, a wiper 112, a wiper retainer 206, and a wiper cover 114. The housing 102 includes an internal cavity 118 separated into four compartments 222 defined by internal cavity dividers 220. The internal cavity dividers 220 additionally provide rigidity to the housing 102 relative to a housing 102 not having any dividers 220. The dispenser retainer 202 at least partially surrounds the dispenser 106 and positions the dispenser 106 with respect to the housing 102 and its internal cavity 118. The dispenser 106 protrudes at least partially through an opening in the dispenser retainer 202.

The dispenser 106 of the cleaning device 200 comprises four protruding members 204. The protruding members 204 are positioned to protrude into the compartments 222 of the housing 102. The protruding members 204 are in fluid communication with the dispensing surface 134 of the dispenser 106 so that cleaning fluid contained in the compartments 222 may be transferred through the protruding members 204, through a main portion of the dispenser 106, and to the dispensing surface 134 to be applied to a surface to be cleaned. In some embodiments, the cleaning fluid 120 is contained directly within the compartments 222. In other embodiments, the cleaning device 200 comprises internal reservoirs 230 positioned at least partially within the compartments 222. For example, as shown in FIGS. 2F and 2G four reservoirs 230 are positioned within the compartments 222. In some embodiments, the reservoirs 230 are slidably or snugly positioned within the internal cavity 118 or compartments 222, and configured to be inserted through the dispenser opening 130. FIG. 2F shows reservoirs 230 comprising a fluid-absorbing, fluid holding, fluid dispensing, and/or porous material. For example, the reservoirs 230 shown in FIG. 2F may comprise a porous plastic, felt, synthetic felt, foam, fiber strands, cotton, sponge, microfiber, polyester, synthetic fiber, extruded polyester fibers, and the like. In some embodiments, the reservoir 230 comprises multiple layers. For example, the reservoir 230 may comprise a fluid absorbing material surrounded by an enclosing layer such as thin layer of plastic. The reservoirs 230 shown in FIG. 2G show reservoirs 230 having a containing wall and an interior hollow cavity or void. In the reservoirs 230 shown in FIG. 2G a cleaning fluid is contained or stored or retained within the hollow cavity or void of the reservoir 230. In any of the embodiments of reservoirs 230, the protruding member 204 of the dispenser 106 may protrude through an opening into the reservoir 230 to be in fluid communication with the reservoir 230.

In various embodiments of cleaning devices as described herein, a housing can comprise any number of compartments (e.g., zero, one, two, three, four, five, six, etc.), such as the compartments 222 shown in FIG. 2A, within an internal cavity of the housing and any number of reservoirs, including zero reservoirs, within the compartments. For example, some embodiments comprise a single compartment and a single reservoir. Some embodiments comprise more than one reservoir positioned at least partially within each compartment. Reservoirs can additionally be shaped in various ways. For example, the reservoirs 230 shown in FIG. 2F are generally cylindrical in shape. However, other reservoirs can be a rectangular shape, oval shape, star shape, etc. Additionally, in various embodiments of cleaning devices, a dispenser can comprise any number of protruding members (e.g., zero, one, two, three, four, five, six, etc.), such as the protruding members 204 shown in FIG. 2A, positioned to be in fluid communication with cleaning fluid within a housing. Some embodiments comprise more than one protruding member for each compartment or reservoir of the cleaning device.

Figure 3A:
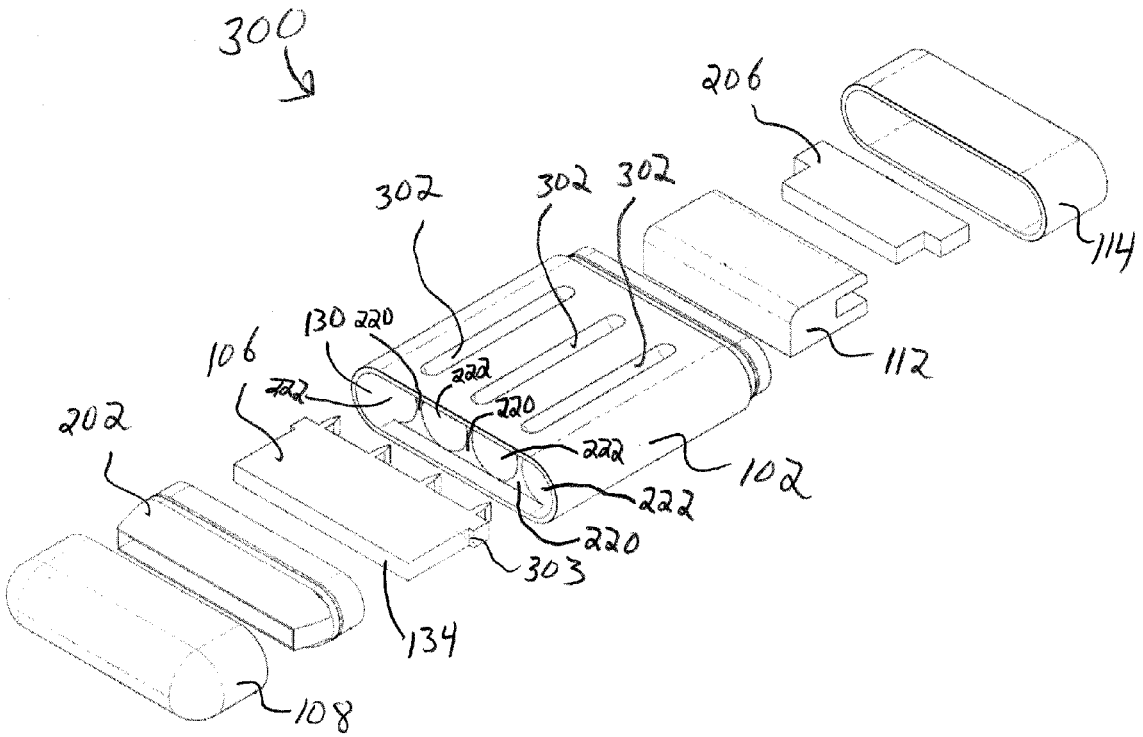
FIG. 3A illustrates an exploded view of an embodiment of a cleaning device.

Referring to the cleaning device 200 illustrated in FIG. 2A, the dispenser 106 is held in place substantially by the tapered surface 203 of the dispenser 106 contacting an interior surface of the dispenser retainer 202. However, in other embodiments the dispenser 106 may be retained in various other ways. For example, the embodiment of a cleaning device 300 shown in FIG. 3A shows a dispenser 106 with a flat surface 303 that contacts the dispenser retainer 202 to hold the dispenser 106 in place relative to the housing 102.

In some embodiments a cleaning device housing 102 includes voids or indentations in an exterior surface. For example, referring to FIG. 3A, the cleaning device 300 includes a housing 102 comprising voids 302. In this embodiment, the voids 302 are positioned between the compartments 222. The voids 302 may be, for example, molded into a plastic housing 102 or stamped into a metal housing 102. The voids 302 may be advantageous to reduce the material required to produce the housing 102 and/or to provide a gripping surface for a user. The voids 302 in some embodiments comprise a clear window allowing a user to see the amount of cleaning fluid remaining within the compartments 222. In some embodiments, the voids 302 are shaped to at least partially conform to the shape of a user's fingers to guide the user in how to hold the device while using it. The voids 302 can, for example, be shaped at least partially as a thumbprint or fingerprint.

The embodiments of cleaning devices shown in FIGS. 2A-2G and FIG. 3A include a removable wiper 112. The wiper 112 may be configured to be removed and reinstalled within the housing 102 in a different position from the position it was originally in. This may be advantageous to allow different surfaces of the wiper 112 to be used to wipe a surface being cleaned. For example, one surface of the wiper 112 may become dirty as it is being used. A user can then pull the wiper 112 from the housing 102, flip the wiper 180° and then reinstall the wiper to use a clean surface of the wiper to continue wiping the surface being cleaned. A wiper may additionally have surfaces configured for different uses. For example the wiper 112 shown in FIG. 2A includes a sharp edge 210 and a rounded edge 208. The sharp edge 210 may be useful to wipe in tight areas, such as the edge of a computer screen, the edge of a smartphone screen, within the spaces between keyboard keys, and the like. The rounded edge 208 may be advantageous to wipe larger surface areas, such as a computer screen, a smart phone screen, other large surfaces, and the like. In another example, a wiper has surfaces comprising different materials configured for different uses. For example, one wiping surface may comprise a relatively soft microfiber cloth material for general wiping and polishing use, while another wiping surface comprises a terry cloth material for removal of more stubborn stains, dirt, etc. In some embodiments, the cleaning device is configured to require a user to remove the wiper from the housing and to reinstall it in a different position to access a different wiping surface material. In other embodiments the cleaning device is configured to allow a user access to more than one wiping surface material without removing the wiper.

The embodiment of a cleaning device 200 shown in FIG. 2A includes a wiper retainer 206. The wiper retainer 206 is configured to fit at least partially within a void of the wiper 112 and to help retain the wiper 112 at least partially within the housing 102. The wiper retainer 206 may be configured to snap into a location or a void in the wiper 112 and then snap into a void or mounting location in the housing 102. The wiper retainer 206 may alternatively be configured to be held within a void in the wiper 112 and/or within the housing 102 using friction. In some embodiments, the wiper retainer 206 is configured to expand a portion of the wiper 112 after the wiper 112 is inserted into a void in the housing 102. By expanding a portion of the wiper 112, the wiper 112 is held within a void of the housing 102 through friction.

In some embodiments, the wiper retainer 206 shown in FIG. 2A is configured to at least partially retain a fabric layer or layers of the wiper 112. For example, the wiper 112 may comprise a microfiber cloth layer at least partially forming the wiping surface. In some embodiments, the wiper retainer 206 is configured to retain the fabric layer snugly or tightly enough to keep the fabric layer substantially in its installed position even when, for example, a user is wiping or rubbing a surface using the wiping surface. In some embodiments, the wiper retainer 206 is configured to be removable to allow a user to remove the fabric layer to be washed or replaced.

The wiper 112 and dispenser 106 of the cleaning device 200 may comprise various materials such as plastic, porous plastic, felt, metal, other materials described herein, and any other materials sufficient to perform the functions described herein. Additionally the wiper 112 and/or the dispenser 106 may comprise a single unitary object or may comprise multiple layers or multiple pieces attached to each other. For example, the dispenser 106 may have a cloth layer (e.g., microfiber cloth, terry cloth, soft cotton cloth, anti-microbial cloth, etc.) forming at least a portion of the dispensing surface 134.

In the embodiment shown in FIGS. 2A-2G, only the protruding members 204 of the dispenser 106 protrude into the internal cavity 118. However, in other embodiments, more or less of the dispenser 106 can be configured to protrude into the internal cavity 118. In some embodiments, the dispenser 106 comprises two or more separate portions in fluid communication with each other. For example, a first portion may include the protruding members 204 and extend into the internal cavity 118 and the individual compartments 222. A second portion of the dispenser 106 may be in fluid communication with the first portion, for example, by mating against the first portion at a mating surface. The second portion of the applicator or dispenser 106 may, for example, include the dispensing surface 134 for dispensing cleaning fluid onto the surface to be cleaned.

Figure 4A:
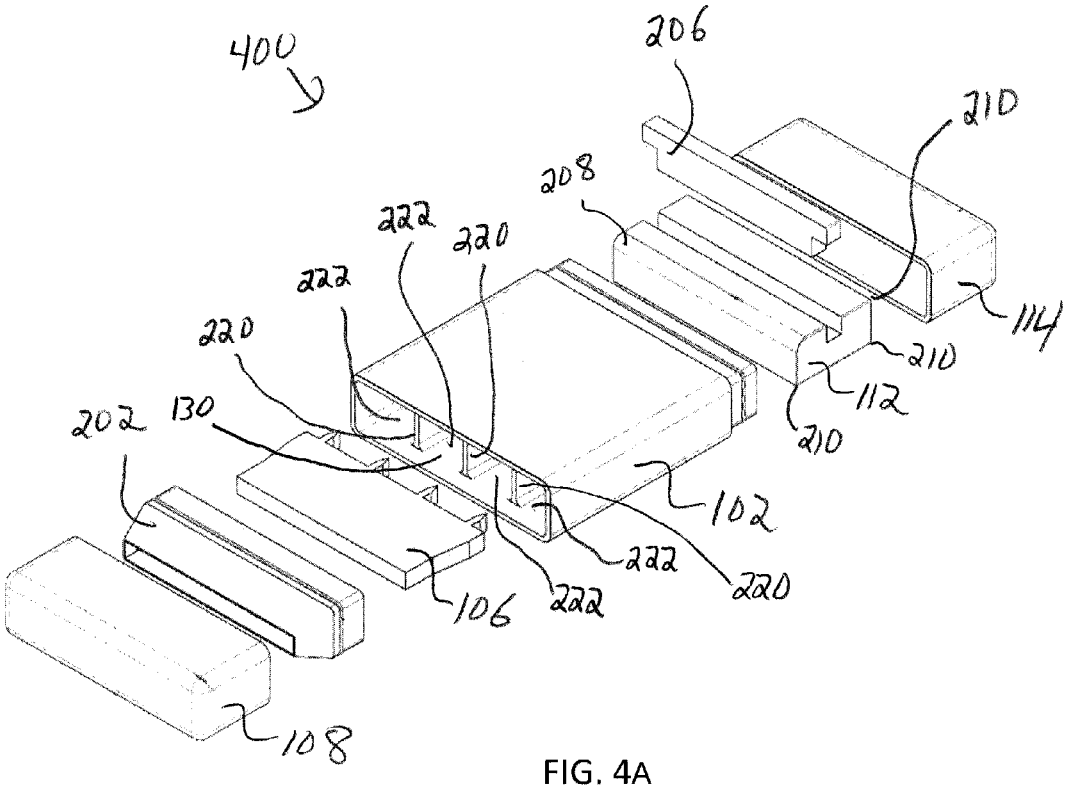
FIG. 4A illustrates an exploded view of an embodiment of a cleaning device.

FIG. 4A illustrates an exploded view of an embodiment of a cleaning device 400. The cleaning device 400 comprises a housing 102 having four compartments 222 within an internal cavity of the housing 102. The four compartments 222 are generally rectangular in cross section, with the shape of the compartments 222 being defined at least partially by internal cavity dividers 220. Although the compartments 222 are generally rectangular in shape in the cleaning device 400, reservoirs may still be used with the cleaning device 400 regardless of their shape as long as they fit at least partially within the compartments 222. For example, the cylindrical reservoirs 230 shown in FIGS. 2F and 2G may be used in the housing 102 shown in FIG. 4A, even though the compartments 222 of the cleaning device 400 are not cylindrical in shape.

Figure 3B:
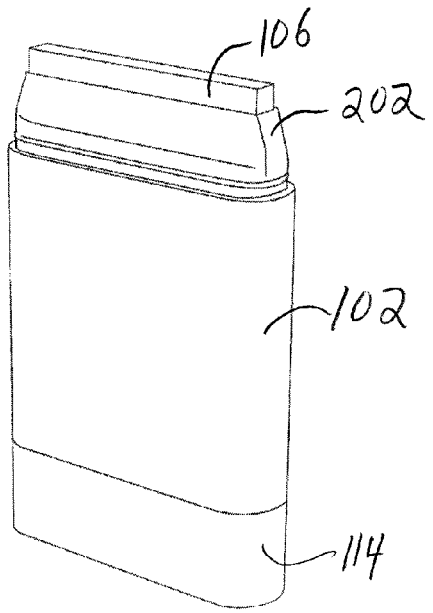
FIG. 3B illustrates a perspective view of an embodiment of a cleaning device.
Figure 3C:
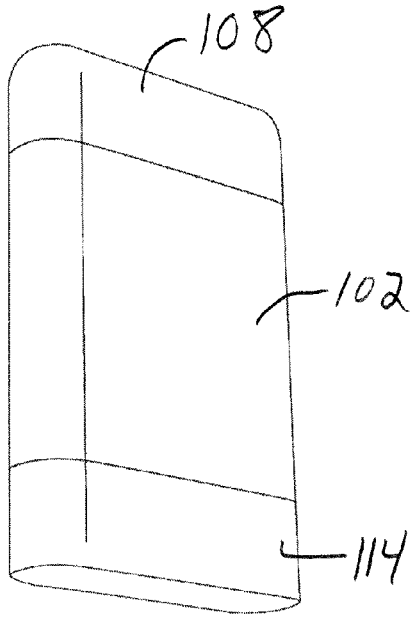
FIG. 3C illustrates a perspective view of an embodiment of a cleaning device.
Figure 3D:
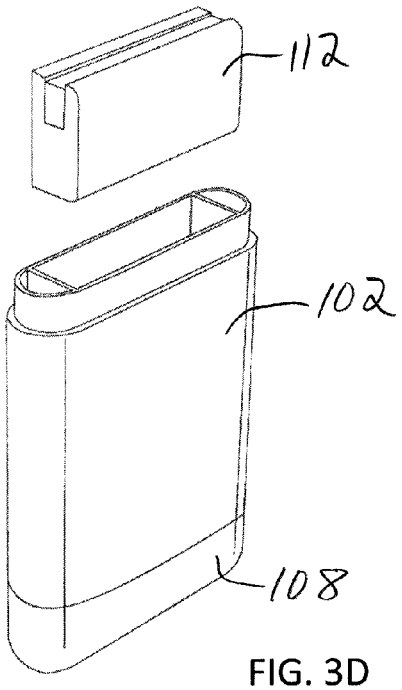
FIG. 3D illustrates an exploded view of an embodiment of a cleaning device.

The cleaning device 400 shown in FIG. 4A includes a wiper 112 having a wiper retainer 206 positioned on a side of the wiper 112 rather than on an end of the wiper 112. In some embodiments, the wiper retainer 206 retains the wiper 112 within the housing 102 through friction with the housing 102, by snapping into a predefined location within the housing 102, and/or using other fastening means. The wiper 112 of the cleaning device 400 includes a variety of wiping surfaces, such as a rounded edge 208 and a sharp edge 210 configured to wipe a variety of surfaces as previously described. Although the cleaning device embodiments shown in FIGS. 2A-2G and FIGS. 3A and 4A illustrate a removable wiper, any of these embodiments and other embodiments may include a generally non-removable wiper wherein the wiper 112 is substantially permanently installed within or attached to the housing 102. FIGS. 3B-3D illustrate perspective and exploded views of other embodiments of cleaning devices.

In various embodiments of cleaning devices as described herein, a dispenser 106 may be configured to regulate, restrict, or control, at least in part, a flow of fluid from an internal cavity 118 to an exterior of the housing 102 through the dispensing portion of the housing 102. In some embodiments, the dispenser 106 comprises a material that uses substantially the entire dispenser 106 to regulate the flow. For example, the dispenser 106 may entirely comprise felt, porous plastic, or other fluid-permeable material configured to regulate a fluid flow. In other embodiments, the dispenser 106 may have a regulating portion used to regulate the flow of fluid while one or more other portions of the dispenser 106 provide no resistance or a lesser resistance to fluid flow. For example, a portion of the dispenser 106 may comprise a material, such as a sponge or foam material, that provides relatively little restriction in flow to a cleaning fluid, while another portion of the dispenser 106 may comprise a material, such as porous plastic or felt, that provides a relatively high restriction to flow of a fluid. In some embodiments, a portion of the dispenser 106 that is directly in contact with cleaning fluid positioned within an internal cavity 118 of a housing 102 may have little resistance to fluid flow. The fluid may be transferred through this portion of the dispenser 106 to a second portion, such as a felt layer, that has a relatively high restriction to fluid flow. The second layer, such as a felt layer, may form the dispensing surface 134 in some embodiments and directly contact a surface to be cleaned. In other embodiments, there may be yet another layer forming a third portion, such as a microfiber cloth material over the second portion, wherein the third portion is the portion of the dispenser 106 that primarily contacts the surface to be cleaned.

Figure 5A:
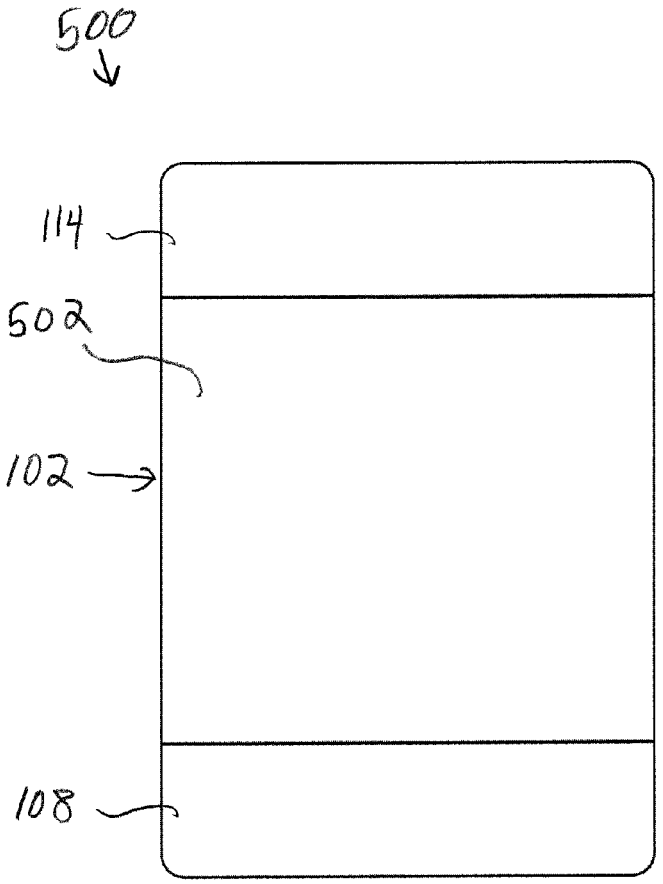
FIG. 5A illustrates a front view of an embodiment of a cleaning device.
Figure 5B:
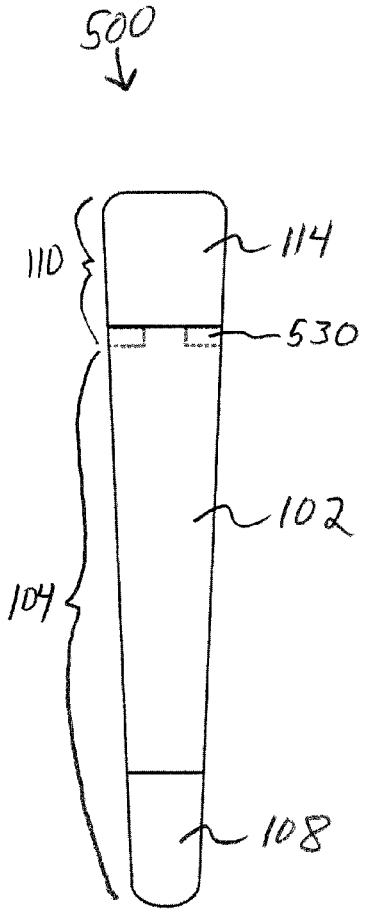
FIG. 5B illustrates a side view of the cleaning device of FIG. 5A.
Figure 5C:
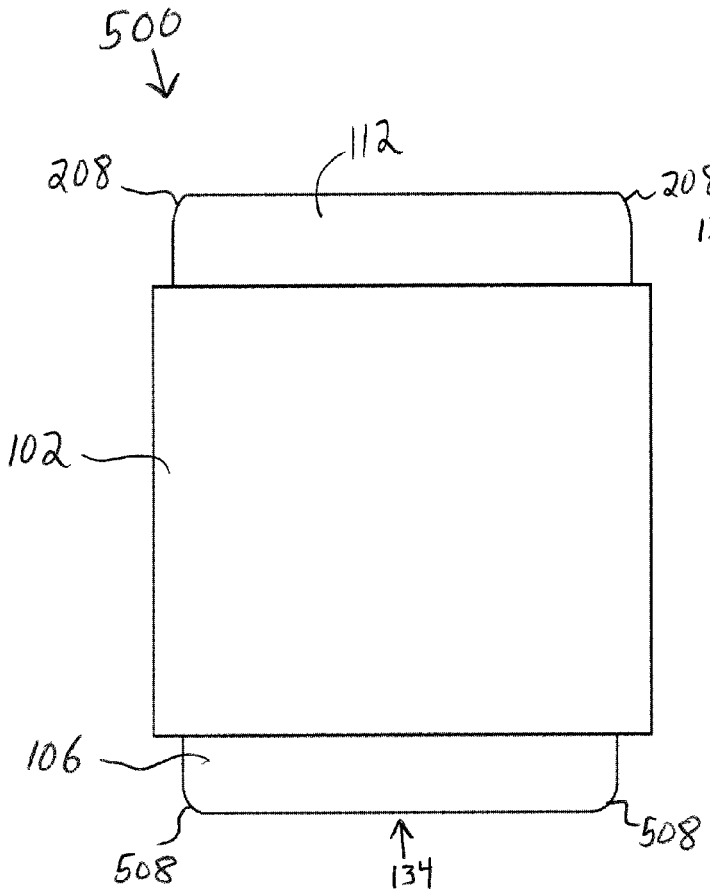
FIG. 5C illustrates a front view of the cleaning device of FIG. 5A with its dispenser cover and wiper cover removed.
Figure 5D:
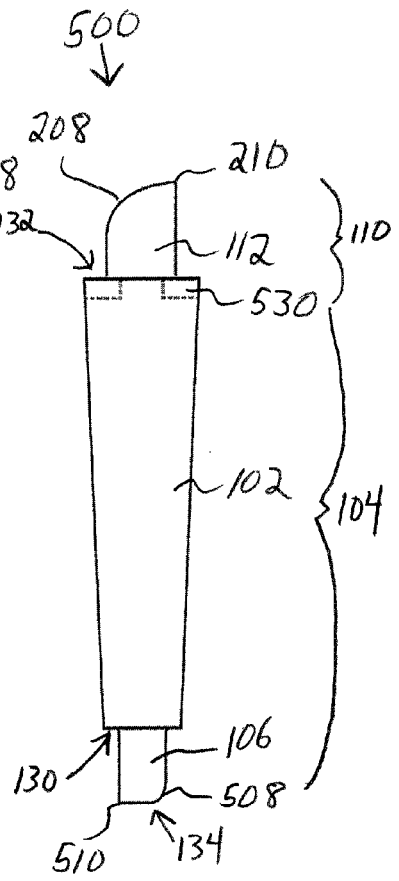
FIG. 5D illustrates a side view of the cleaning device of FIG. 5A with its dispenser cover and wiper cover removed.
Figure 5E:
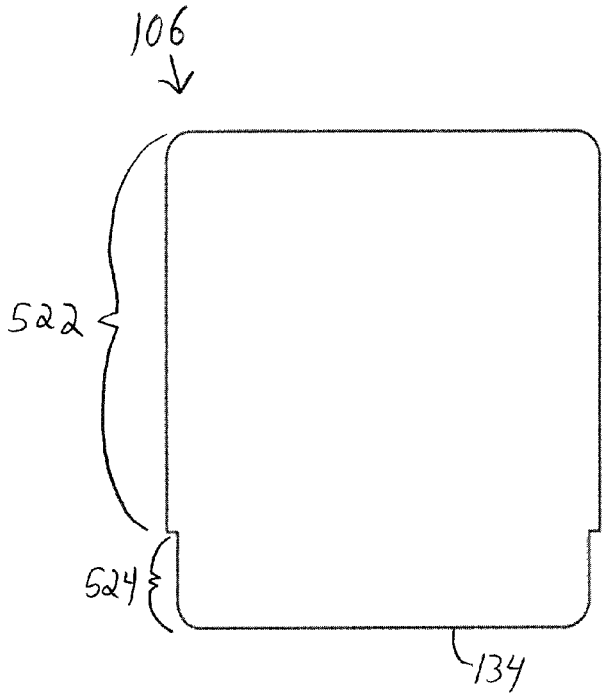
FIG. 5E illustrates a front view of the dispenser of the cleaning device of FIG. 5A.
Figure 5F:
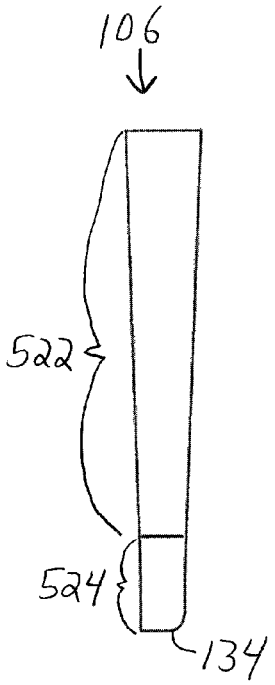
FIG. 5F illustrates a side view of the dispenser of the cleaning device of FIG. 5A.
Figure 5G:
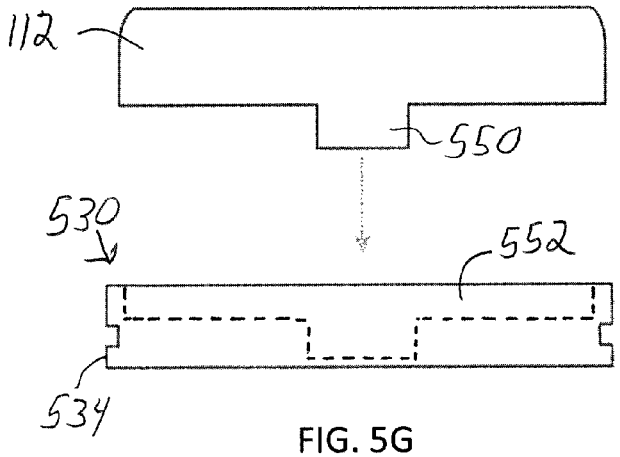
FIG. 5G illustrates a front view of the wiper and wiper retainer of the cleaning device of FIG. 5A.
Figure 5H:
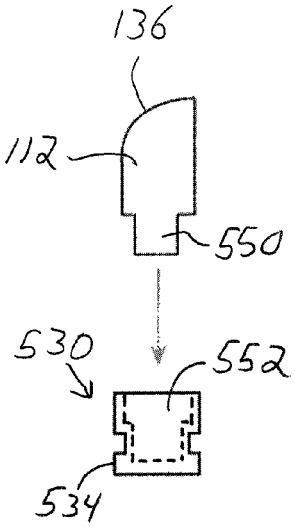
FIG. 5H illustrates a side view of the wiper and wiper retainer of the cleaning device of FIG. 5A.

FIGS. 5A through 5H illustrate an embodiment of a cleaning device 500. FIGS. 5A and 5B illustrate a front view and a side view of the cleaning device 500, respectively. FIGS. 5C and 5D illustrate a front view and a side view of the cleaning device 500 with its dispenser cover 108 and wiper cover 114 removed. FIGS. 5E and 5F illustrate a front view and a side view of the dispenser 106 of the cleaning device 500. FIGS. 5G and 5H illustrate a front view and a side view of the wiper 112 and a wiper retainer 530 of the cleaning device 500.

As illustrated in FIGS. 5B and 5D, the cleaning device 500 comprises a housing 102, dispenser cover 108, and wiper cover 114 forming a generally tapered design. In some embodiments, a large end of the tapered design (e.g., at the wiper cover) is approximately 0.685 inches thick, and a small end of the tapered design (e.g., at the dispenser cover) is approximately 0.375 inches thick. In the embodiment shown in FIGS. 5B and 5D, a smaller end of the tapered design includes the dispenser 106 and a larger end of the tapered design includes the wiper 112. This design may be advantageous, for example, to have a smaller dispenser 106 to better regulate a flow of cleaning fluid to the dispensing surface 134. For example, the dispensing surface 134, in this and any other embodiment, may be configured to be a certain size to enable a certain level of flow of cleaning fluid based on a known resistance of the dispenser's material to fluid flow and/or a viscosity of the cleaning fluid transferred through the dispenser 106. In various embodiments, the cleaning device 500 may be configured to be various sizes and/or have various amounts of taper to create various sizes of dispensing surfaces 134 based on the desired level of fluid flow. In some embodiments, other characteristics of a dispenser can also be configured to produce a desired level of fluid flow, for example, pore size of a porous plastic, density of a felt, etc.

In the embodiment shown in FIGS. 5A-5H the wiper 112 is positioned at the larger end of the tapered design. This may be advantageous, for example, by allowing for a larger wiper 112 with a larger wiping surface 136. In use, it may be desirable to have a smaller dispensing surface 134 than wiping surface 136. In the embodiment shown in FIGS. 5A-5H, the wiper 112 includes a rounded edge 208 and a sharp edge 210. This may be advantageous to allow wiping in constrained areas, such as between keyboard keys or at the edge of a TV or computer screen with the sharp edge 210. It may be advantageous to use the rounded edge 208 to provide a larger surface area to wipe larger areas not requiring a sharp edge 210.

In some embodiments, including the cleaning device 500 and other embodiments, the wiper 112 comprises an at least partially deformable or compressible material. For example, when a user presses the wiping surface 136 against a surface to be cleaned, the wiper 112 may compress or deform to conform to the surface being cleaned and provide a larger surface contact area with the surface being cleaned. In some embodiments, the wiper 112 comprises more than one layer. For example, an interior portion of the wiper 112 may comprise a less deformable and/or less absorbent material, such as a plastic or metal material, and an exterior portion of the wiper 112 may comprise a more deformable and/or more absorbent material, such as microfiber cloth, cotton cloth, a sponge material, and the like.

The wiper 112 of the cleaning device 500 may be configured to be removable from the housing 102. As shown in FIGS. 5G and 5H a wiper retainer 530 is configured to fit within a cavity of the housing 102 and to have a portion of the wiper 112 fit within a mounting cavity 552 of the wiper retainer 530. A mounting plug 550 protrudes from the wiper 112 and fits within the mounting cavity 552 of the wiper retainer 530. The wiper retainer 530 may be configured to have a substantially permanent connection to the housing 102. For example, the housing lip 534 of the wiper retainer 530 may fit within a mating lip of the housing 102 forming a substantially permanent connection. The wiper 112 may, however, be configured to be relatively easily removed from the wiper retainer 530 for replacement of the wiper, using the wiper 112 as an individual device, and/or to clean the wiper 112. For example, the mounting plug 550 may be configured to have a friction fit within the mounting cavity 552. A user may overcome the force of the friction fit by pulling on the wiper 112 to release it from the wiper retainer 530. This may be advantageous, for example, to clean the wiper 112 if it is dirty. This may also be advantageous if the wiper 112 includes a fabric layer on an exterior of the wiper 112, because the wiper 112 may be configured to have the fabric layer be removable from the wiper 112. The fabric layer may be removed to replace it with a new fabric layer and/or to wash the fabric layer and replace it back onto the wiper 112. The fabric layer of the wiper 112 may be retained on the wiper 112 through various means including, but not limited to, adhesives, staples, other mechanical fasteners, and/or being held in place by a portion of the wiper retainer 530 when the wiper 112 is positioned within the mounting cavity 552 of the wiper retainer 530.

In some embodiments, the wiper 112 comprises more than one fabric layer (e.g., 2, 3, 4, 5, 6, etc.). The wiper 112 can, for example, comprise a single piece of fabric or cloth wrapped one or more times around itself to form multiple fabric layers. The wiper 112 can also, for example, comprise multiple pieces of fabric or cloth (of either the same type of fabric or cloth or different types), wherein each piece of fabric or cloth forms one or more of the more than one fabric layers. Multiple fabric layers may be advantageous, for example, to help absorption, to make a softer wiper surface, or to increase deformability or compressibility of the wiper 112.

Figure 5J:
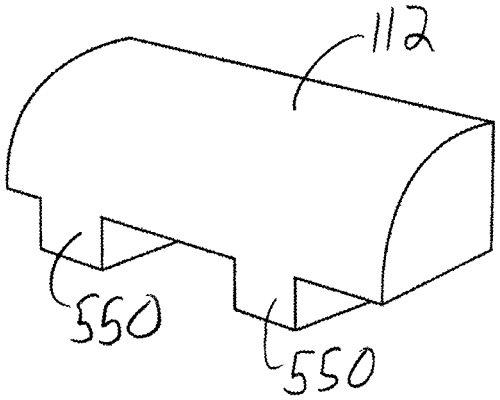
FIG. 5J illustrates a perspective view of an embodiment of a wiper of a cleaning device.

In various embodiments, a wiper is retained to a housing or wiper retainer, permanently or removably, using various other methods. For example, as illustrated in FIG. 5J, an embodiment of a wiper 112 comprises two mounting plugs 550 instead of one mounting plug. The two mounting plugs 550 are configured to mate with a mounting cavity to retain the wiper 112 to a housing and/or wiper retainer. Other embodiments may include any number of mounting plugs 550. In another example, FIG. 36B illustrates an embodiment retaining a wiper 112 to a housing 102 utilizing a fastener 810. This embodiment is described in greater detail below.

Referring to FIGS. 5A-5F, the dispenser 106 of the cleaning device 500 includes an internal portion 522 and an external portion 524. In some embodiments, the internal portion 522 and external portion 524 comprise separate parts or components in fluid communication with each other. In other embodiments, the dispenser 106 is one unitary part or component (for example, one piece of the same material, such as porous plastic, felt, etc.) comprising an internal portion 522 and external portion 524. In this embodiment, the internal portion 522 is positioned or extends substantially within an internal cavity of the housing 102, and the external portion 524 is positioned substantially exterior to the housing 102. In various embodiments, varying amounts of the dispenser 106 may be positioned or extend within the housing 102 or be positioned exterior to the housing 102. For example, 90% of the dispenser 106 may be positioned within the housing 102 while the remaining 10% is positioned external to the housing 102. In other embodiments, 5% of the dispenser 106 may be positioned exterior to the housing 102. In some embodiments, hardly any, if any, of the dispenser 106 is positioned exterior to the housing 102. For example, the dispensing surface 134 may be positioned substantially parallel to an exterior edge or surface of the housing 102 with substantially the entire dispenser 106 being positioned within a cavity of the housing 102. In other embodiments, various percentages of the dispenser 106 are positioned exterior to the housing, such as 1%, 10%, 20%, 30%, 40%, 50%, etc.

Figure 42:
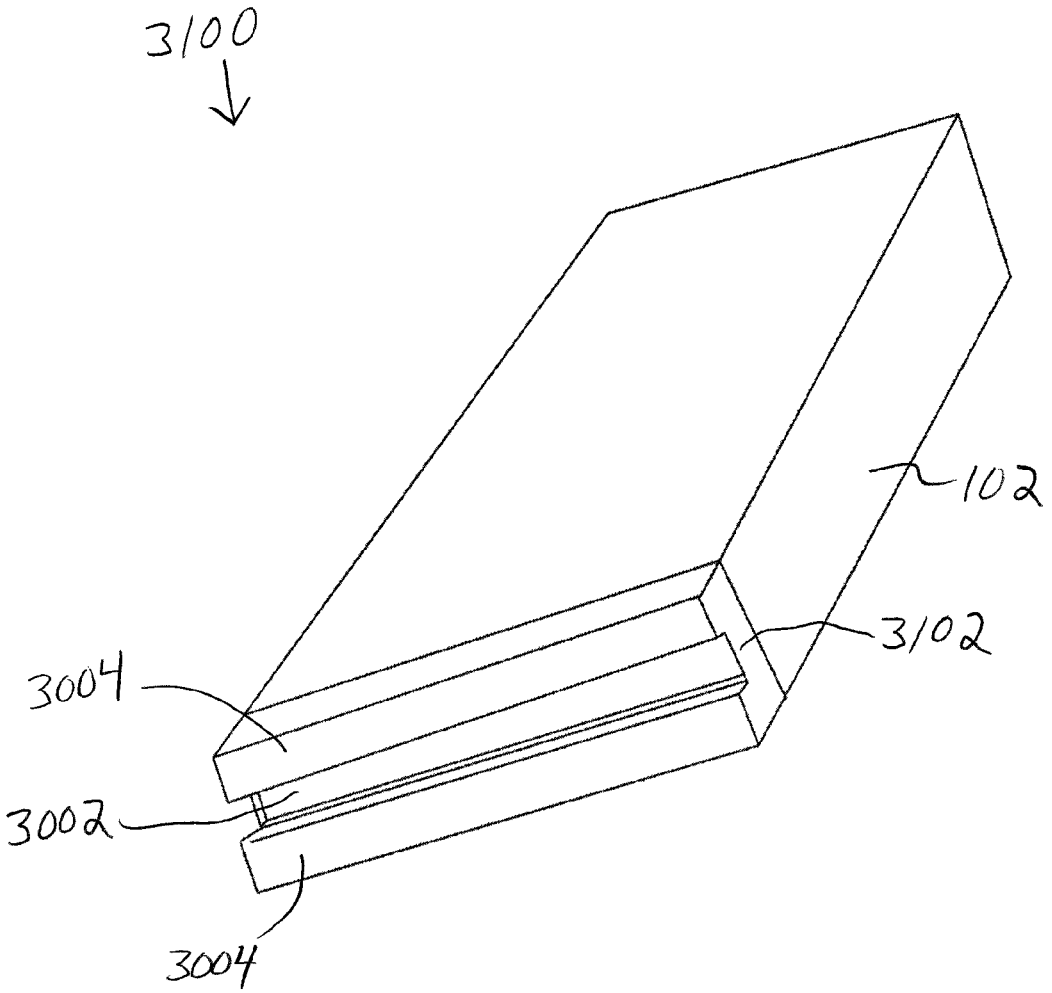
FIG. 42 illustrates a perspective view of an embodiment of a cleaning device.

In some embodiments, the entire dispenser 106 is positioned within a cavity of the housing 102. For example, a dispensing surface, such as the dispensing surface 134, is positioned within a recess, similar to how the ultraviolet light source 3002 shown in FIG. 42 is positioned within a recess formed by the protruding members 3004. In some embodiments, the cleaning device is configured to dispense cleaning fluid from a recessed dispensing surface 134 when a user squeezes the housing 102, forcing at least a portion of cleaning fluid stored in the dispenser 106 out of the dispenser 106. In some embodiments, a recessed dispensing surface includes one or more nozzles or sprayers to spray cleaning fluid onto a surface being cleaned when a user, for example, squeezes the housing. In some embodiments, the wiper 112 is configured to be removable from the housing 102 and positioned in front of or at least partially within a recess adjacent to a recessed dispensing surface 134 in order for a user to dispense cleaning fluid from the dispenser 106 onto the wiper 112. The user can then use the wiper 112 to clean the surface being cleaned.

In some embodiments, the internal portion 522 fits snugly within an internal cavity of the housing 102. The internal portion 522 may have a sliding fit with the internal cavity of the housing 102. The internal portion 522 in some embodiments can completely or substantially completely fill the internal cavity of the housing 102. In other embodiments, the internal portion 522 may only fill, for example, 90%, 80%, 70%, 60%, 50%, 40%, 30%, 20%, 10%, etc. of the internal cavity of the housing 102. In some embodiments where the internal portion 522 of the dispenser 106 substantially fills the internal cavity of the housing 102, cleaning fluid is stored almost entirely within the dispenser 106 for dispensing at the dispensing surface 134. In some embodiments where the internal portion 522 does not substantially fill the internal cavity of the housing 102, a volume of cleaning fluid may be stored in the dispenser 106 while a separate volume of cleaning fluid may be stored in the remainder of the internal cavity that is not filled by the internal portion 522 of the dispenser 106. In some embodiments, the internal portion 522 is in fluid communication, however, with at least a portion of the remainder of the internal cavity. In use, when a user dispenses cleaning fluid from the dispensing surface 134 of the dispenser 106, the cleaning fluid may be transferred from the internal portion 522 to the external portion 524 for dispensing at the dispensing surface 134. Cleaning fluid may also be transferred from the internal cavity of the housing 102 to the internal portion 522 of the dispenser 106 and to the external portion 524 of the dispenser 106 for dispensing at the dispensing surface 134. In some embodiments, the dispenser 106 is not in fluid communication with the internal cavity of the housing 102, and cleaning fluid is retained entirely within the dispenser 106 for dispensing at the dispensing surface 134.

Figure 6A:
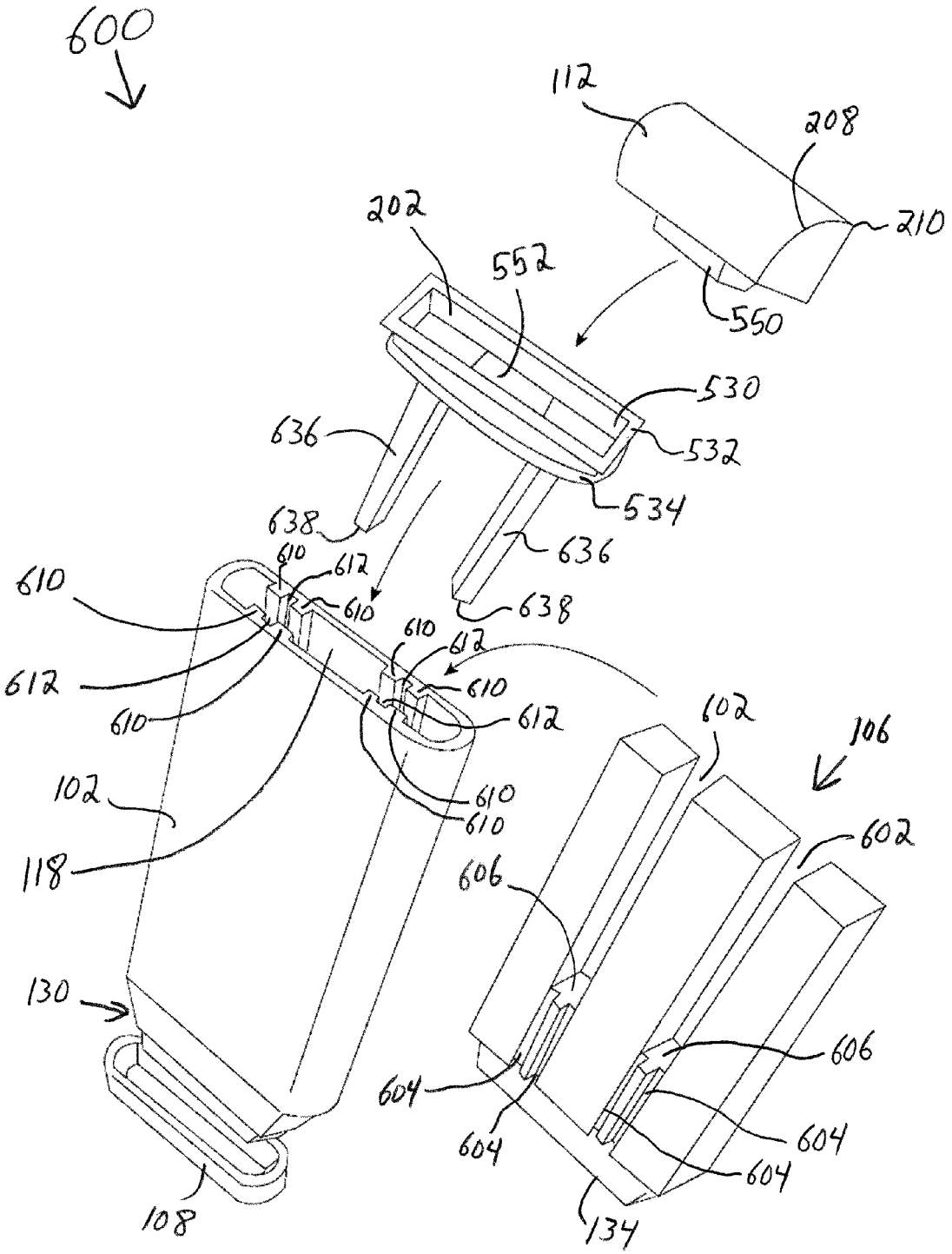
FIG. 6A illustrates an exploded view of an embodiment of a cleaning device.

Referring to FIG. 5F, the dispenser 106 of the cleaning device 500 has a generally tapered design. In this embodiment, a smaller end of the tapered design has a width of approximately 0.25 inches. However, in other embodiments the dispenser 106 may be made in various shapes. For example, the dispenser 106 may be substantially rectangular. The dispenser 106 may even have shapes or features or voids to accommodate a design of the internal cavity of the housing 102, such as is illustrated in FIG. 6A.

The dispenser 106 of the cleaning device 500, and dispensers of various other embodiments, can comprise one material or multiple materials combined to form the dispenser 106. For example, the entire dispenser 106 may comprise an absorptive or porous plastic or felt material or the like. The dispenser 106 may additionally comprise a fluid absorbing material, but also have one or more layers of another material forming the dispensing surface 134. For example, a microfiber cloth material may form the dispensing surface 134 and be applied over the fluid absorbing material forming the remainder of the dispenser 106. In another embodiment, a microfiber cloth material or the like is applied over a sponge or foam or similar compressible or deformable material which is in turn applied over a fluid absorptive material forming the rest of the dispenser 106. Such a design may be desirable to allow the dispensing surface 134 to better conform to contours of a surface being cleaned. For example, if a user is cleaning a computer monitor surface at an edge along with a housing around the computer monitor surface, a foam material behind the microfiber cloth material may allow the microfiber cloth material forming the dispensing surface 134 to conform simultaneously to both the computer monitor screen and the housing surrounding the computer monitor screen.

As illustrated in the cleaning device 500 and various other embodiments, the dispensing surface 134 may comprise various shaped edges and surfaces to dispense cleaning fluid onto various shaped surfaces. For example, the cleaning device 500 includes various rounded edges 508 along with a sharp edge 510.

Some embodiments of cleaning devices include a surface, area, inlay, and the like to include an advertisement, business information, logo, etc. For example, the cleaning device 500 illustrated in FIG. 5A includes a surface 502 for placement of printed information, graphics, a sticker, etc. In another example, the cleaning device illustrated in FIG. 6P includes an inlay 502 for placement of printed information, graphics, a sticker, etc.

FIG. 6A illustrates an exploded view of an embodiment of a cleaning device 600. The cleaning device 600 comprises a housing 102, a dispenser 106, a wiper 112, a dispenser cover 108, and a dispenser retainer 202. The housing 102 of the cleaning device 600 further comprises several ribs or reinforcing members 610 within the internal cavity 118 extending through at least a portion of the internal cavity 118 to stiffen and/or reinforce the housing 102. This design may be advantageous, for example, to allow a thinner material to be used for the housing 102 while still maintaining sufficient stiffness or rigidity of the housing 102. The dispenser 106 of the cleaning device 600 includes retainer slots 602, retainer faces 606, and clearance slots 604. The clearance slots 604 are configured to allow clearance for the ribs or reinforcing members 610 of the housing 102. The retainer slots 602 are configured to allow clearance for protruding members 636 protruding from a surface of the wiper retainer 202.

The wiper retainer 202 of the cleaning device 600 is configured to mount to an exterior or back surface of the housing 102 with the protruding members 636 extending into the internal cavity 118 of the housing 102. Dispenser retaining faces 638 positioned at ends of the protruding member 636 are configured to at least partially mate with the retainer faces 606 of the dispenser 106 when the dispenser 106 and wiper retainer 202 are in their installed positions with respect to the housing 102. In the embodiment shown in FIG. 6A, the dispenser 106 is configured to have a slideable fit with the internal cavity 118 of the housing 102. The dispenser 106 is configured to be installed in the housing 102 by sliding the dispenser 106 into the housing 102 through the opening shown at the top of the housing 102 in FIG. 6A. A substantial portion of the dispenser 106 is configured to be positioned within the internal cavity 118 of the housing 102 with at least a portion of the dispenser 106 protruding through an opening in the housing 102 to allow the dispensing surface 134 of the dispenser 106 to protrude exterior to the housing 102.

When the dispenser 106 is in an installed position in the housing 102 with the dispensing surface 134 protruding exterior to the housing 102, the wiper retainer 202 can be installed against or adjacent to a back end of the housing 102, with the protruding members 636 extending into the cavity 118 and contacting the dispenser 106. The wiper retainer 202 may be installed with adhesive, using interlocking lips, or various other methods. In some embodiments, the wiper retainer 202 is configured to form a substantially air-tight or water-tight seal with the housing 102. The dispenser retaining faces 638 are configured to be in physical contact with the retainer faces 606 of the dispenser 106 to hold the dispenser 106 in position. For example, when a user is pressing the dispensing surface 134 against a surface being cleaned, a force is applied to the dispensing surface 134. The force applied to the dispensing surface 134 is configured to be at least partially counteracted through the retainer faces 606 pressing against the dispenser retaining faces 638 of the wiper retainer 202.

In some embodiments the wiper retainer 202 of the cleaning device 600 is configured to mate against a back surface of the housing 102. The wiper retainer 202 may be fastened to the back surface of the housing 102, for example, by using adhesives or other means. In other embodiments, a housing lip 534 of the wiper retainer 202 is used to mate with a slot, lip, ledge, or the like of the housing 102 to retain the wiper retainer 202 in position relative to the housing 102. The features connecting the wiper retainer 202 to the housing 102 may be configured to be substantially permanent or removable. For example, a user may want to be able to remove the wiper retainer 202 from the housing 102 to remove the dispenser 106 and/or refill the dispenser 106 with cleaning fluid. In some embodiments the cleaning device 600 further comprises a wiper cover to install over the wiper 112. The wiper retainer 202 can comprise a wiper cap lip 532 to retain the wiper cover and allow the wiper cover to be removed and reinstalled.

Although the housing 102 of the cleaning device 600 shown in FIG. 6A includes ribs 610 extending through a portion of the internal cavity 118 in a direction substantially parallel to an axis of the housing 102, different and/or additional features may be used to stiffen the housing 102. For example, the housing 102 may include a honeycomb pattern or various other patterns on the interior surface or exterior surface to stiffen the housing 102.

Figure 6B:
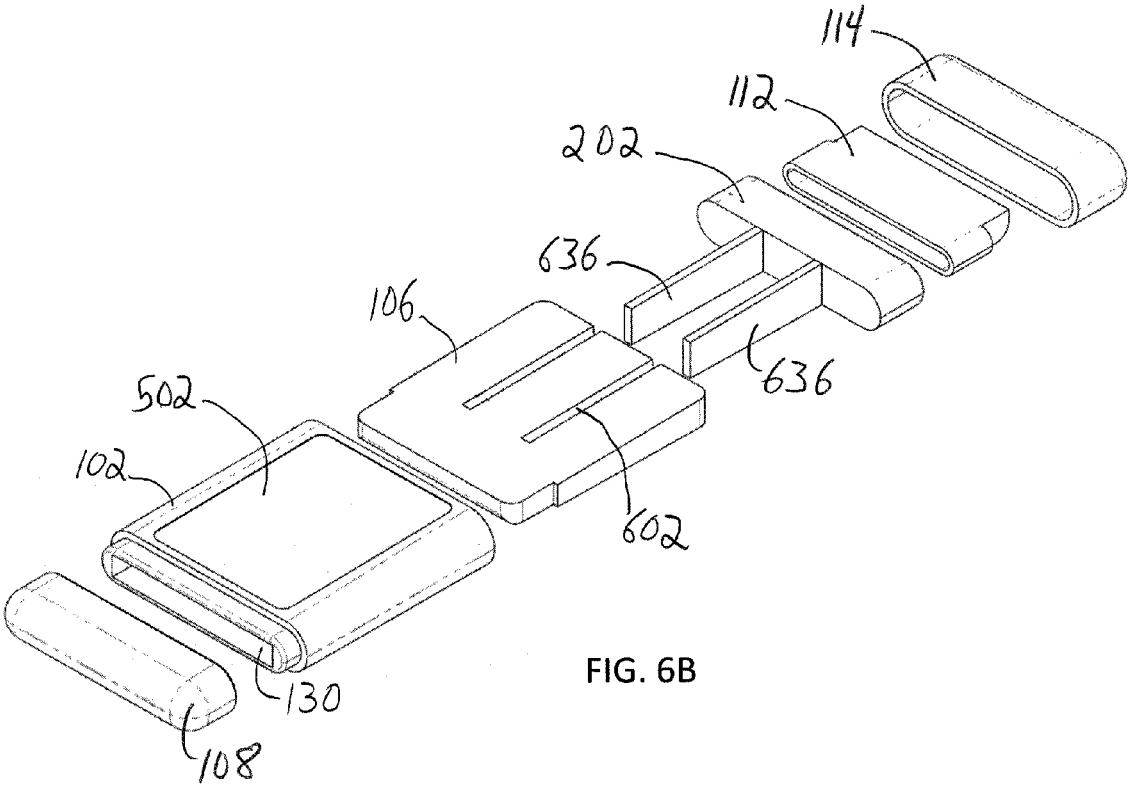
FIG. 6B illustrates an exploded view of an embodiment of a cleaning device.
Figure 6C:
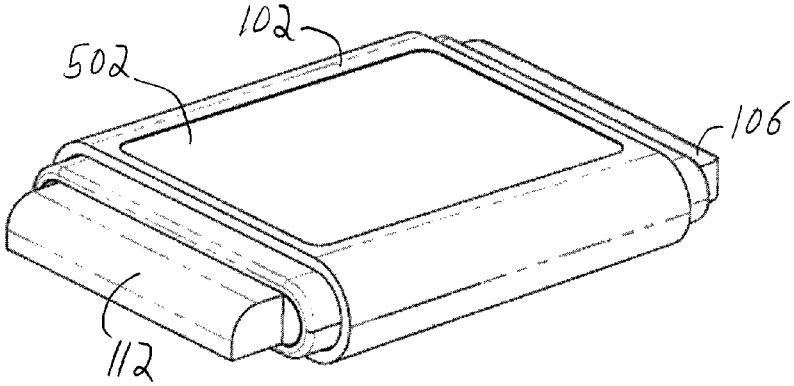
FIG. 6C illustrates a perspective view of an embodiment of a cleaning device.
Figure 6H:
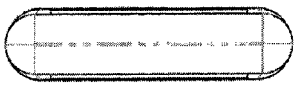
FIG. 6H illustrates a top view of an embodiment of a cleaning device.
Figure 6E:
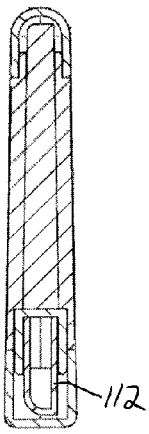
FIG. 6E illustrates a cross-sectional view of an embodiment of a cleaning device.
Figure 6D:
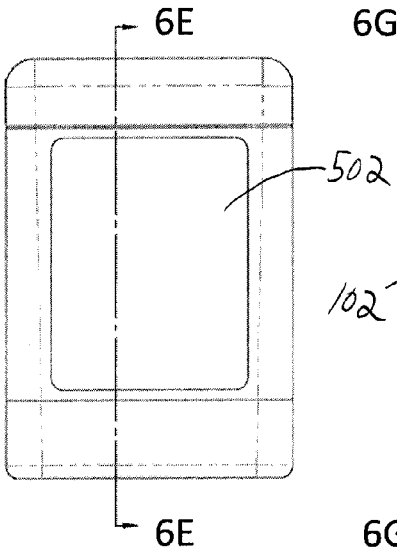
FIG. 6D illustrates a front view of an embodiment of a cleaning device.
Figure 6F:
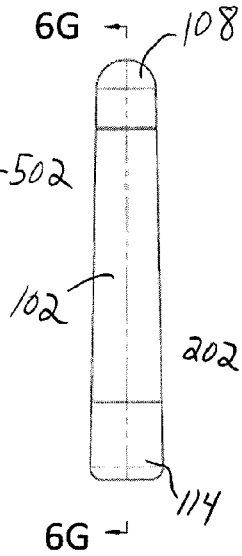
FIG. 6F illustrates a side view of an embodiment of a cleaning device.
Figure 6G:
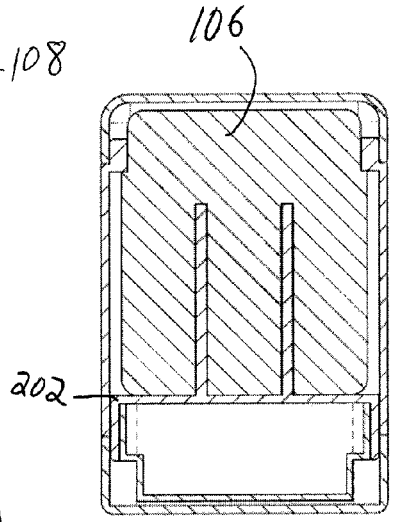
FIG. 6G illustrates a cross-sectional view of an embodiment of a cleaning device.
Figure 6N:
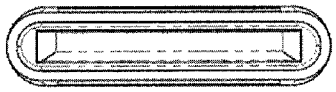
FIG. 6N illustrates a top view of an embodiment of a cleaning device.
Figure 6L:
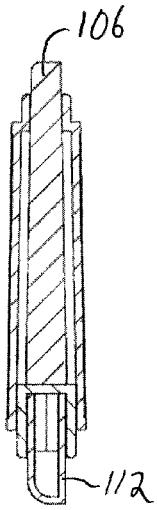
FIG. 6L illustrates a cross-sectional view of an embodiment of a cleaning device.
Figure 6J:
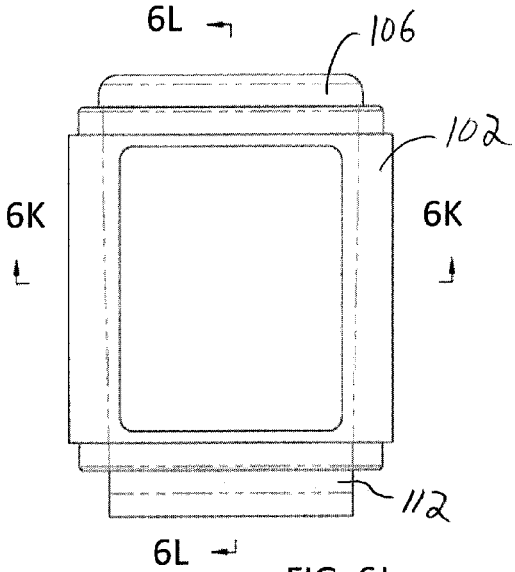
FIG. 6J illustrates a front view of an embodiment of a cleaning device.
Figure 6M:
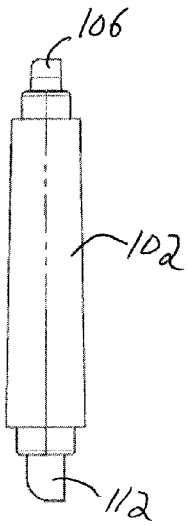
FIG. 6M illustrates a side view of an embodiment of a cleaning device.
Figure 6K:
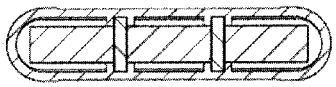
FIG. 6K illustrates a cross-sectional view of an embodiment of a cleaning device.
Figure 6P:
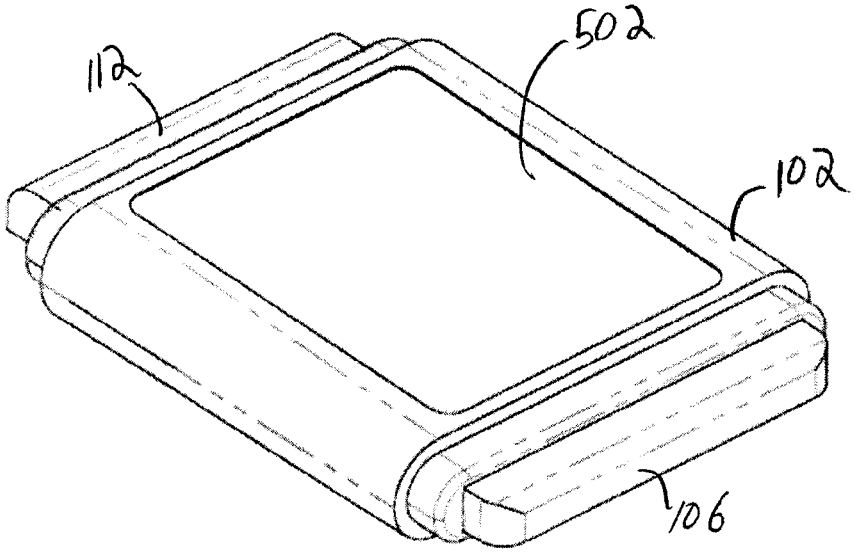
FIG. 6P illustrates a perspective view of an embodiment of a cleaning device.

FIGS. 6B-6P illustrate other embodiments of the cleaning device 600 illustrated in FIG. 6A. FIG. 6B illustrates an exploded view of an embodiment of a cleaning device. FIGS. 6D-6N illustrate various front, side, top, and cross-sectional views of an embodiment of a cleaning device. FIGS. 6C and 6P illustrate perspective views of an embodiment of a cleaning device. The embodiments shown in FIGS. 6B-6P comprise a housing 102, a dispenser 106, a wiper 112, a dispenser cover 108, a wiper cover 114, and a dispenser retainer 202. The housing 102 additionally comprises an inlay 502 for placement of printed information, graphics, a sticker, etc. The dispenser retainer 202 comprises two protruding members 636 having a generally long and rectangular shape configured to fit at least partially within retainer slots 602 of the dispenser 106 and slots 612 of the housing 102 defined by reinforcing members 610. The dispenser retainer 202 comprises a mounting cavity 552 configured to at least partially surround or encapsulate a portion of the wiper 112.

Figure 7A:
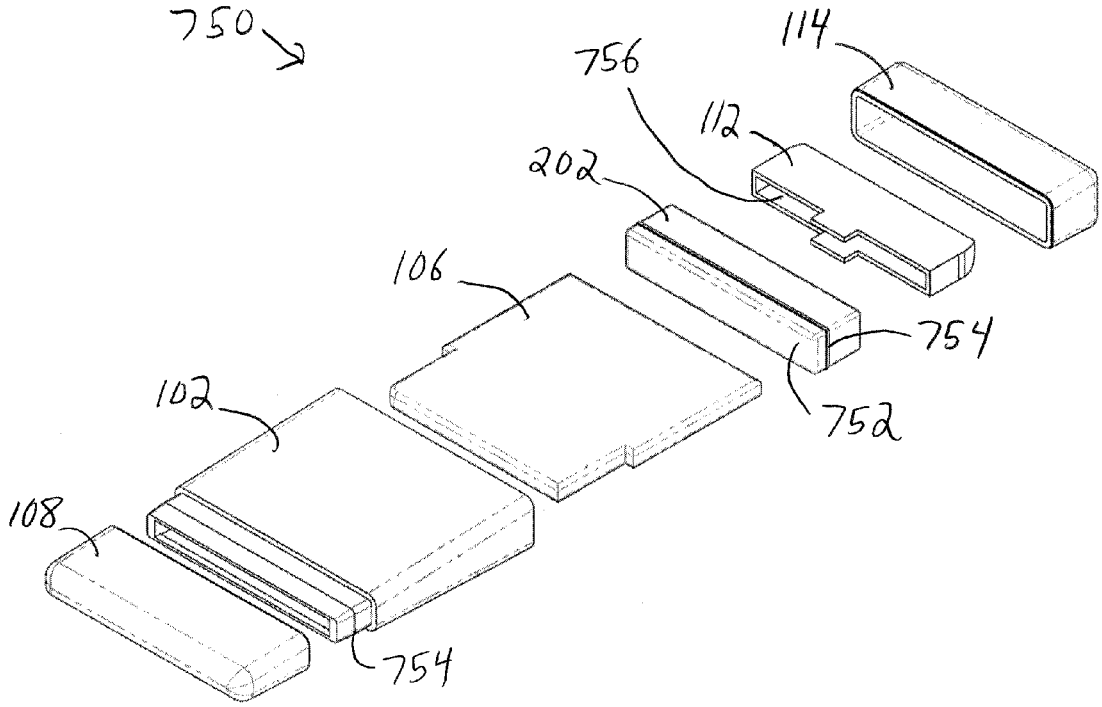
FIG. 7A illustrates an exploded view of an embodiment of a cleaning device.
Figures 7B, 7C:
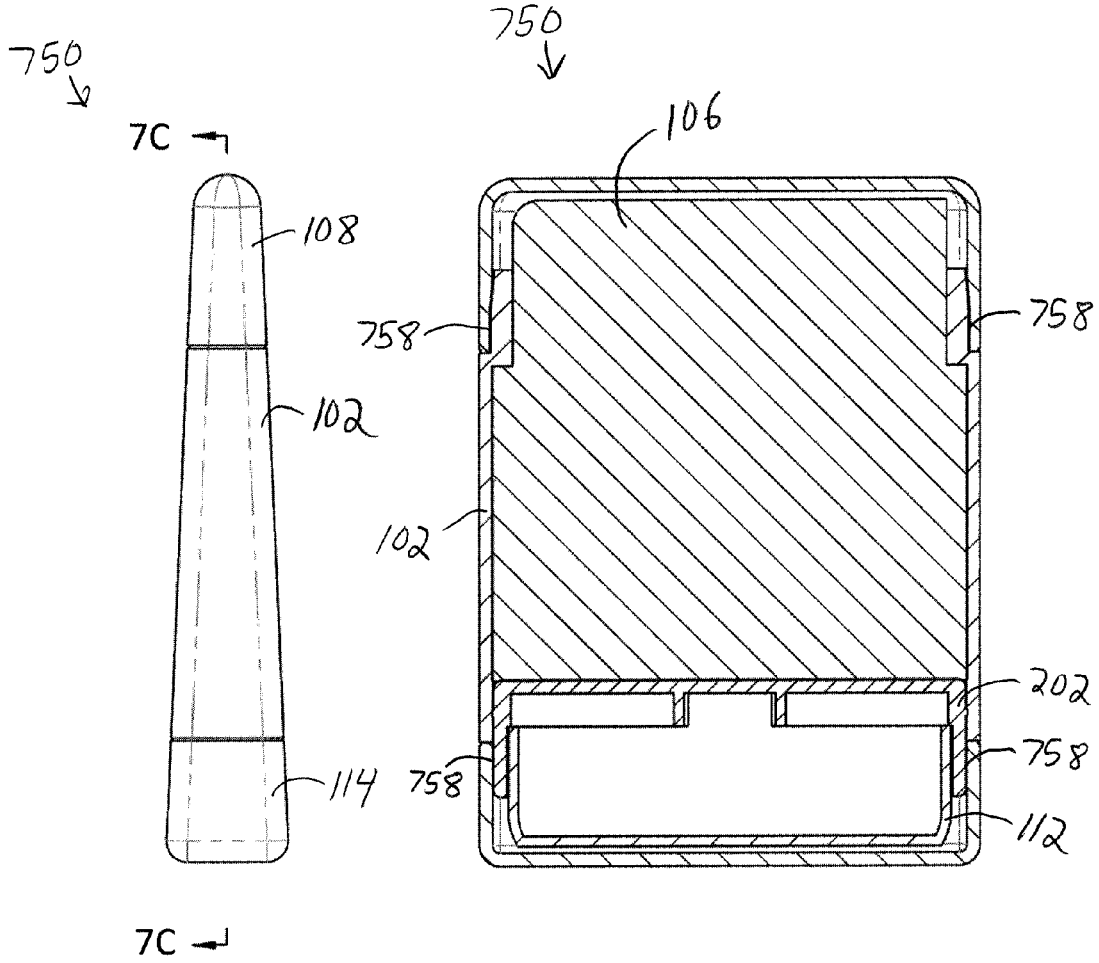
FIG. 7B illustrates a side view of an embodiment of a cleaning device.
FIG. 7C illustrates a cross-sectional view of an embodiment of a cleaning device.
Figure 7D:
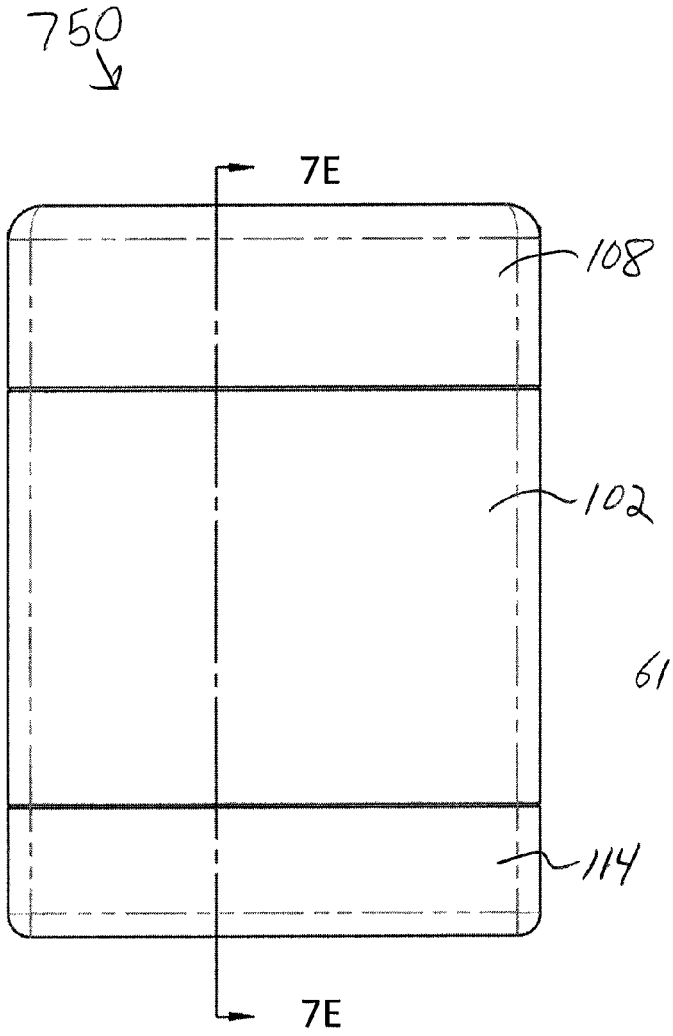
FIG. 7D illustrates a front view of an embodiment of a cleaning device.
Figure 7E:
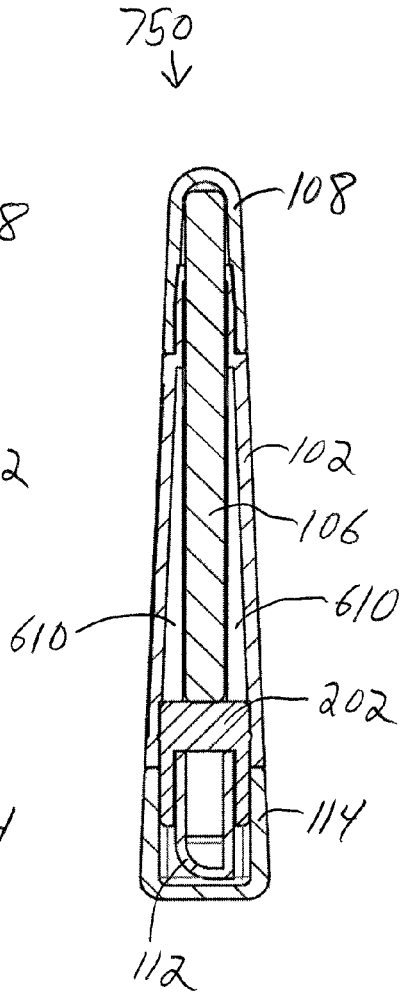
FIG. 7E illustrates a cross-sectional view of an embodiment of a cleaning device.
Figure 7H:
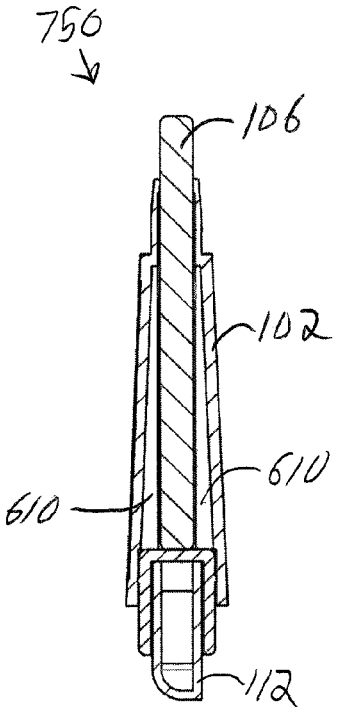
FIG. 7H illustrates a cross-sectional view of an embodiment of a cleaning device.
Figure 7F:
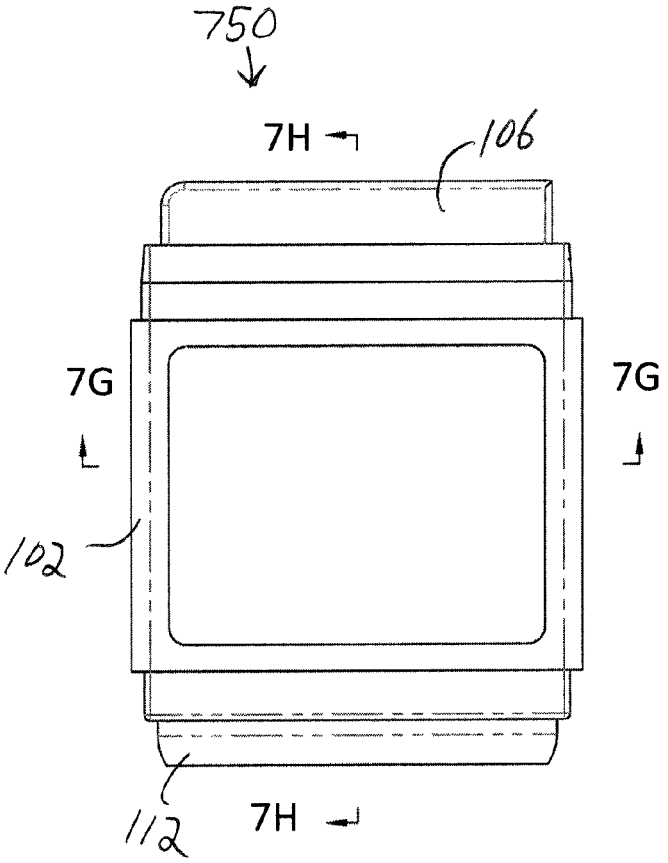
FIG. 7F illustrates a front view of an embodiment of a cleaning device.
Figure 7G:
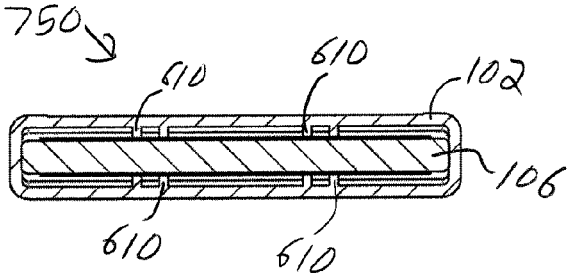
FIG. 7G illustrates a cross-sectional view of an embodiment of a cleaning device.
Figure 7J:
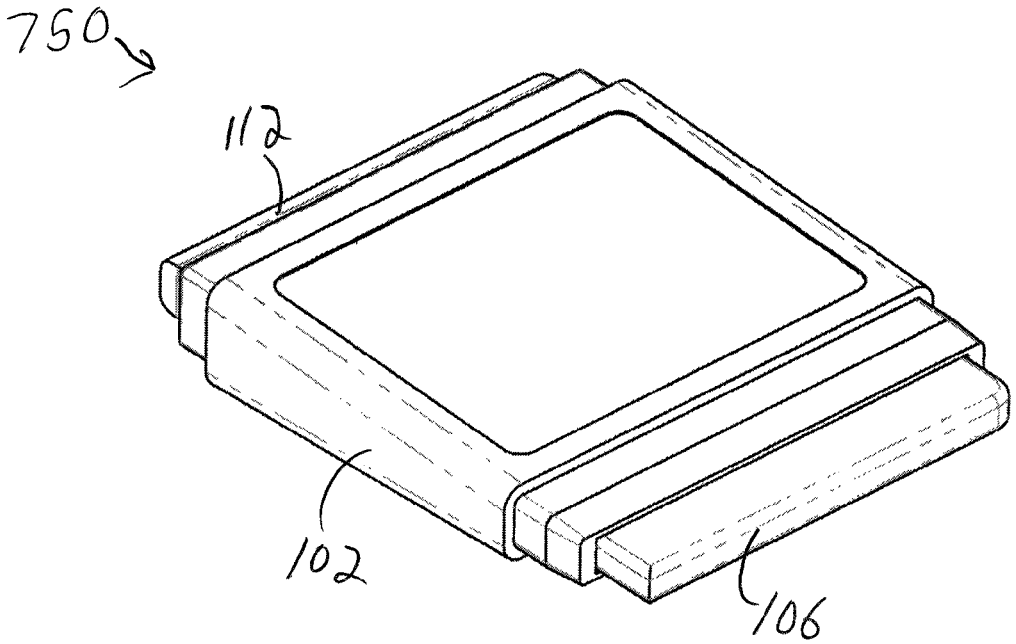
FIG. 7J illustrates a perspective view of an embodiment of a cleaning device.
Figure 7K:
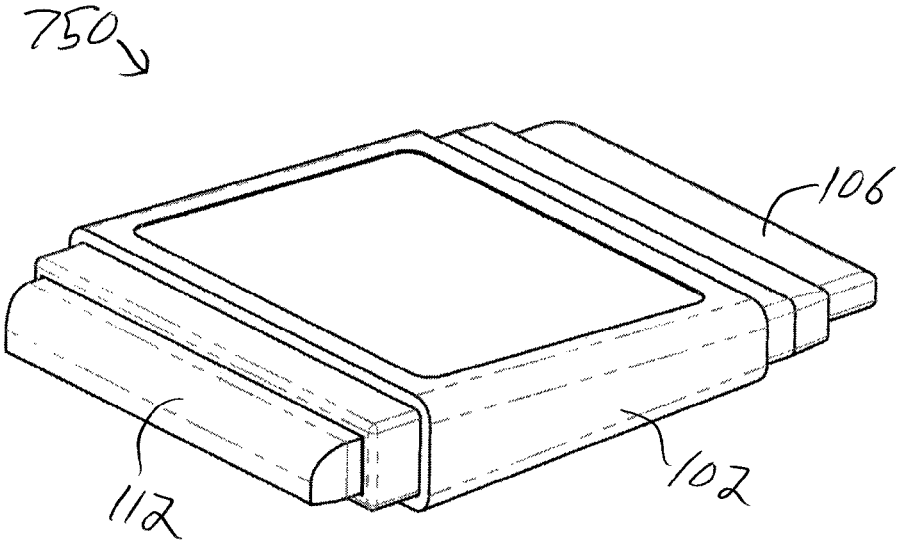
FIG. 7K illustrates a perspective view of an embodiment of a cleaning device.

FIGS. 7A-7K illustrate various views of an embodiment of a cleaning device 750. FIG. 7A illustrates an exploded view of the cleaning device 750. FIG. 7B illustrates a side view of the cleaning device 750. FIGS. 7C, 7E, 7G, and 7H illustrate cross-sectional views of the cleaning device 750. FIGS. 7D and 7F illustrate front views of the cleaning device 750. FIGS. 7J and 7K illustrate perspective views of the cleaning device 750. The cleaning device 750 comprises a housing 102, a dispenser cover 108, a wiper cover 114, a dispenser 106, a wiper 112, and a dispenser retainer 202.

As illustrated in FIG. 7E, the housing 102 further comprises ribs or reinforcing members 610. In this embodiment, the housing 102 has a generally tapered profile, but the dispenser 106 has a generally rectangular profile. The ribs 610 are configured to be generally tapered in design to be positioned adjacent to the dispenser 106 to at least partially help retain the dispenser 106 in position within the housing 102. The dispenser retainer 202 further comprises a face 752 configured to be positioned adjacent to the dispenser 106 to at least partially help retain the dispenser 106 in position with the housing 102.

As illustrated in FIG. 7A, the housing 102 and dispenser retainer 202 both further comprise a ridge 754. The ridges 754 are configured to help retain the dispenser cover 108 and wiper cover 114 when installed on the housing 102 and dispenser retainer 202, respectively. In some embodiments, the ridges 754 are configured to mate with ridges or grooves in the covers to help to retain the covers. In some embodiments, the ridges 754 are configured to help retain the covers through a friction fit. The housing 102 and dispenser retainer 202 additionally comprise engagement areas 758 configured to help retain the covers by creating an area for a friction fit. In some embodiments, the engagement areas 758 are flat or generally parallel to an axis of the housing 102 to enable installation and removal of the covers 108 and 114.

As illustrated in FIG. 7A, the wiper 112 comprises a cavity 756. The cavity 756 can be included to reduce a weight of the wiper 112 and/or to make the wiper 112 easier to manufacture. In some embodiments, the cavity 756 is configured to enable the walls of the wiper 112 to compress to aid in forming a friction fit between the wiper 112 and dispenser retainer 202. In some embodiments, the cavity 756 comprises ribs or reinforcing members to add strength or resistance to compression to the wiper 112.

Additional Cleaning Device Embodiments

Figure 8:
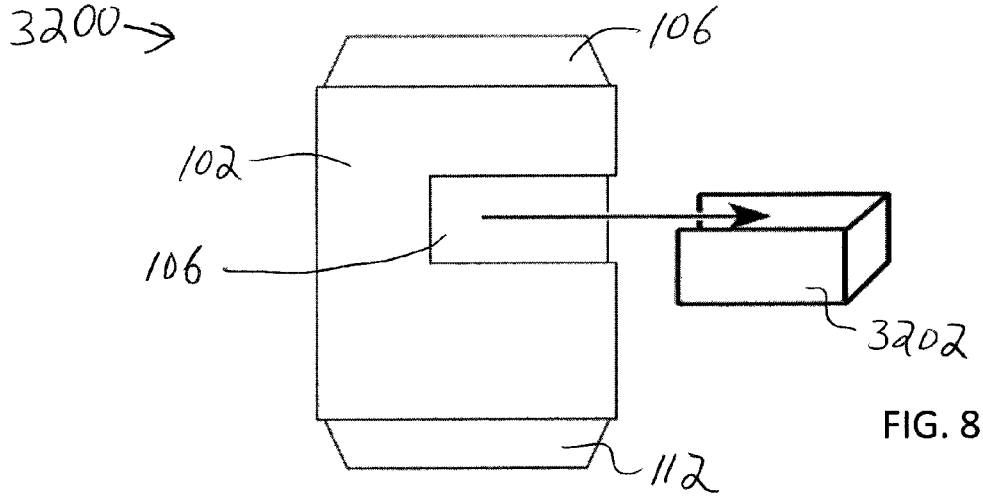
FIG. 8 illustrates an exploded view of an embodiment of a cleaning device.

FIG. 8 illustrates an exploded view of an embodiment of a cleaning device 3200. The cleaning device 3200 comprises a housing 102, a dispenser 106, a wiper 112, and an access cover 3202. In this embodiment, the dispenser 106 has multiple access points. A user may use the dispenser 106 to dispense cleaning fluid from the top surface that is extending from the housing 102, or the user may dispense cleaning fluid from the portion of the dispenser 106 located beneath the access cover 3202. This embodiment may be advantageous, for example, to clean small items with the portion of the dispenser 106 located beneath the access cover 3202. A user may even clean his or her hands using the portion of the dispenser 106 located beneath the access cover 3202.

Figure 9:
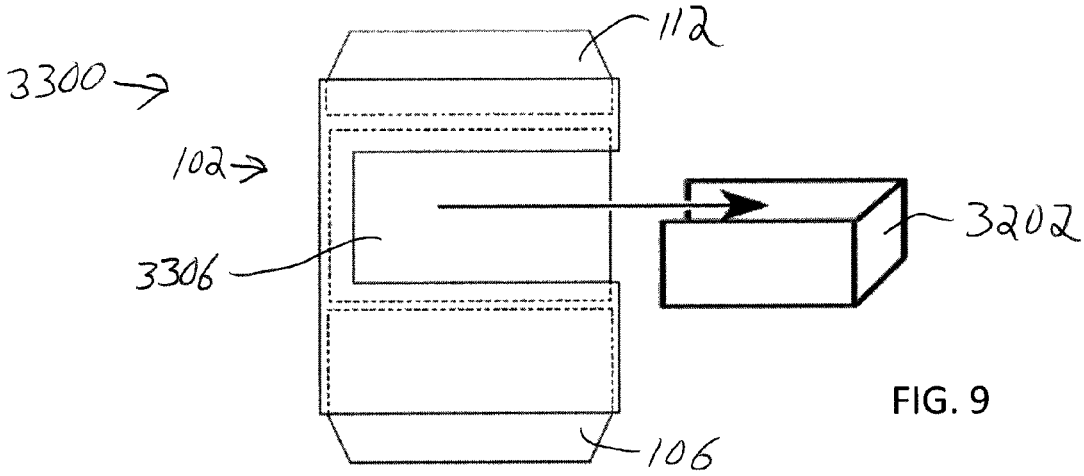
FIG. 9 illustrates an exploded view of an embodiment of a cleaning device.

FIG. 9 illustrates an exploded view of an embodiment of a cleaning device 3300 comprising a housing 102 having a wiper 112, a dispenser 106, a second dispenser 3306, and an access cover 3202. This embodiment illustrates that a cleaning device may have more than one dispenser and may have more than one way to access the dispensers. In this embodiment, the dispenser 106 is accessed by grasping the housing 102 and touching a surface of the dispenser 106 to an item to be cleaned. The second dispenser 3306 is accessed by removing or substantially removing the access cover 3202, revealing surfaces of the second dispenser 3306. An access cover 3202 may be configured to slidably engage the housing 102, allowing it to be removed by sliding it to the side of the housing 102. An access cover 3202 may alternatively be attached in various other ways, such as with a hinge.

Figure 10:
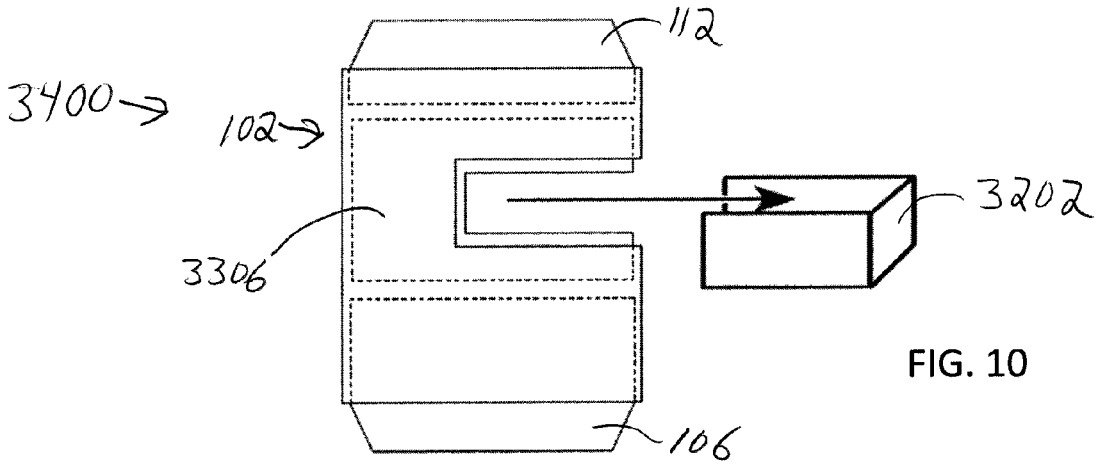
FIG. 10 illustrates an exploded view of an embodiment of a cleaning device.

FIG. 10 illustrates an exploded view of an embodiment of a cleaning device 3400 comprising a housing 102 having a wiper 112, a dispenser 106, a second dispenser 3306, and an access cover 3202. The cleaning device 3400 includes a second dispenser 3306 having a u-shaped cutout. This embodiment may be advantageous to allow multiple cleaning surfaces of the second dispenser 3306 to be used simultaneously. For example, the u-shaped cutout may be configured to conform to the shape of a smartphone, for example an iPhone or an Android phone. When a user wishes to apply cleaning fluid to his or her smartphone, the user can remove the access cover 3202, slide his or her smart phone through the cutout in the second dispenser 3306, and have cleaning fluid dispensed from the second dispenser 3306 onto three surfaces of the smart phone simultaneously. The second dispenser 3306 may be configured to have various shapes of cutouts. In this embodiment, the cutout is generally a U shape. However, the cutout can be shaped in any shape to conform to the shape of an object intended to be cleaned. In some embodiments, the opening in the second dispenser 3306 may even be a four sided or completely enclosed opening. For example, the opening in the second dispenser 3306 may be a hole through a center of the second dispenser 3306. This embodiment may be useful to clean, for example, an object that is generally cylindrical in shape. The user can remove one or more access covers providing access to the hole in the second dispenser 3306 and then pass the cylindrically shaped object through the hole allowing cleaning fluid to be applied to an exterior surface of that object. In other embodiments, a cleaning device can include any number of different dispensers and/or access covers depending on the application. Some embodiments may also include an access cover as the only way to access a dispenser, rather than also including a dispenser protruding from an end or side of a housing. Some embodiments include a single dispenser that performs the functions of both dispenser 106 and second dispenser 3306 in the cleaning device 3400 shown in FIG. 10.

Figure 11:
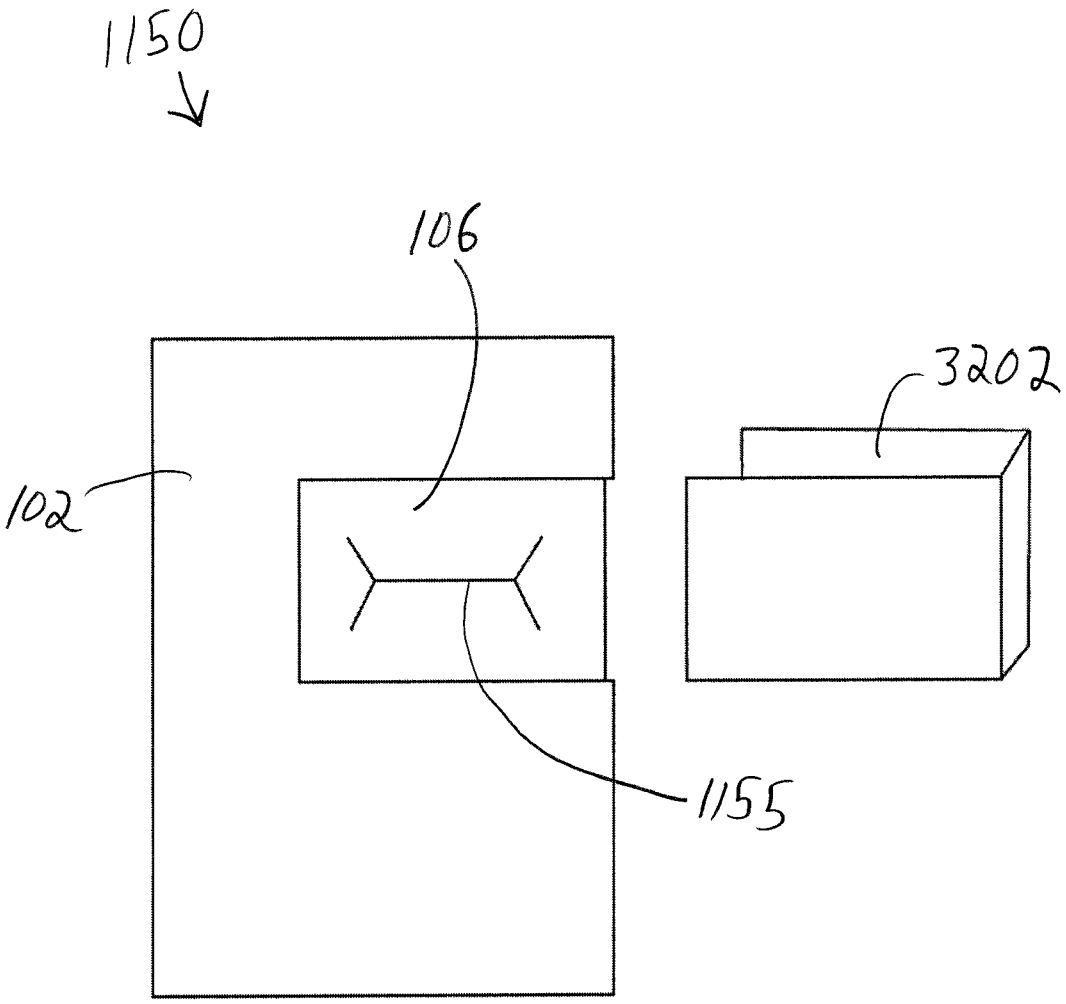
FIG. 11 illustrates an exploded view of an embodiment of a cleaning device.

FIG. 11 illustrates an exploded view of an embodiment of a cleaning device 1150 comprising a housing 102 having a dispenser 106 and an access cover 3202. In this embodiment, the dispenser 106 further comprises an opening 1155. The opening 1155 is formed as one or more cuts or slits in the dispenser 106 and is configured to allow an object being cleaned to be passed through the opening 1155. In some embodiments, the opening 1155 is configured to deform as an object is passed through it, to allow more surface area of the dispenser 106 to come into contact with the object being cleaned, and/or to apply a pressure to a surface of the object being cleaned to more effectively clean the object. In some embodiments, for example, the slits are die-cut or molded into the dispenser 106.

The embodiments shown in FIGS. 8-11, in addition to various other embodiments, can be configured to comprise a dispenser or dispensers, but no wiper. This may be advantageous to, for example, create a smaller overall size of the cleaning device to allow easier transport, storage, etc.

Figure 12:
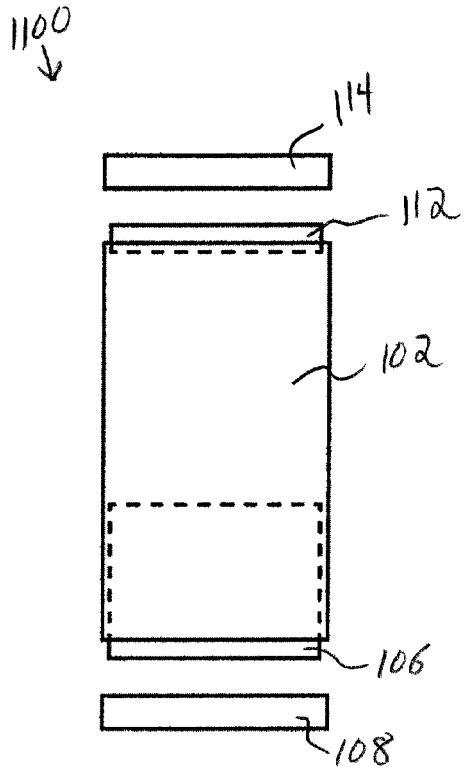
FIG. 12 illustrates a front view of an embodiment of a cleaning device.

FIG. 12 illustrates a front view of an embodiment of a cleaning device 1100. The cleaning device 1100 comprises a housing 102 having a dispenser 106 and a wiper 112. The cleaning device 1100 additionally comprises a dispenser cover 108 and a wiper cover 114. While the cleaning device embodiment shown in FIG. 12 illustrates both the dispenser 106 and wiper 112 extending at least partially into internal cavities of the housing 102, other embodiments may include the wiper 112 and/or dispenser 106 positioned on an exterior surface of the housing 102 and not extending into a cavity of the housing 102.

Figure 13:
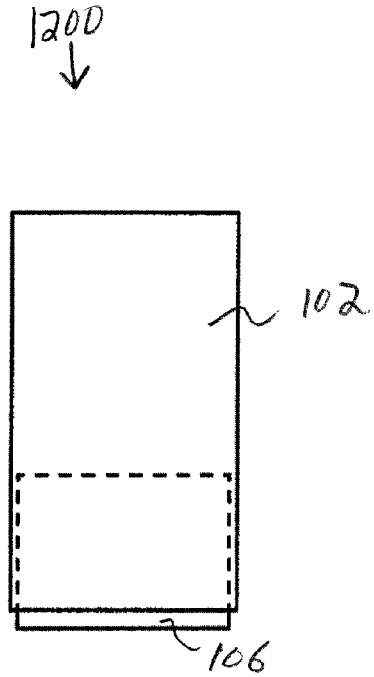
FIG. 13 illustrates a front view of an embodiment of a cleaning device.

FIG. 13 illustrates a front view of an embodiment of a cleaning device 1200. The cleaning device 1200 comprises a housing 102 and a dispenser 106. The cleaning device 1200 does not include a wiper or any covers, such as a dispenser cover. Such an embodiment may be desirable to minimize or reduce the size of a cleaning device. In some embodiments, a cleaning device 1200 may be used in combination with a separate wiper that is not attached to the cleaning device 1200. For example, a user may use the cleaning device 1200 to apply a cleaning fluid held within a cavity of the housing 102 to a surface using the dispenser 106 and then wipe any remaining cleaning fluid and/or buff or polish the surface using a separate microfiber cloth wiper. In some embodiments, the cleaning device 1200 does include a dispenser cover, such as the dispenser cover 108 shown in FIG. 12. In some embodiments, rather than a cleaning device comprising a dispenser and no wiper, a cleaning device comprises a wiper, but no dispenser. The cleaning device can be configured to comprise one or more of the various embodiments of wipers illustrated and described herein. In some embodiments, a cleaning device comprises a standalone wiper, for example one of the various embodiments of wipers illustrated and described herein, not configured to attach to a housing, but configured to be used by a user as a standalone cleaning device.

Figure 14:
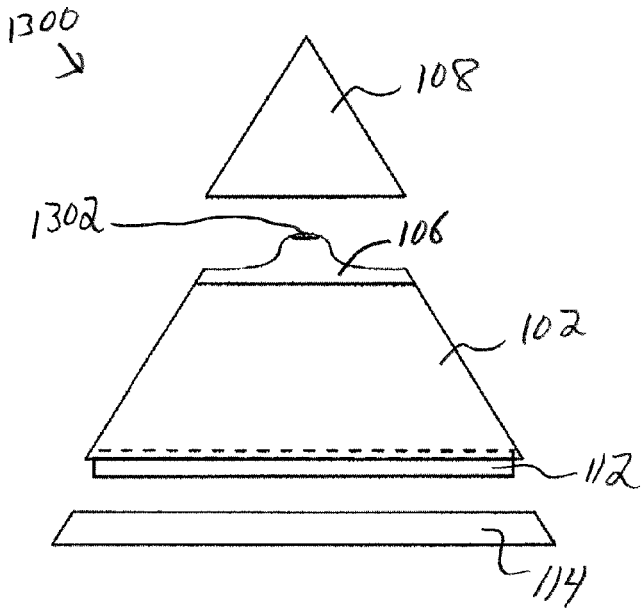
FIG. 14 illustrates a front view of an embodiment of a cleaning device.

FIG. 14 illustrates a front view of another embodiment of a cleaning device 1300. The cleaning device 1300 comprises a housing 102 having a dispenser 106 and a wiper 112. The cleaning device 1300 additionally comprises a dispenser cover 108 and a wiper cover 114. In this embodiment, the cleaning device 1300 is designed to be generally triangular in shape. This design may be desirable as an aesthetic shape, and the shape may additionally be functional. For example, the triangular design allows a relatively large wiper 112 to wipe a relatively large surface area at one time. However, in this embodiment a relatively small dispenser is used, so the triangular shape allows the overall size of the cleaning device 1300 to be smaller than if the shape were, for example, rectangular. Although this embodiment uses a generally triangular shape, the cleaning device 1300 could be shaped in various other ways, too.

In the cleaning device 1300 embodiment shown in FIG. 14, the dispenser 106 includes an opening 1302 to dispense cleaning fluid stored within the housing 102. In this embodiment, the dispenser 106 may primarily comprise nonporous or non-fluid permeable material. The housing 102 may comprise a material such as plastic that is flexible and makes the housing 102 squeezable. In use, a user may position the opening 1302 next to, adjacent to, or on a surface to be cleaned, and then squeeze the housing 102 to cause cleaning fluid stored within the housing 102 to be expelled from the opening 1302 and applied to the surface to be cleaned. The user may then flip the cleaning device 1300 over and distribute and/or wipe and/or buff or polish the surface with the wiper 112. In some embodiments, the dispenser 106 comprises a pump with a nozzle to dispense cleaning fluid. In various embodiments, the cleaning device can be configured to expel, eject, or otherwise dispense cleaning fluid as drops, a mist, a stream, a foam, etc.

In some embodiments, a cleaning device can be configured to dispense cleaning fluid using gravity, rather than requiring a user to squeeze the housing or otherwise force the fluid out of the cleaning device. For example, a cleaning device can be configured to dispense cleaning fluid when a user turns the device over to point the opening 1302 in a downward direction, and to let the cleaning fluid drip, drop, or otherwise flow out of the cleaning device. In some embodiments, the flow of cleaning fluid out of the cleaning device can be configured to be faster or slower depending on, for example, what type of surface the cleaning device is designed to drip or flow fluid onto. For example, if the fluid is intended to flow directly on a surface to be cleaned, a smaller drop or slower flow rate may be advantageous to better control the flow and/or to not apply too much fluid to the surface being cleaned. If, for example, the fluid is intended to flow onto a microfiber or other cloth, rather than directly onto a surface to be cleaned, a larger drop or faster flow rate may be advantageous. In some embodiments, the flow or flow rate of fluid being dispensed from the cleaning device can be configured to be regulated by, for example, the user's amount of tilt (e.g., whether the opening 1302 is directed or pointed directly downward or is at some other angle), a size of the hole or opening 1302, a size of other holes or openings in the cleaning device, such as an air vent, and/or the like.

In some embodiments, the cleaning device does not utilize a "squeezable" housing 102. In some embodiments, the cleaning fluid is only (or at least partially) kept from being dispensed by a cap (such as the cover 108) or other component or solid piece that is configured to "plug" the hole or holes or openings of the body through which fluid can be dispensed. The component configured to be the "plug" can be, in some embodiments, slidably, hingedly, or otherwise moveably or removably attached to the housing 102. In some embodiments, for example, the cleaning device can be configured to comprise a button or a switch that can be pressed or otherwise activated to cause a cap or cover to slide off of or otherwise disengage from the opening that it would usually plug, revealing the hole or holes for the fluid to flow or be dispensed.

Figure 15:
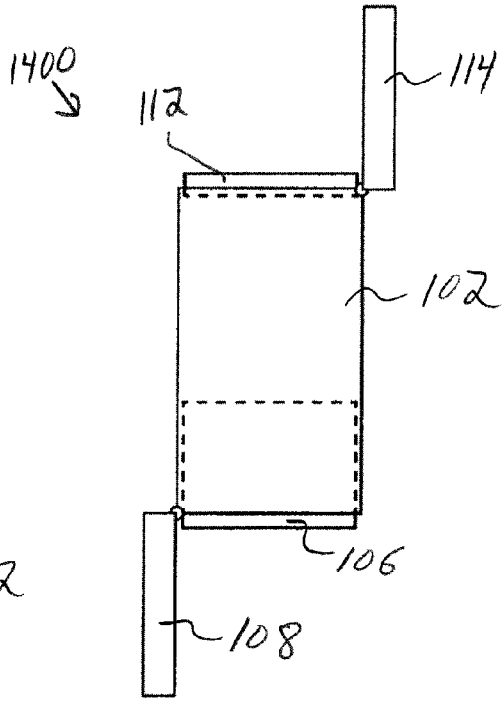
FIG. 15 illustrates a front view of an embodiment of a cleaning device.

FIG. 15 illustrates a front view of an embodiment of a cleaning device 1400. The cleaning device 1400 illustrates that a wiper cover 114 and/or a dispenser cover 108 may be attached to the housing 102 in various ways. In this embodiment, the covers are attached to the housing 102 using a hinged connection. However, caps or covers may be attached to a housing 102 in various other ways. A cover or cap may, for example, be attached to the housing through a friction fit or with interlocking lips or ledges. A cap or cover may additionally be hingedly attached to the housing 102 along either a long axis or a short axis of the housing 102 shown in FIG. 15. A cover or cap may additionally be slidably attached to the housing 102 and configured to allow a user to slide the cover or cap on and off the housing 102.

Figure 18:
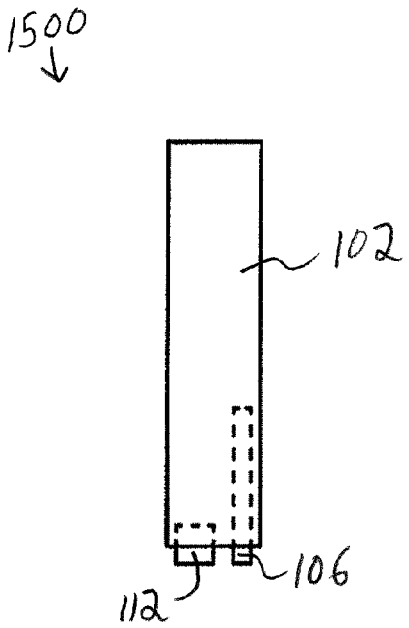
FIG. 18 illustrates a side view of an embodiment of a cleaning device.

FIG. 18 illustrates a side view of an embodiment of a cleaning device 1500. Cleaning device 1500 illustrates that a dispenser 106 and wiper 112 may be positioned anywhere along an exterior of the housing 102 that would be useful for a user. For example, as shown in cleaning device 1500, the dispenser 106 and wiper 112 are positioned along the same surface of housing 102 and/or along the same end or side of the housing 102. One advantage of this embodiment is that a user can both dispense fluid onto a surface and wipe the surface in one pass over the surface. In other embodiments, the dispenser 106 and wiper 112 may be positioned together along any other surface or side or end of the housing 102 or may be positioned on different surfaces or sides or ends of the housing 102 as shown in various other embodiments.

Figure 19:
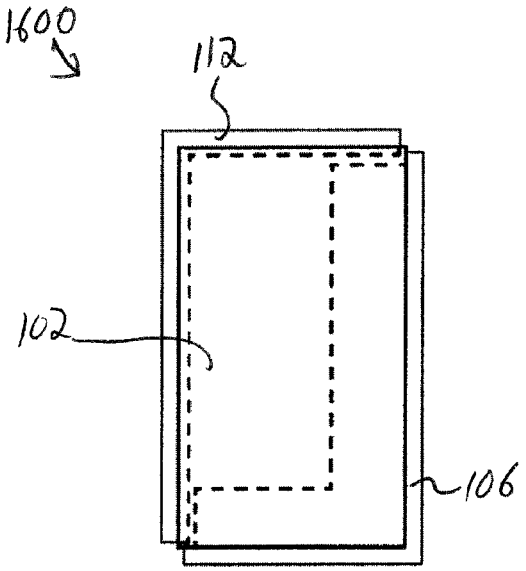
FIG. 19 illustrates a front view of an embodiment of a cleaning device.

FIG. 19 illustrates a front view of an embodiment of a cleaning device 1600 comprising a housing 102, a dispenser 106, and a wiper 112. The cleaning device 1600 illustrates that the wiper 112 and/or the dispenser 106 can be formed in various shapes and can also protrude from the housing 102 along more than one surface or side or end. In the embodiment shown in FIG. 19, the wiper 112 is configured in an L shape and protrudes from the housing 102 along two ends forming 90° angles to each other. The dispenser 106 is also L shaped and protrudes from the housing 102 along two ends forming a 90° angle to each other. In other embodiments, the dispenser 106 and wiper 112 may take various other forms. For example, the dispenser 106 may protrude from one end or surface of the housing 102 while the wiper 112 forms a U shape and protrudes from three sides or surfaces or ends of the housing 102.

Figure 20:
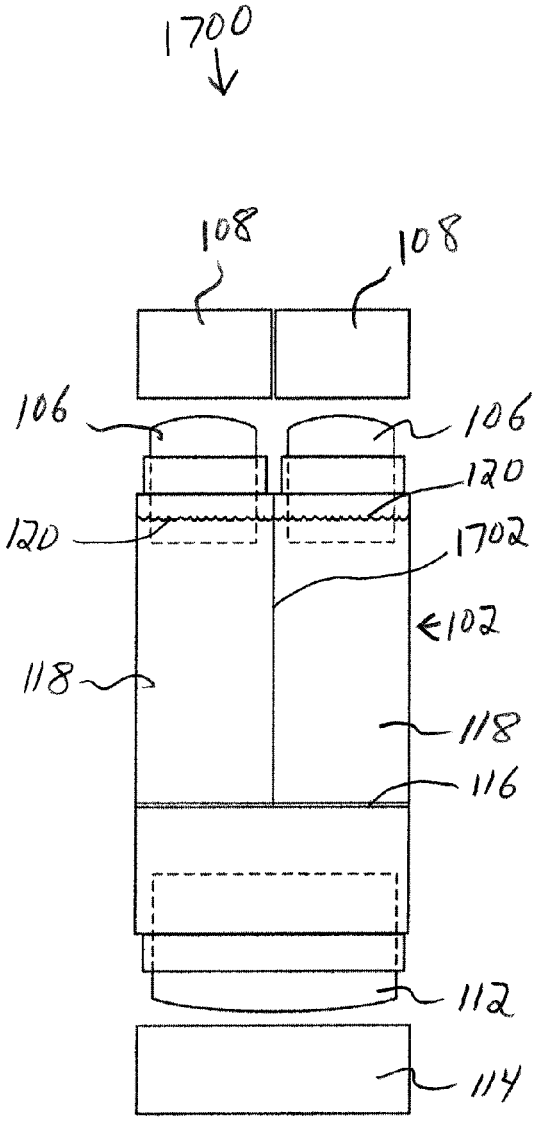
FIG. 20 illustrates a front view of an embodiment of a cleaning device.

FIG. 20 illustrates a front view of an embodiment of a cleaning device 1700. The cleaning device 1700 comprises a housing 102 having two dispensers 106 and one wiper 112. The embodiment shown in FIG. 20 illustrates that a cleaning device may have more than one dispenser 106 and/or wiper 112. In various embodiments, the various dispensers 106 may be configured to dispense the same type of cleaning fluid or they may be configured to dispense different types of cleaning fluid. For example, in the embodiment shown in FIG. 20, an internal cavity divider 1702 separates the internal cavity 118 of the housing 102 into two separate chambers. Therefore, two different cleaning fluids may be contained in the two different chambers. In some embodiments, such as the cleaning device 1700, the cleaning device may have a separate dispenser cover 108 for each dispenser 106. This design may be desirable especially for a cleaning device that has different types of cleaning fluid for each dispenser 106. For example, if one dispenser 106 is configured to dispense an alcohol-based cleaning fluid preferably to be used on electronics and the other dispenser 106 is configured to dispense a cleaning fluid that would be corrosive to electronics, it is desirable to have separate covers 108 for the different dispensers 106 so that one cleaning product is not accidentally applied to a surface that a user does not intend to apply that fluid to. However, some embodiments have a single dispenser cover 108 to cover both dispensers 106. This may be advantageous, for example, for a cleaning device having complementary cleaning fluids in the two internal cavities 118.

Although the cleaning device 1700 shows the two dispensers 106 in line with each other on the same side or end of the housing 102, in various other embodiments various dispensers 106 may be positioned in different areas on the housing 102. For example, one dispenser 106 may be positioned along one end or side of the housing 102 with another dispenser 106 being positioned along an end or side that is approximately 180° from the other end. Additionally, a wiper may be positioned on an end or side that is 90° from each of those dispensers 106. Such a design may be desirable so that only one dispensing or wiping surface is available on each side or end of the housing 102 to further reduce the possibility of accidentally contacting a surface to be cleaned with a dispensing surface other than the dispensing surface a user desires. In various other embodiments, a cleaning device can comprise any number of dispensers 106 in any configuration, with some or all of the dispensers 106 being configured to dispense either the same or different fluids.

Figure 21:
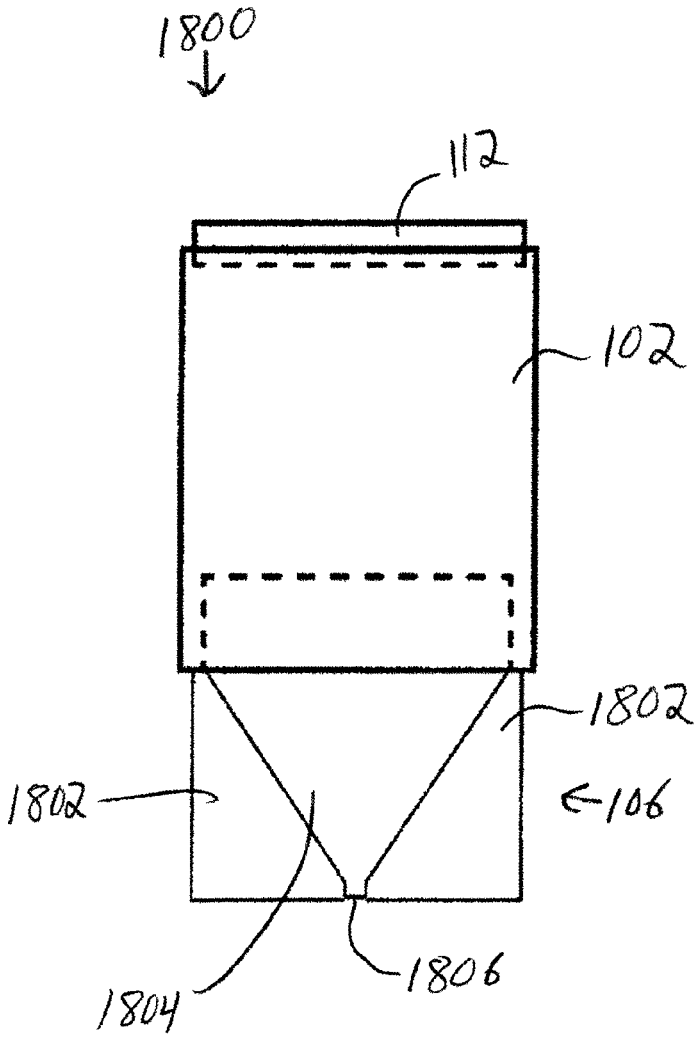
FIG. 21 illustrates a front view of an embodiment of a cleaning device.

FIG. 21 illustrates a front view of an embodiment of a cleaning device 1800. The cleaning device 1800 comprises a housing 102, a wiper 112, and a dispenser 106. The dispenser 106 shown in FIG. 21 comprises an opening 1806. In this embodiment, as with other embodiments, the dispenser 106 may comprise multiple materials. For example, outer sections 1802 may comprise a compliant or foam or sponge type material while an inner portion 1804 comprises a less compliant material. This configuration may be advantageous to allow a more compliant material to contact a surface being cleaned to easily conform to the surface being cleaned while the less compliant material maintains a general shape of the dispenser 106 while dispensing cleaning fluid onto the surface being cleaned.

In some embodiments, the dispenser 106 shown in FIG. 21 may include an area 1804 substantially open to fluid flow (e.g., a hollow cavity or a fluid-permeable material) with outer areas 1802 being substantially not open to fluid flow (e.g., comprising substantially non-fluid permeable material). In this example, cleaning fluid is configured to flow from a cavity in the housing 102 through the center area 1804 of the dispenser 1806 and be guided by edges of the areas 1802 to the opening 1806 for dispensing of the fluid through the opening 1806 in, for example, drop form. A surface of the outer areas 1802 may then be configured to spread the cleaning fluid around a surface being cleaned after the cleaning fluid has been dispensed through the opening 1806.

Figure 22:
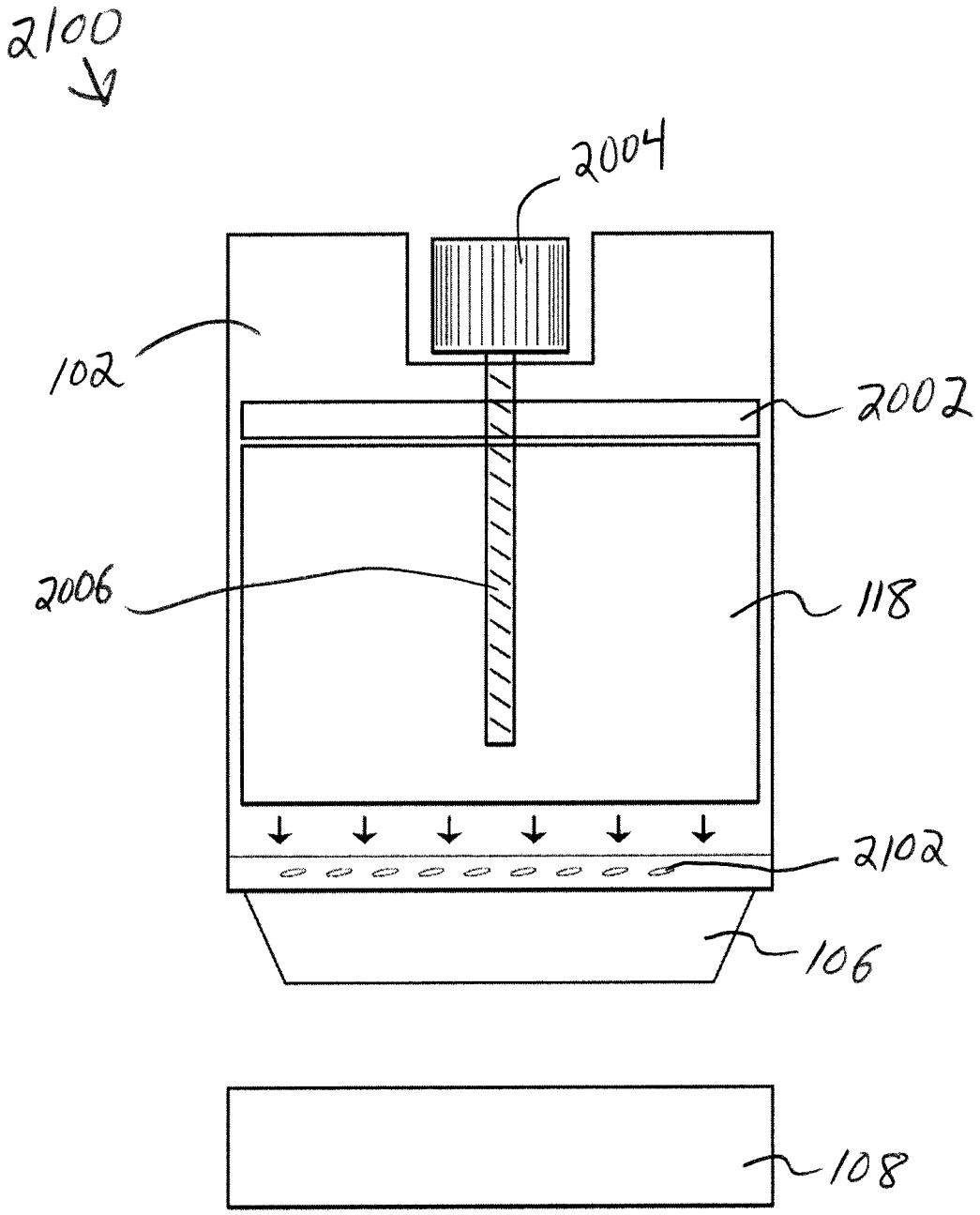
FIG. 22 illustrates a front view of an embodiment of a cleaning device.

FIG. 22 illustrates a front view of an embodiment of a cleaning device 2100. The cleaning device 2100 comprises a housing 102 having a dispenser 106, an internal cavity 118, an elevator 2002, a twist handle 2004, and a screw 2006. The dispenser 106 is configured to be in fluid communication with the internal cavity 118 through one or more openings 2102. The internal cavity 118 at least partially contains a volume of cleaning fluid. In use, a user may turn the twist handle 2004 causing the screw 2006 to move the elevator 2002 reducing the size of the internal cavity 118. Due to the reduction in size of the internal cavity 118, cleaning fluid stored in the cavity 118 is pushed through the one or more openings 2102 and into the dispenser 106. A user can then dispense the cleaning fluid using dispenser 106 onto a surface to be cleaned. An advantage of the embodiments shown in FIG. 22 is that a user may select the amount of cleaning fluid he or she wants to apply to the dispenser 106 prior to applying the dispenser 106 to the surface to be cleaned. For example, if a user only wants a small amount of cleaning fluid, the user may turn the twist handle 2004 a small amount. If the user, on the other hand, wants a larger volume of cleaning fluid to be applied to the surface to be cleaned, the user may turn the twist handle 2004 a larger amount.

In some embodiments, a reservoir comprising a fluid-permeable material is positioned within the internal cavity 118 and configured to retain at least a portion of the fluid within the internal cavity 118. In some embodiments, the elevator 2002 is configured to deform or reduce a volume of the fluid-permeable material when the elevator 2002 presses against the fluid-permeable material, to force a portion of fluid out of the fluid-permeable material and through the one or more openings 2102.

In some embodiments, the cleaning device 2100 does not comprise the openings 2102. Instead, the dispenser 106 is in direct fluid communication with the internal cavity 118 and or a fluid-permeable material positioned within the internal cavity 118. For example, the fluid-permeable material can comprise a porous plastic in direct fluid communication with a dispenser 106 comprising a microfiber cloth or other suitable material. In use, a user can rotate the twist handle 2004 to saturate the dispenser 106 to his or her liking, and then back the twist handle 2004 off to stop or reduce fluid transfer from the internal cavity 118 to the dispenser 106.

Figure 23:
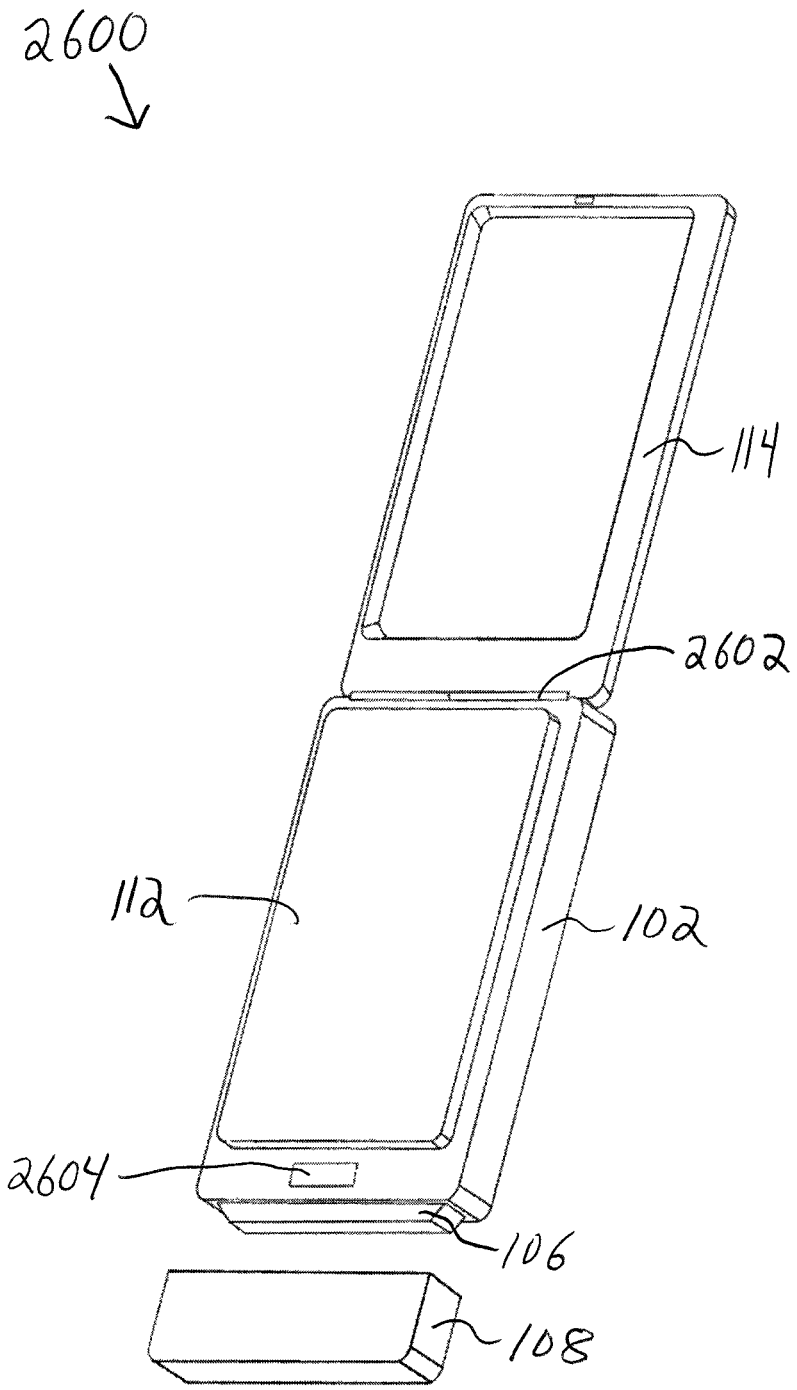
FIG. 23 illustrates a perspective view of an embodiment of a cleaning device.

FIG. 23 illustrates a perspective view of an embodiment of a cleaning device 2600 comprising a housing 102 having a dispenser 106, wiper 112, magnet 2604, and a clamshell cover 114. The clamshell cover 114 is configured to rotate at a hinge 2602 and cover the wiper 112. The cover 114 is configured to be held closed using the magnet 2604.

The embodiment shown in FIG. 23 illustrates that the wiper 112 and dispenser 106 may be configured in various ways. For example, in this embodiment, the dispenser 106 is protruding along a side of the housing 102 having a relatively small surface area. The wiper 112, on the other hand, is protruding from a surface of the housing 102 having a relatively large surface area. In some embodiments, the dispenser 106 may have a portion protruding to an exterior of the housing 102 and a portion protruding at least partially into an interior of the housing 102. In some embodiments, the portion protruding into the housing 102 may substantially fill an internal cavity of the housing 102. In some embodiments the dispenser 106 may fill substantially the entire inside of housing 102 and be positioned substantially parallel to the wiper 112 as shown in FIG. 23.

In some embodiments, such as illustrated in FIG. 23, the clam shell cover 114 may allow access to a removable wiper 112. In other embodiments, the wiper 112 shown in FIG. 23 may protrude through an opening in the cover 114 while the cover 114 is closed against the housing 102. In that embodiment, the wiper 112 is able to be used to wipe a surface without opening the clam shell cover 114. However, if the wiper is to be removed, such as to replace the wiper or use the wiper individually without being attached to the housing, the clam shell cover 114 may be opened to allow access to remove the wiper 112.

Figure 24:
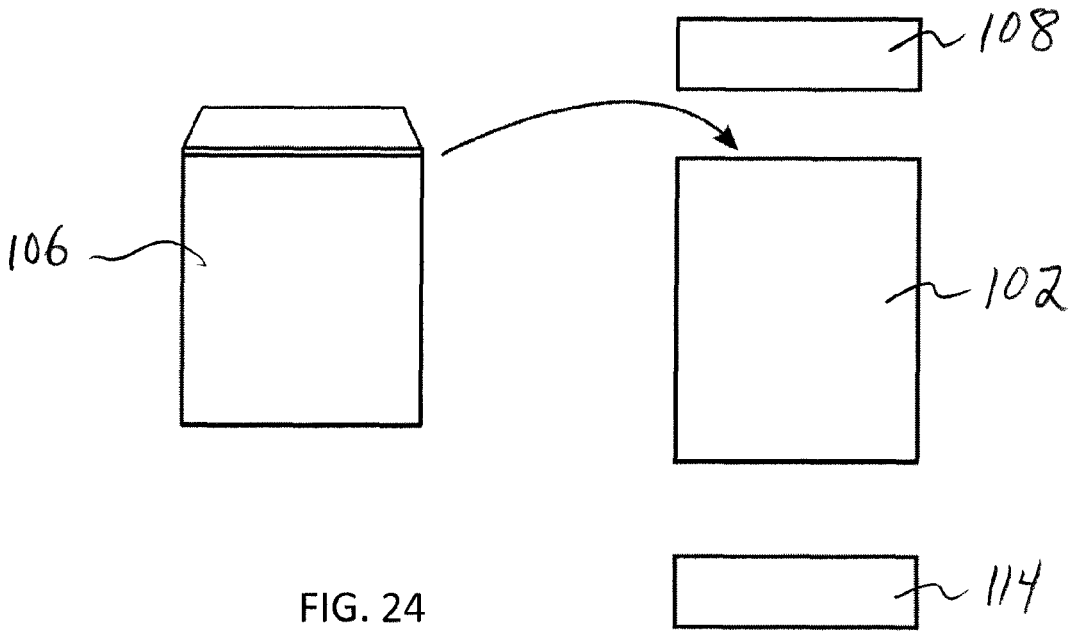
FIG. 24 illustrates an exploded view of an embodiment of a cleaning device.

In some embodiments, the dispenser 106 may be configured to be substantially permanently installed within the internal cavity of the housing 102. In some embodiments the dispenser 106 may be configured to be removable, refillable, and/or replaceable. For example, as shown in FIG. 24, a dispenser 106 may be inserted into a housing 102 after removing a dispenser cover 108. This design may be advantageous to allow, for example, replacement of a dispenser 106 containing old fluid that has expired or become ineffective with a new dispenser 106 containing new cleaning fluid. In another example, a user may want a different type of cleaning fluid and therefore may replace one dispenser 106 that contains a first type of cleaning fluid with a second dispenser 106 containing a second type of cleaning fluid. Although the embodiment shown in FIG. 24 includes a wiper cover 114 (with a wiper not being shown, although a wiper may or may not be included), various embodiments, including embodiments not comprising a wiper or wiper cover, can be configured to have a removable, refillable, and/or replaceable dispenser. In some embodiments, the dispenser 106 comprises a cover or barrier or housing, for example a thin plastic layer, covering at least a portion of the dispenser 106 to enable a user to handle the dispenser 106, such as to remove, install, or replace the dispenser, without coming into contact with fluid or a portion the dispenser containing or impregnated with fluid.

Figure 25:
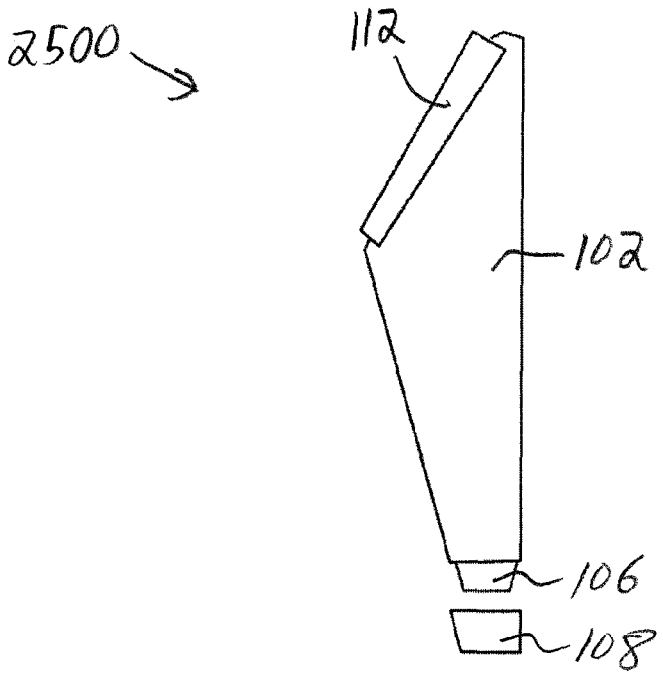
FIG. 25 illustrates a side view of an embodiment of a cleaning device.

FIG. 25 illustrates a side view of an embodiment of a cleaning device 2500 comprising a housing 102 having a wiper 112, a dispenser 106, and a dispenser cover 108. The embodiment shown in FIG. 25 illustrates that the ends or sides or surfaces where the wiper 112 and/or dispenser 106 are positioned need not be at right angles or parallel to each other or at any particular angle to each other. In this embodiment, the dispenser 106 is positioned at approximately a 90° angle to a main axis of the housing 102. The wiper 112, however, is positioned at a different angle, roughly 40°, to an axis of the housing 102. However, the surface comprising the wiper 112 may be at various other angles and the surface comprising the dispenser 106 may be at various other angles to an axis of the housing 102. One advantage of the embodiment shown in FIG. 25 is that the wiper 112 is able to have a larger surface area while minimizing any increase in size to the housing 102. For instance, if the wiper 112 were positioned parallel to the dispenser 106 and was the same size as shown in FIG. 25, the housing 102 would have a larger overall size. By changing the angle of the surface or end or side containing the wiper 112, a larger wiper 112 is able to be used while minimizing an increase in size of the housing 102. Another advantage of embodiments having a wiper and/or dispenser at different angles is that the cleaning device may be more ergonomically designed.

Figure 26A:
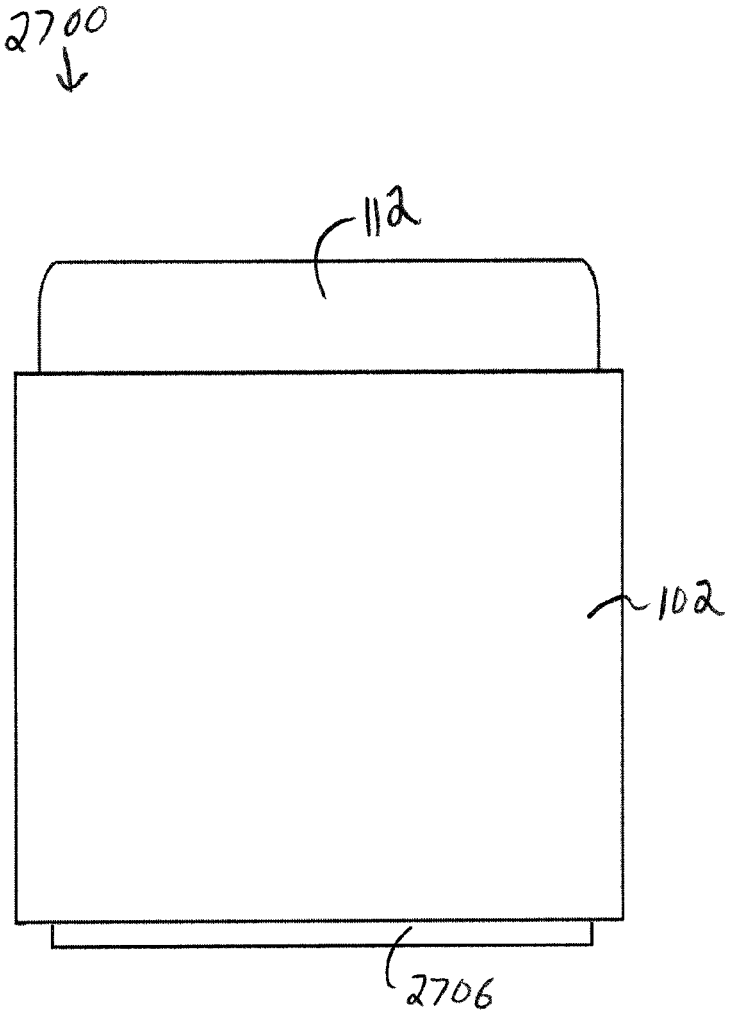
FIG. 26A illustrates a front view of an embodiment of a cleaning device.
Figure 26B:
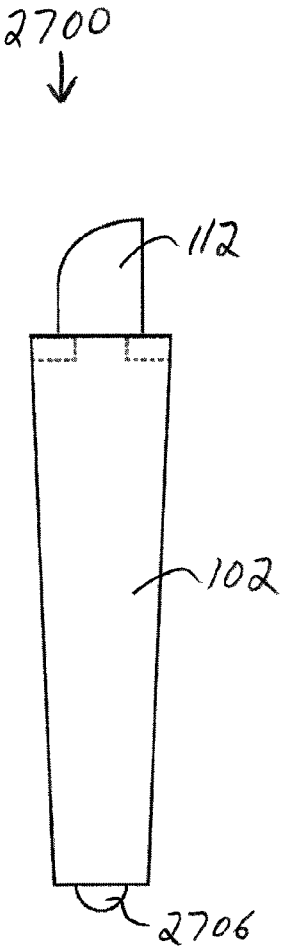
FIG. 26B illustrates a side view of the cleaning device of FIG. 26A.

FIGS. 26A and 26B illustrate an embodiment of a cleaning device 2700. FIG. 26A illustrates a front view of the cleaning device 2700 and FIG. 26B illustrates a side view of the cleaning device 2700. The cleaning device 2700 comprises a housing 102, a wiper 112, and a roller dispenser 2706. This embodiment shows that the dispenser need not be a stationary item that is moved along a surface to be cleaned. In this embodiment, the dispenser 2706 is a roller that rolls along a surface to be cleaned. The dispenser 2706 may be in fluid contact with cleaning fluid positioned within a cavity of housing 102 on one side of the dispenser 2706 while another side of the dispenser 2706 is in contact with a surface to be cleaned. In use, as the dispenser 2706 is rolled along a surface to be cleaned, the dispenser 2706 can absorb or pick up cleaning fluid from the internal cavity of the housing 102 and present that fluid to the surface being cleaned as the dispenser surface that absorbed the fluid rolls around to the exterior of the housing and contacts the surface being cleaned. The roller dispenser 2706 may comprise a unitary material, such as a porous plastic, felt, microfiber material, etc. The roller dispenser 2706 may alternatively comprise multiple layers. For example, the dispenser 2706 may include a relatively firm material forming a core cylinder which is covered by a layer of fabric such as microfiber or sponge or foam material. In some embodiments, a wiper is configured to be a roller wiper, similar in operation to the roller dispenser 2706 of the cleaning device 2700. This may, for example, allow more surface area of a wiper to be used compared to a non-rolling wiper.

Figure 27:
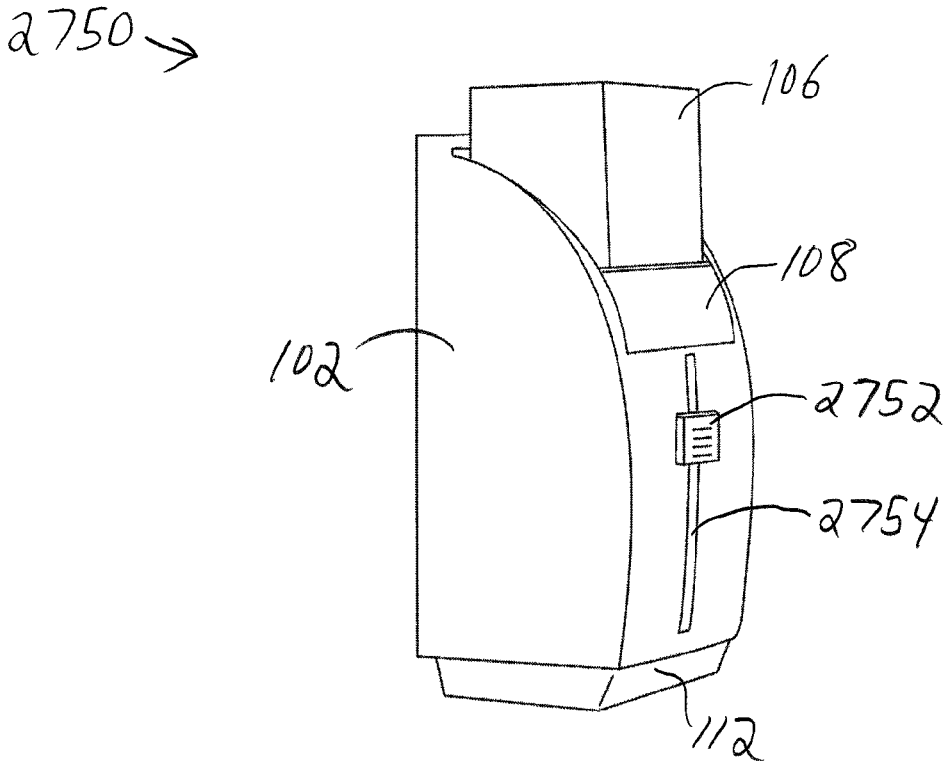
FIG. 27 illustrates a perspective view of an embodiment of a cleaning device.

FIG. 27 illustrates a perspective view of an embodiment of a cleaning device 2750. The cleaning device 2750 comprises a housing 102 with a dispenser 106 configured to move relative to the housing 102 and to selectively protrude through an opening of the housing 102. The cleaning device 2750 further comprises a slider 2752 configured to slide relative to a slot 2754 of the housing 102. The slider 2752 is configured to move the dispenser cover 108 when the slider 2752 is moved relative to the slot 2754. The dispenser cover 108 is slidably engaged with the housing 102 and has an open and a closed configuration. When the dispenser cover 108 is in its closed configuration, the dispenser 106 is positioned within the cavity of the housing 102. When the dispenser cover 108 is in its open configuration, an opening is created to allow the dispenser 106 to at least partially protrude through the opening. In some embodiments, a spring is positioned between the dispenser 106 and an interior surface of the housing 102. The spring is configured to force the dispenser 106 to protrude at least partially through the opening created when the dispenser cover 108 is moved. The cleaning device 2750 further comprises a wiper 112 positioned substantially opposite to the dispenser 106. In other embodiments, the wiper 112 may be positioned elsewhere, or the cleaning device 2750 may not include a wiper.

Figure 28:
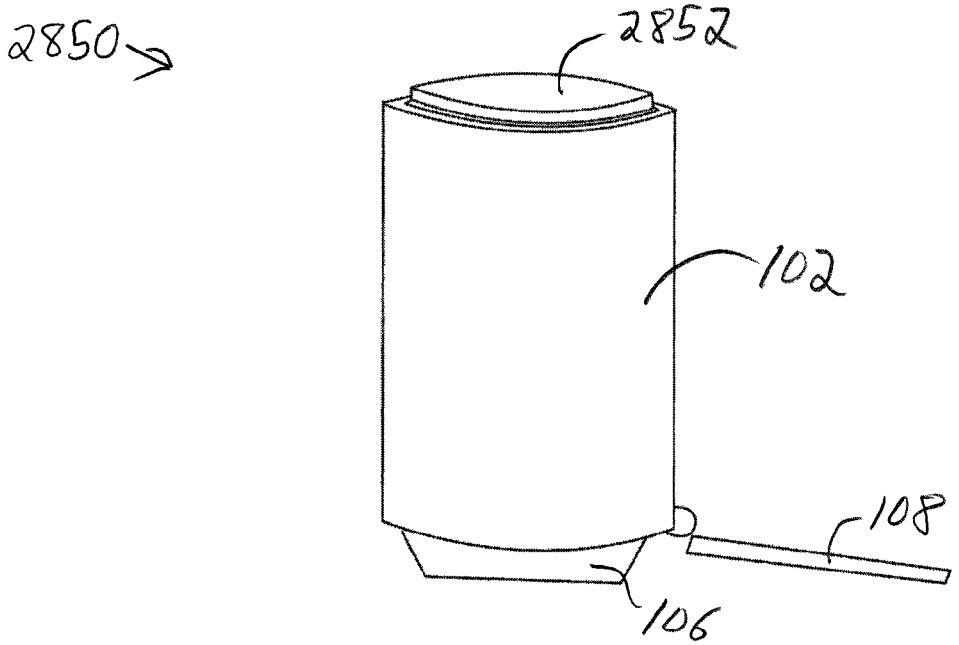
FIG. 28 illustrates a perspective view of an embodiment of a cleaning device.

FIG. 28 illustrates a perspective view of an embodiment of a cleaning device 2850. The cleaning device 2850 comprises a housing 102 having a dispenser cover 108 hingedly attached to the housing 102. The cleaning device 2850 further comprises a dispenser 106 and a button 2852. In some embodiments, the dispenser 106 is configured to move relative to the housing 102, to allow the dispenser 106 to retract within a cavity of the housing 102 and to alternately protrude at least partially through an opening in the housing 102. In some embodiments, the button 2852 is configured to move the dispenser 106 to protrude at least partially through the opening in the housing 102 when the button 2852 is depressed by a user. In some embodiments, the dispenser cover 108 is configured to be opened by the dispenser 106 contacting an interior surface of the dispenser cover 108 and pushing the dispenser cover 108 open. In some embodiments, the button 2852 is configured to operate a latch retaining the dispenser cover 108 in the closed position. When the button 2852 is depressed by a user, the latch is operated to allow the dispenser cover 108 to move to the opened position. In some embodiments, the dispenser 106 and/or dispenser cover 108 are spring-loaded, such that the dispenser 106 moves to the at least partially protruding position and/or the dispenser cover 108 moves to the opened position under the force of a spring when the button 2852 is depressed. In some embodiments, the button 2852 comprises a wiper. In other embodiments, a wiper is located elsewhere on the housing 102.

Embodiments as shown in FIGS. 27 and 28 may be desirable, for example, as a one-handed cleaning device. Although several of the embodiments described herein may be used with one hand, the embodiments illustrated in FIGS. 27 and 28 may be easier to use with one hand, because the dispenser covers 108 do not have to be removed from the housing 102.

Figure 29A:
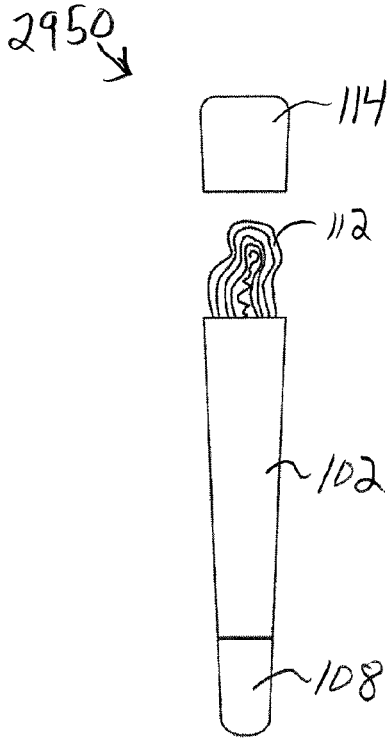
FIG. 29A illustrates a side view of an embodiment of a cleaning device.
Figure 29B:
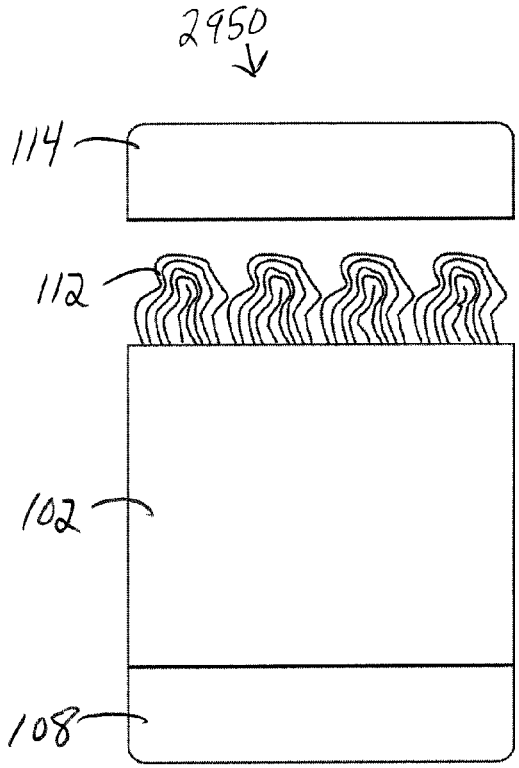
FIG. 29B illustrates a front view of an embodiment of a cleaning device.
Figure 30:
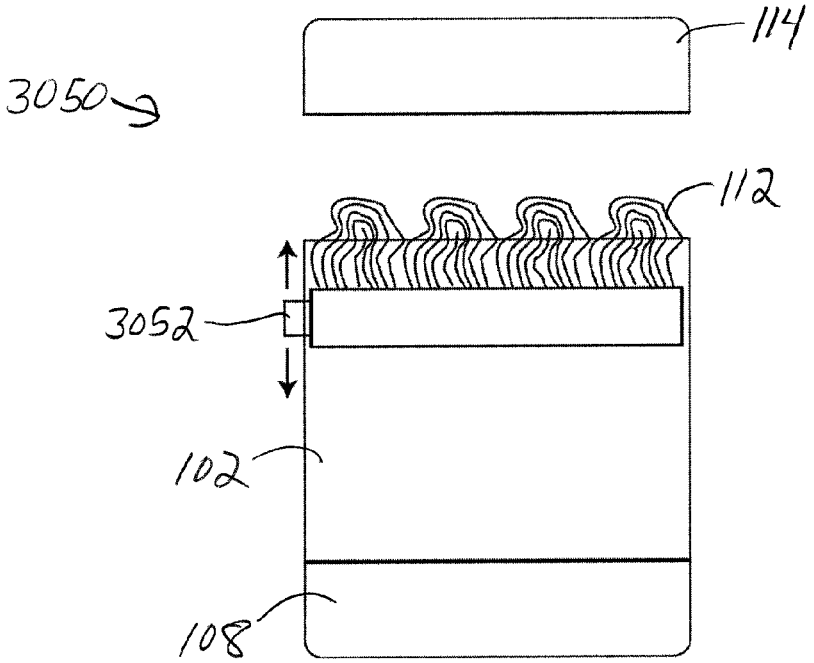
FIG. 30 illustrates a front view of an embodiment of a cleaning device.

FIGS. 29A and 29B illustrate a side view and a front view, respectively, of an embodiment of a cleaning device 2950. The cleaning device 2950 comprises a housing 102, a dispenser cover 108, a wiper cover 114, and a wiper 112. In this embodiment, the wiper 112 comprises a cloth material. For example, the wiper 112 may comprise a shredded microfiber cloth material. The wiper 112 may alternatively comprise a soft cloth, such as microfiber that has been bunched up. These embodiments may be advantageous, for example, to increase a surface area over which the wiper 112 contacts a surface of an object being cleaned. In some embodiments, as shown in FIG. 30, a cleaning device 3050 comprises a slider 3052 configured to selectively retract the wiper 112 at least partially within a cavity of the housing 102. The wiper 112 may be configured to be stowed within the housing 102, potentially eliminating any need for a wiper cover.

Although the embodiments shown in FIGS. 29A, 29B, and 30 illustrate wipers 112 comprising soft shredded and/or bunched up material, these concepts may be applied to a dispenser, too. For example, a dispenser may comprise soft shredded and/or bunched up material in fluid communication with a reservoir of cleaning fluid. In use, cleaning fluid may be transferred from the reservoir through the soft material to an object being cleaned.

Figure 31A:
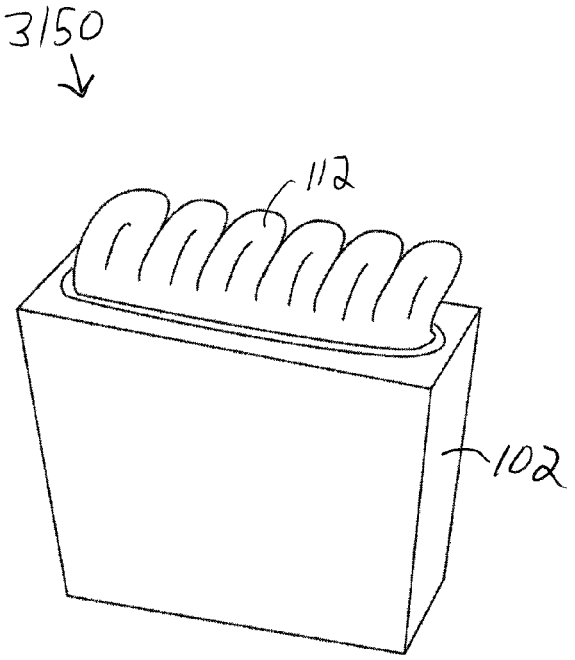
FIG. 31A illustrates a perspective view of an embodiment of a cleaning device.
Figure 31B:
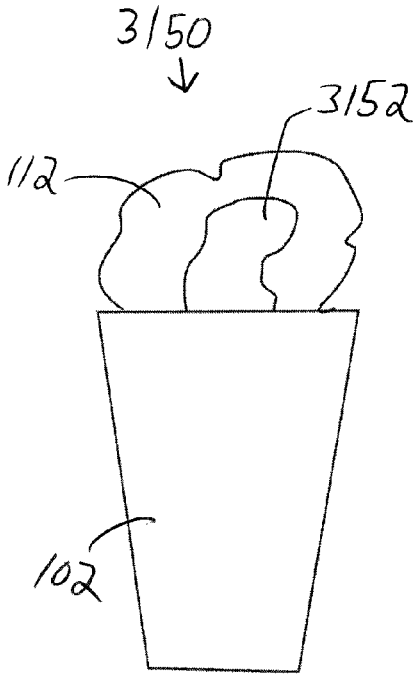
FIG. 31B illustrates a side view of an embodiment of a cleaning device.

FIGS. 31A and 31B illustrate a perspective view and side view, respectively, of an additional embodiment of a cleaning device 3150 comprising a wiper 112 comprising shredded and/or bunched up soft cloth material. As is illustrated in FIG. 31B, the wiper 112 may be configured to surround or substantially surround an inner portion 3152. The inner portion 3152 can be configured to be more rigid than the wiper 112, to allow the wiper 112 to retain at least somewhat of a predetermined shape. Although this embodiment is described as comprising shredded and/or bunched up soft cloth material for the wiper 112, the shredded and/or bunched up soft cloth material may also or alternatively be used for a dispenser.

Figure 32:
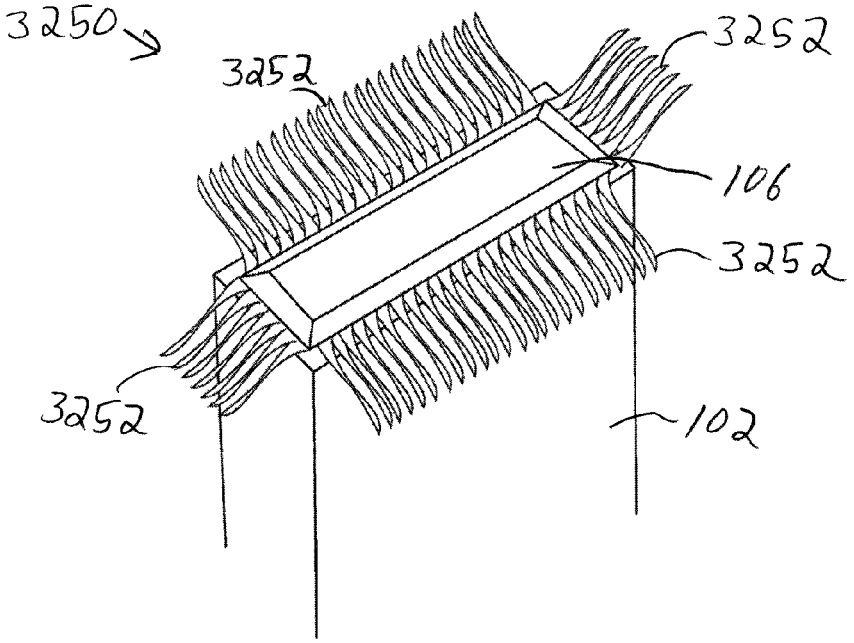
FIG. 32 illustrates a perspective view of an embodiment of a cleaning device.

FIG. 32 illustrates a perspective view of an embodiment of a cleaning device 3250. The cleaning device 3250 comprises a housing 102, a dispenser 106, and cloth pieces 3252. The cloth pieces 3252 are attached to the housing 102 and at least partially surround a perimeter of the dispenser 106. In this embodiment, the dispenser 106 can be configured to dispense fluid to a surface being cleaned, while the cloth pieces 3252 are configured to help in cleaning the surface being cleaned by wiping the surface. The cloth pieces 3252 may comprise any cloth material suitable for wiping a surface, for example, microfiber cloth material.

Figure 33A:
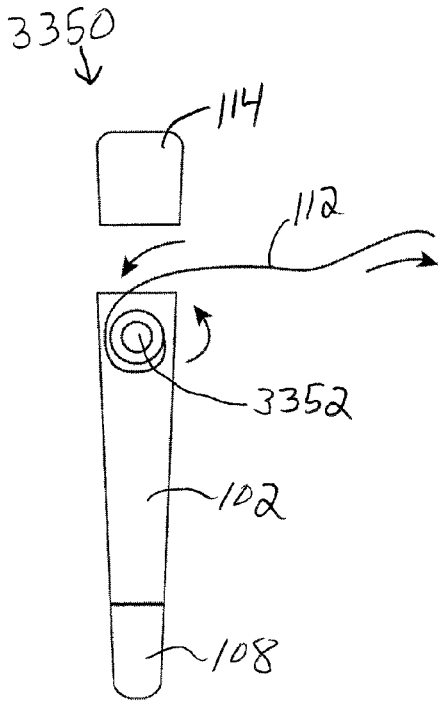
FIG. 33A illustrates a side view of an embodiment of a cleaning device.
Figure 33B:
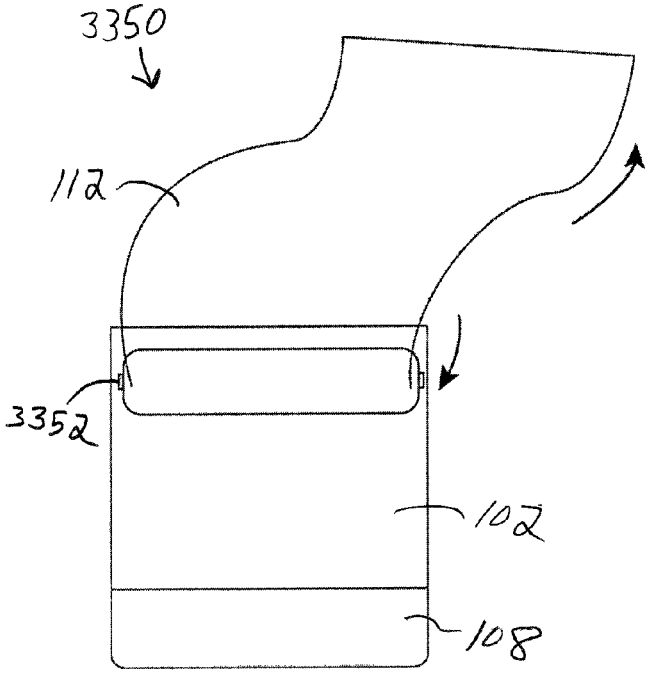
FIG. 33B illustrates a front view of an embodiment of a cleaning device.

FIGS. 33A and 33B illustrate side and front views, respectively, of a cleaning device 3350. The cleaning device 3350 comprises a housing 102, a dispenser cover 108, a wiper cover 114, and a wiper 112. In this embodiment, the wiper 112 comprises a cloth, such as a microfiber cloth. The wiper 112 is retained within the housing 102 by being rolled onto a cylinder 3352. When a user desires to use the wiper 112, the user can pull the wiper 112 at least partially out of the housing 102, causing the cylinder 3352 to unroll the wiper 112. In some embodiment, the cylinder 3352 is spring-loaded, to retract the wiper 112 back into the housing 102 after use. In some embodiments, the cleaning device 3350 further comprises a crank used to roll the wiper 112 back into the housing 102.

Figure 34:
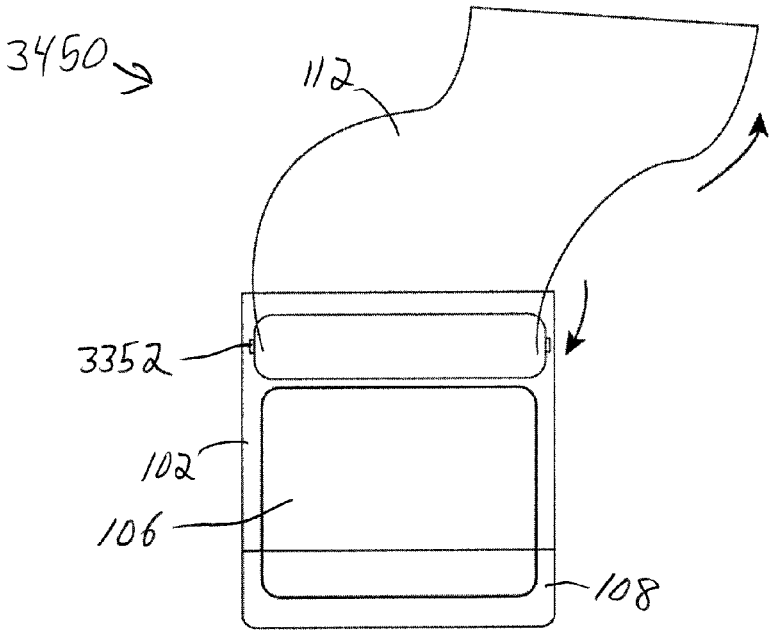
FIG. 34 illustrates a front view of an embodiment of a cleaning device.

FIG. 34 illustrates a front view of another embodiment of a cleaning device 3450 comprising a cylinder 3352. In this embodiment, a dispenser 106 is configured to be in contact with the wiper 112 when the wiper 112 is within the housing 102, wrapped around the cylinder 3352. This design may be advantageous, for example, by cleaning the wiper 112 as it is rolled back into the housing 102 by forcing it against a portion of the dispenser 106. The cleaning device 3450 may be configured such that the dispenser 106 transfers sufficient cleaning fluid to the wiper 112 to clean the wiper 112, but not to saturate the wiper 112 with cleaning fluid. In some embodiments, the wiper 112 shown in FIG. 34 may be configured to be a dispenser. In that case, the dispenser 106 is configured to transfer cleaning fluid to the soft material when it is wrapped around the cylinder 3352. When the soft material is unwound and pulled from the housing 102, it is sufficiently saturated with cleaning fluid to transfer cleaning fluid to a surface being cleaned.

In some embodiments, a cleaning device may include a dispenser comprising a nozzle to dispense or spray cleaning fluid onto a surface to be cleaned. Cleaning fluid is dispensed through the nozzle by operating a pump (either manually or electrically operated) in some embodiments, or by squeezing sides of a housing in other embodiments.

In some embodiments, a cleaning device may include a dispenser comprising a spring-loaded plug configured to plug or close off an opening to retain cleaning fluid within an internal cavity of a housing. The dispenser is configured to allow cleaning fluid to flow from the internal cavity of the housing through the opening to an exterior of the housing when a user presses the dispenser against a surface to counteract the force of a spring forcing the dispenser against the opening. In some embodiments, the plug comprises a non-fluid permeable material, for example rubber, plastic, etc. In some embodiments, the plug includes one or more fabric layers, such as microfiber cloth, as described above in reference to various embodiments of dispensers and/or wipers. In these embodiments, the dispenser can be configured to at least partially saturate the one or more fabric layers with cleaning fluid transferred from the internal cavity of the housing when the user presses the dispenser against a surface.

Although several embodiments described herein comprise dispenser covers and wiper covers, such as the dispenser cover 108 and wiper cover 114 shown in FIG. 1A, various embodiments can comprise any combination of covers, including no covers, only a dispenser cover, or only a wiper cover.

In some embodiments, a cleaning device may comprise one or more clips or loops to hook the device onto a belt, backpack strap, purse loop, and the like. In some embodiments, the clips or loops comprise "hand bands" or straps configured to be wrapped around a user's hand.

Dispensers and Wipers

Figure 35A:
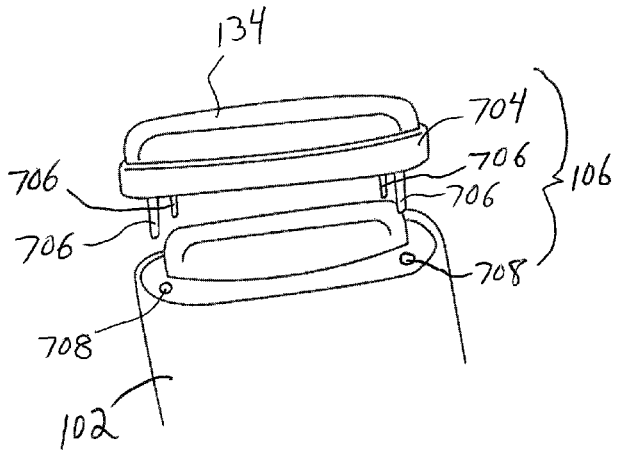
FIG. 35A illustrates a perspective view of an embodiment of a cleaning device.
Figure 35B:
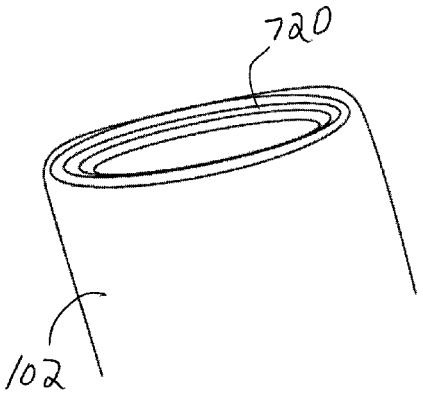
FIG. 35B illustrates a perspective view of an embodiment of a cleaning device.
Figure 35C:
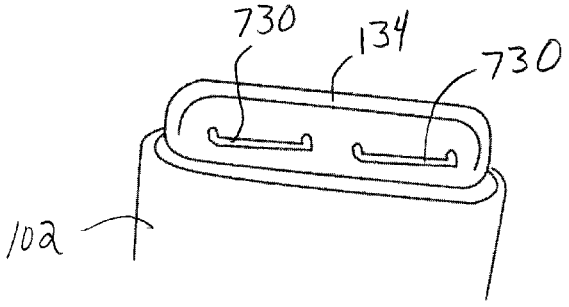
FIG. 35C illustrates a perspective view of an embodiment of a cleaning device.

FIGS. 35A-35C illustrate embodiments of cleaning devices having a dispensing surface 134 comprising at least one fabric layer. Referring to FIG. 35A, a dispensing surface 134 comprising at least one fabric layer, such as a microfiber fabric, is attached to a dispensing surface retainer 704. Dispensing surface retainer 704 comprises retainer legs 706 configured to fit into retainer holes 708 of the housing 102. The dispensing surface retainer 704 is configured to attach to the housing 102 by positioning the retainer legs 706 within the retainer holes 708. The retainer legs 706 may form a friction fit with the retainer holes 708 or may be held in place with adhesive, lips, or various other means. The retainer legs 706 may be configured to be substantially permanently installed within the retaining holes 708 or the dispensing surface retainer 704 may be configured to be removable and replaceable. In the embodiment shown in FIG. 35A the dispensing surface 134 is defined by a microfiber material attached to the dispensing surface retainer 704 such as by gluing or adhering the microfiber material to the dispensing surface retainer 704, stapling the microfiber material to the dispensing surface retainer 704, and/or holding the microfiber fabric material in place through friction as the dispensing surface retainer 704 presses the microfiber fabric material against a mating portion of the dispenser 106.

Referring to FIG. 35B, the housing 102 may include a retaining lip 720 for retention of, for example, a microfiber fabric material comprising the dispensing surface 134 of the dispenser 106. For example, a portion of the dispenser 106 may protrude through an opening in the housing 102 with a fabric material, such as a microfiber material, being adhered or glued to the retaining lip 720. Alternatively, the fabric may be adhered to the retaining lip 720 using various other means, such as stapling, plastic welding, or being held in through friction caused by a portion of the dispenser 106 pressing the fabric against the retaining lip 720.

Referring to FIG. 35C, a fabric layer forming the dispensing surface 134 of the dispenser 106 may additionally be adhered in other ways. For example, the dispensing surface retainers 730 shown in FIG. 35C are staples extending through the dispensing surface 134 to retain the fabric layer to the rest of the dispenser 106. Various other means may be used to retain a fabric layer or other layer to a portion of the dispenser 106. For example a mechanical pin may extend through a hole in the fabric layer and into the dispenser 106, retaining the layer to the rest of the dispenser 106.

In some embodiments, a fabric layer forming the dispensing surface of a dispenser is crimped to a portion of the dispenser with, for example, a metal crimp. In other embodiments, the fabric layer is sewn and/or glued to a portion of the dispenser.

Figure 36A:
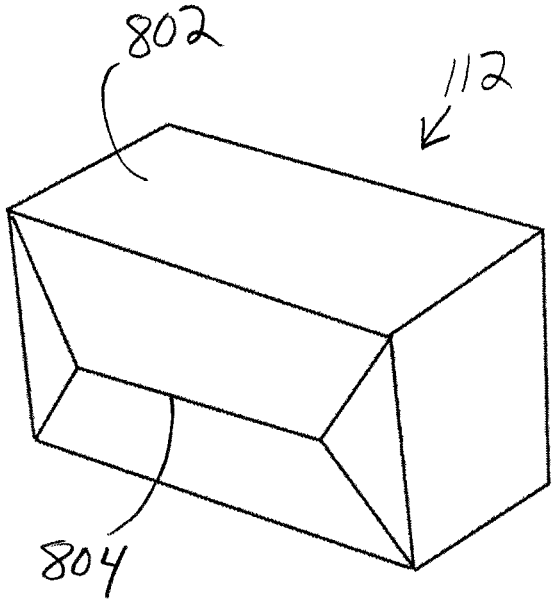
FIG. 36A illustrates a perspective view of an embodiment of a wiper of a cleaning device.
Figure 36B:
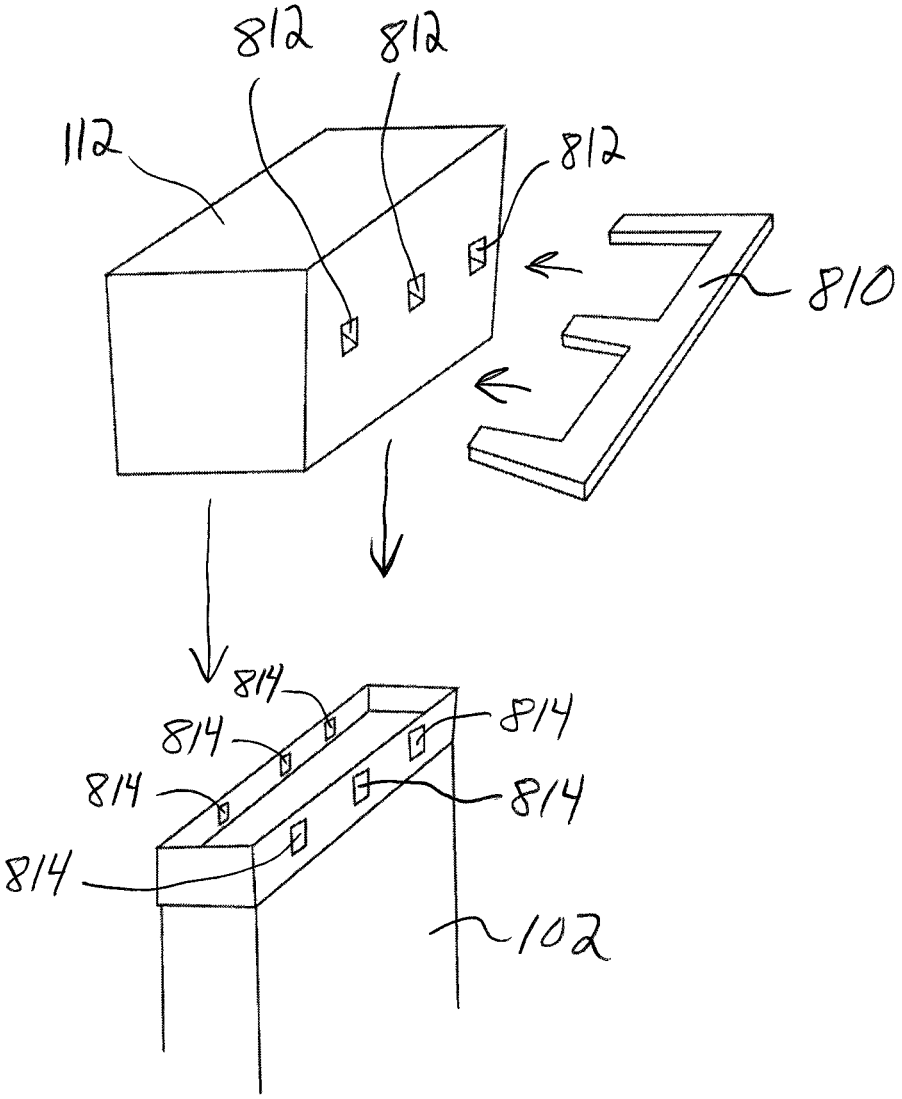
FIG. 36B illustrates an exploded view of an embodiment of a cleaning device.

FIG. 36A illustrates a wiper 112 comprising an outer layer 802. The outer layer 802 may, for example, comprise a microfiber cloth material, cotton, or any other material sufficient to form a wiping surface to wipe a surface being cleaned and/or an absorbent surface to absorb, for example, excess cleaning fluid on a surface being cleaned. The wiper 112 shown in FIG. 36A comprises seams 804 formed by the outer layer 802 being wrapped around the wiper 112. The outer layer 802 may be held onto an exterior surface of the wiper 112 using adhesives, staples, a rubber or elastic band, other mechanical means, and/or being wrapped substantially taut and sealed or otherwise held together at the seams 804. In some embodiments, an outer layer 802 is replaceable with a new outer layer to, for example, replace the outer layer 802 when it becomes worn out. In other embodiments, an outer layer 802 is relatively permanently attached and not configured to be replaceable. In some embodiments, the outer layer 802 may have a useful life of, for example 100 uses, while the rest of the cleaning device has a useful life of, for example, 1000 uses.

The wiper 112 shown in FIG. 36A may be used with a housing 102 in various configurations. For example, the wiper 112 may be positioned at least partially within a wiping end 110 of a housing 102 with the side of the wiper comprising the seams 804 being positioned within a cavity of the housing 102. When a wiping surface of the wiper 112 shown in FIG. 36A becomes dirty, a user can remove the wiper 112 from the housing 102, reposition the wiper 112, and reinsert it into the housing 102. For example, the user may rotate the wiper 90° or 180° and reinsert it into the housing 102. This may be advantageous to allow multiple clean surfaces of the wiper 112 to be used as other surfaces of the wiper 112 become dirty or contaminated. The outer layer portion 802 of the wiper 112 may be configured to be removable by a user to either wash the outer layer 802 and reinstall it on the wiper 112 or to replace it with a new outer layer 802. In some embodiments, various outer layers 802 may be available based on the intended use of the wiper 112. For example, a microfiber cloth material may be a desirable material to form a wiping surface to wipe a computer screen, while a different type of material, such as a spongy material, may form a more desirable wiping surface to clean various other surfaces, such as wood surfaces. Therefore, a user may remove a microfiber outer layer 802 and replace it with a spongy material outer layer 802 to clean different surfaces. In some embodiments, a cleaning device may have multiple interchangeable wipers 112 having a variety of different outer layer materials. A user may remove a wiper 112 and replace it with a different wiper 112 to allow a different surface to be used to clean a different surface.

In some embodiments, an outer layer 802 may comprise more than one material. For example an outer layer 802 may be applied in a configuration where one wiping surface exposes a microfiber material and another wiping surface exposes a different type of material. A wiper 112 may be configured so that the multiple types of wiping surface materials are available at the same time for use in wiping a single surface, or a wiper 112 may be configured to have one type of wiping surface available at a time. In those embodiments, the user may remove the wiper 112 from the housing 102 and reposition and reinstall it in the housing 102 with the different wiping surface being exposed in order to change the wiping surface. Alternatively, the user may remove the wiper 112 from the housing 102 and use the wiper 112 as a component separated from the housing 102 to wipe a surface.

In some embodiments, mechanical retaining devices are used to retain a, for example, fabric outer layer or fabric material forming a dispensing or wiping surface of a dispenser or wiper. In some embodiments, the mechanical retainer, in addition to retaining the fabric material, also retains at least a portion of the dispenser 106 or the wiper 112 to the housing 102. For example, as illustrated in FIG. 36B, a fastener 810 extends through three fastener holes 812 in a side of a wiper 112 and into mating fastener holes 814 in the housing 102. The fastener 810 illustrated in FIG. 36B performs both the function of retaining a wiper cover or fabric layer portion of the wiper 112 and retaining the wiper 112 itself to the housing 102. In some embodiments, a fastener, such as the fastener 810, is used to retain the wiper cover or fabric layer portion of the wiper 112, but not to retain the wiper 112 to the housing 102. The wiper 112 can be retained to the housing 102 using various other means, such as a friction fit, a separate fastener, etc.

Figure 36C:
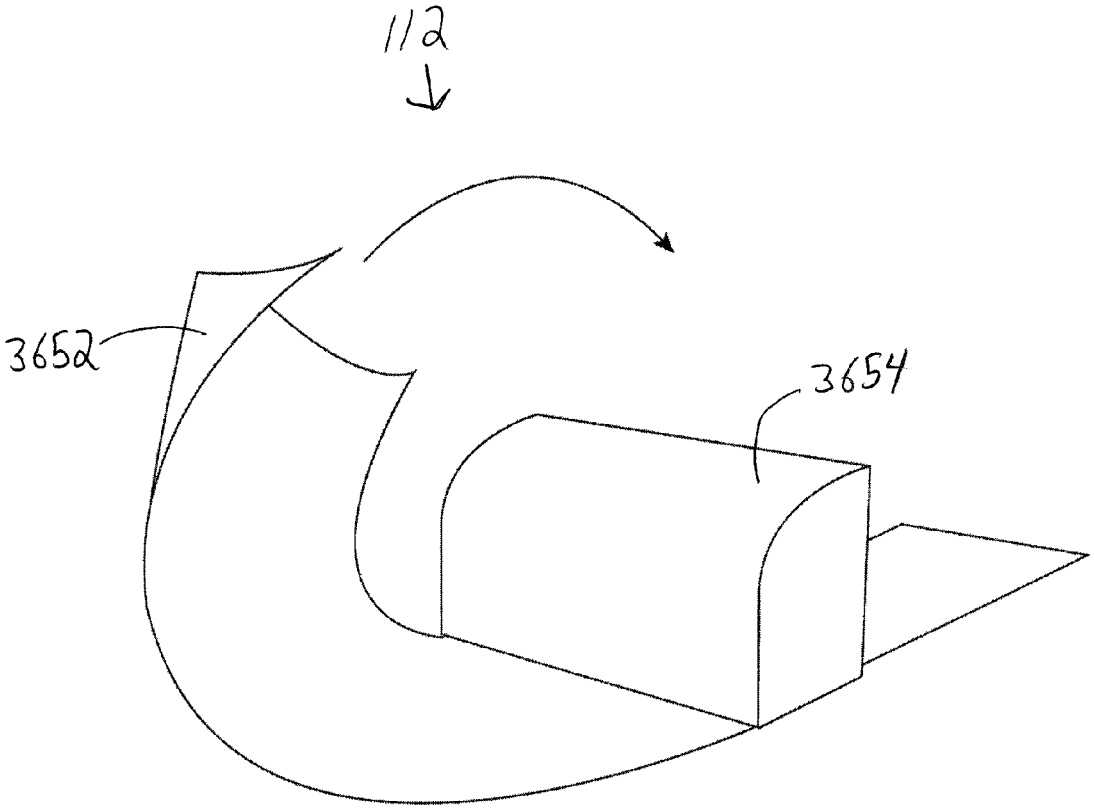
FIG. 36C illustrates an exploded view of an embodiment of a cleaning device.
Figure 36D:
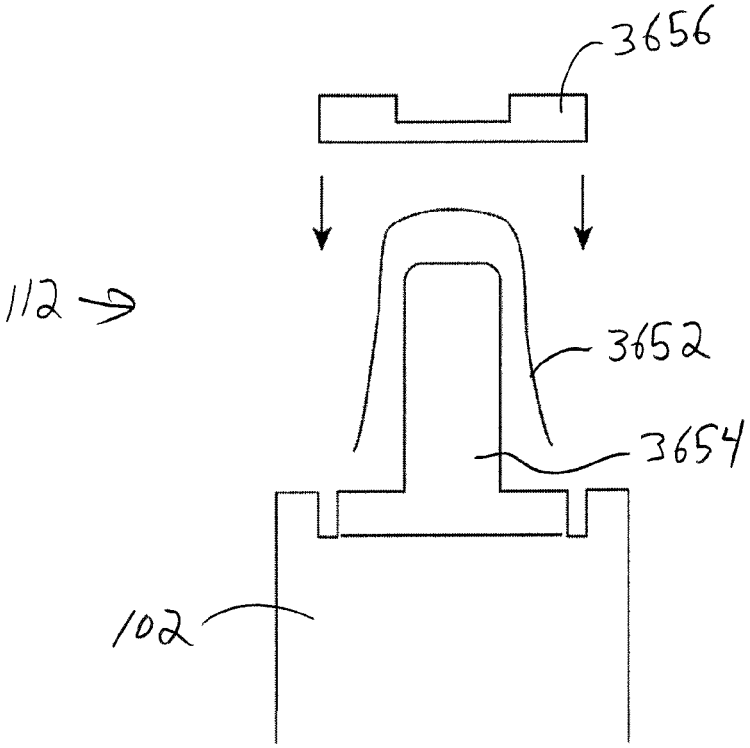
FIG. 36D illustrates an exploded view of an embodiment of a cleaning device.
Figure 36E:
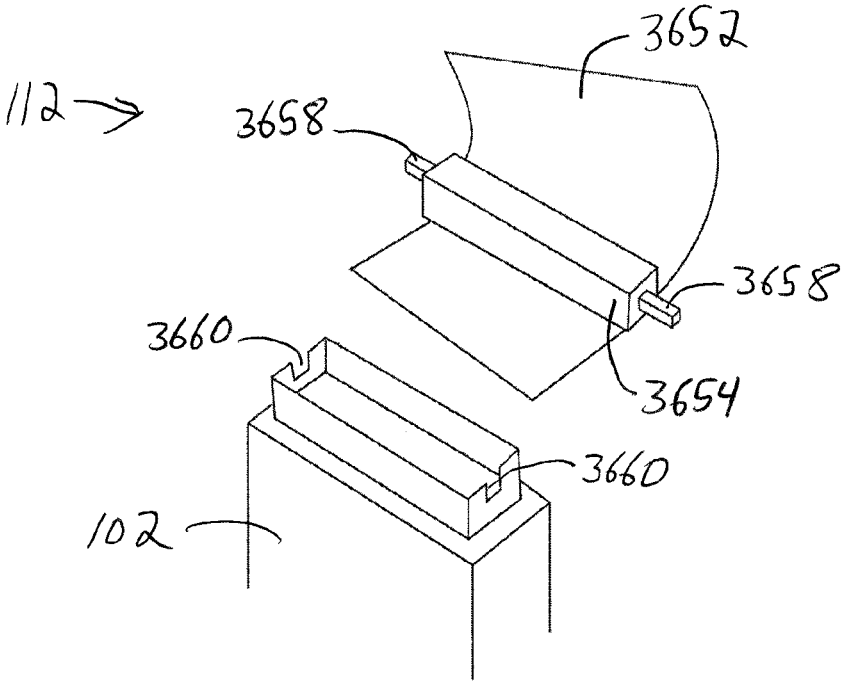
FIG. 36E illustrates an exploded view of an embodiment of a cleaning device.

FIG. 36C illustrates an exploded view of an embodiment of a wiper 112. In this embodiment, the wiper 112 comprises an inner portion 3654 and a fabric cover 3652. The fabric cover 3652 can be configured to be wrapped one or more times around the inner portion 3654. In some embodiments, the fabric cover 3652 can be held to the inner portion 3654 using one or more staples or other fasteners. In some embodiments, the fabric cover 3652 is held in place over the inner portion 3654 through friction, such as when the wiper 112 is inserted into a cavity of a dispenser retainer, such as is shown in FIG. 7E. In other embodiments, such as is illustrated in FIG. 36D, a fabric cover 3652 is retained over an inner portion 3654 using a fastener or collar 3656 that slides over the fabric cover 3652. In other embodiments, as is illustrated in FIG. 36E, a fabric cover 3652 is wrapped around an inner portion 3654, and the wiper is retained to the housing 102 with pegs 3658 that engage recesses 3660 of the housing 102. In other embodiments, the wiper is attached to the housing 102 using various other means. Although the embodiments illustrated in FIGS. 36A-36E are described with respect to wipers, the concepts may also be utilized with dispensers and cloth covers used with dispensers.

Figure 37A:
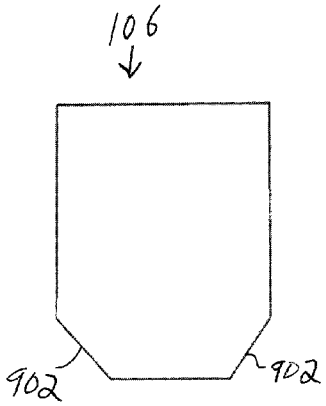
FIG. 37A illustrates a front view of an embodiment of a dispenser of a cleaning device.
Figure 37B:
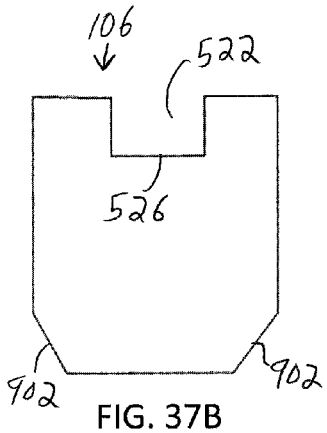
FIG. 37B illustrates a front view of an embodiment of a dispenser of a cleaning device.
Figure 37C:
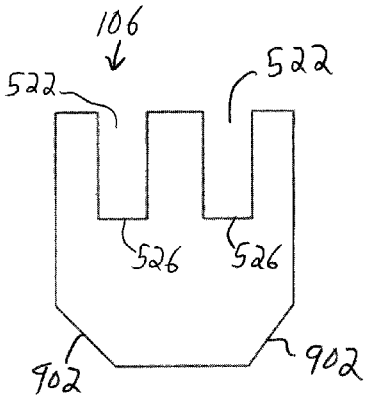
FIG. 37C illustrates a front view of an embodiment of a dispenser of a cleaning device.
Figure 37D:
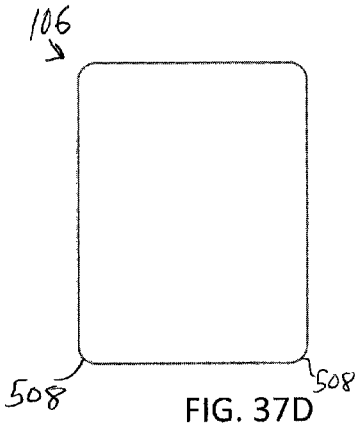
FIG. 37D illustrates a front view of an embodiment of a dispenser of a cleaning device.
Figure 37E:
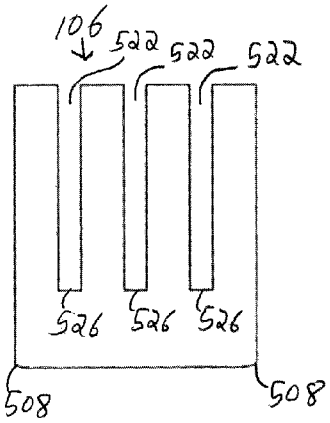
FIG. 37E illustrates a front view of an embodiment of a dispenser of a cleaning device.
Figure 37F:
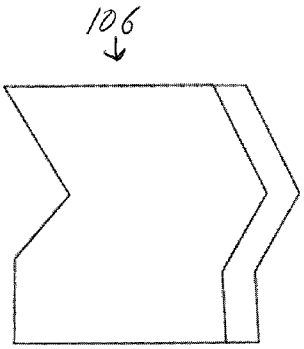
FIG. 37F illustrates a perspective view of an embodiment of a dispenser of a cleaning device.
Figure 37G:
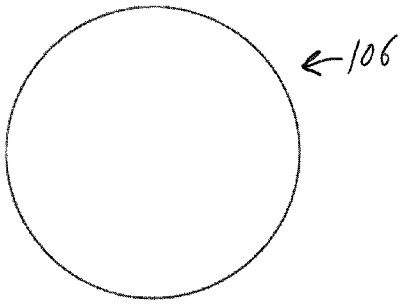
FIG. 37G illustrates a front view of an embodiment of a dispenser of a cleaning device.
Figure 37H:
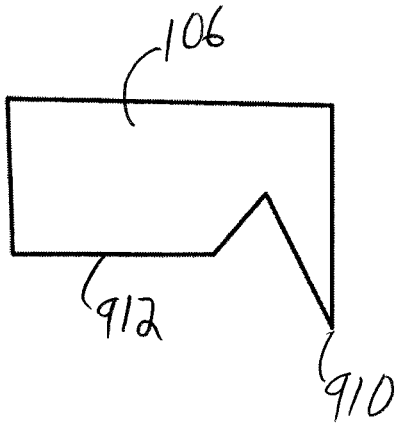
FIG. 37H illustrates a side view of an embodiment of a dispenser of a cleaning device.
Figure 37J:
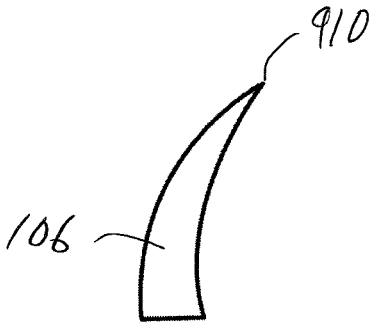
FIG. 37J illustrates a side view of an embodiment of a dispenser of a cleaning device.
Figure 37K:
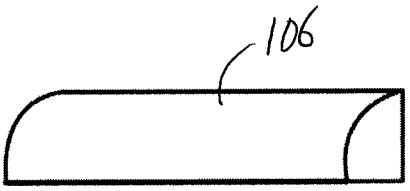
FIG. 37K illustrates a perspective view of an embodiment of a dispenser of a cleaning device.
Figure 37L:
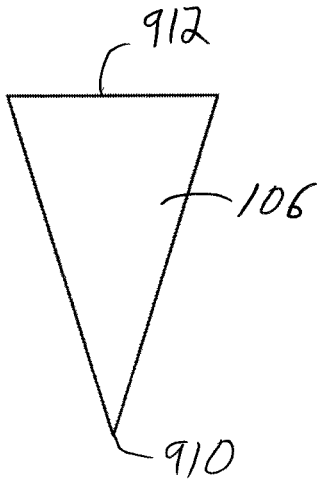
FIG. 37L illustrates a top view of an embodiment of a dispenser of a cleaning device.
Figure 37M:
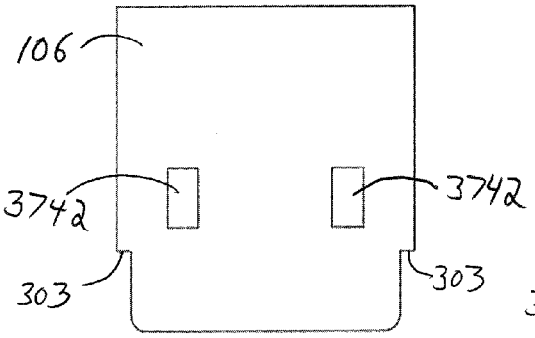
FIG. 37M illustrates a front view of an embodiment of a dispenser of a cleaning device.
Figure 37N:
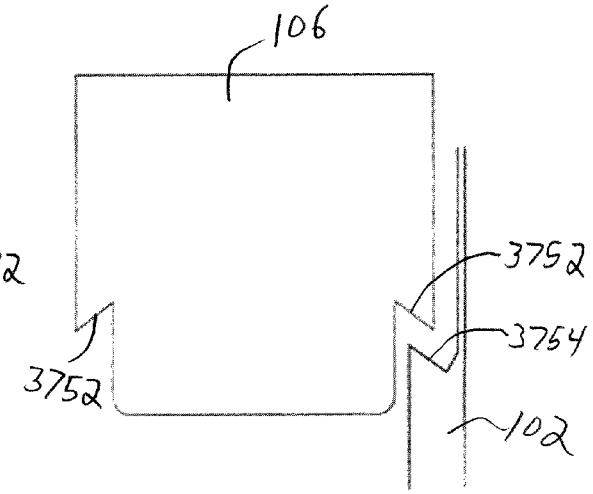
FIG. 37N illustrates an exploded view of an embodiment of a dispenser and housing of a cleaning device.
Figure 37P:
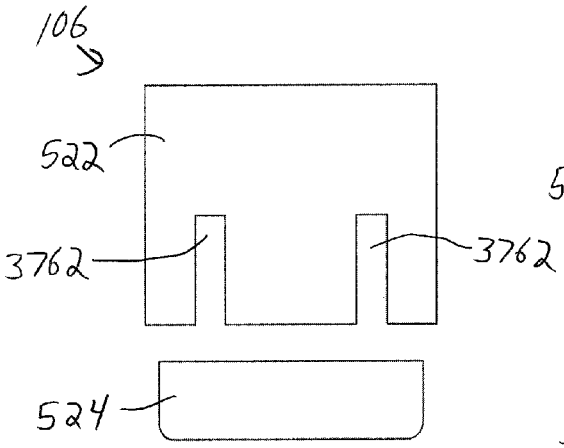
FIG. 37P illustrates an exploded view of an embodiment of a dispenser of a cleaning device.
Figure 37Q:
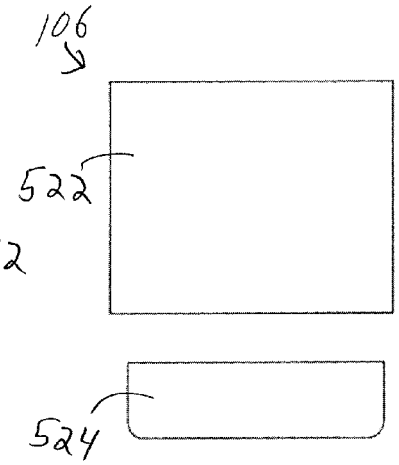
FIG. 37Q illustrates an exploded view of an embodiment of a dispenser of a cleaning device.
Figure 37R:
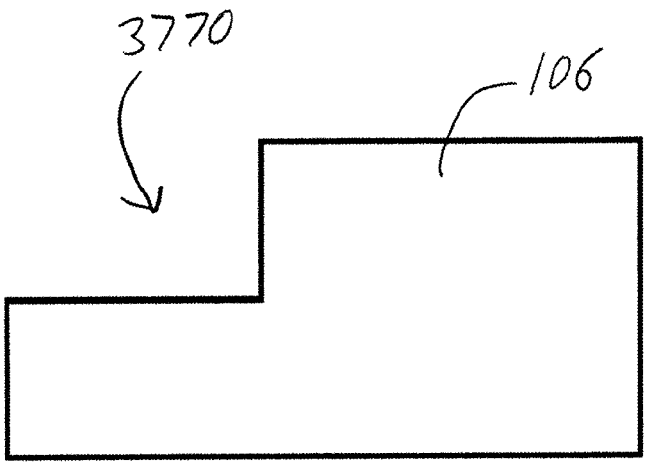
FIG. 37R illustrates a front view of an embodiment of a dispenser of a cleaning device.
Figure 37S:
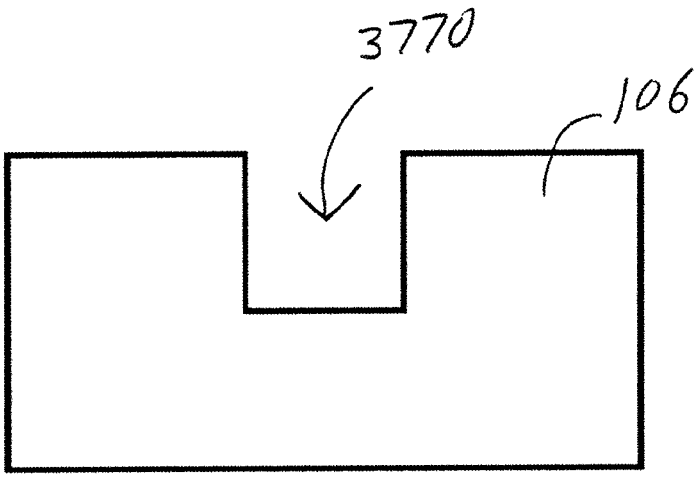
FIG. 37S illustrates a front view of an embodiment of a dispenser of a cleaning device.

FIGS. 37A-37S illustrate various embodiments of dispensers 106. These various figures show that dispensers 106 may be configured in various ways to perform various functions in storing and/or dispensing cleaning fluid. FIG. 37A illustrates a dispenser 106 having tapered edges 902. These tapered edges 902 may assist in allowing a user to apply cleaning fluid to various different shaped surfaces. For example when a user is holding a cleaning device using the housing 102, depending on the surface the user is attempting to clean, it may be easier for a user to use the bottom surface of the dispenser shown in FIG. 37A or one of the tapered edges 902. FIGS. 37B, 37C, and 37E illustrate that the dispensers 106 may comprise various voids or slots in the structure to compensate for any features in the housing 102 and/or a retainer retaining the dispenser 106 to create clearance for those features.

A dispenser 106 can take various shapes and still perform its function of storing cleaning fluid and/or dispensing cleaning fluid to a surface. For example, FIG. 37F shows a dispenser 106 with a zigzag shape. This shape may be desirable for a housing that is in a similar zigzag shape for promotional purposes. For example, a company may want a cleaning device that is shaped like their company logo, like a product that the company produces, like a food product, etc. If, for example, a company produces a product or has a logo similar to the zigzag shape shown in FIG. 37F, the dispenser 106 can conform to that shape and still perform its intended function of storing and/or dispensing cleaning fluid.

FIG. 37G illustrates yet another embodiment of a dispenser 106. The dispenser 106 shown in FIG. 37G comprises a generally spherical shape. In some embodiments, a spherically shape dispenser 106 may be useful to place within a housing 102 that is substantially spherical in shape. In other embodiments, a dispenser 106 as shown in FIG. 37G may be useful as a rotating dispenser so that a fresh surface of the dispenser 106 is always being applied to the surface being cleaned as the dispenser 106 is rolled across the surface. For example, the dispenser 106 may be positioned in a housing 102 with a backside of the spherical surface in contact with a fluid reservoir while a front side of the spherical dispenser is in contact with a surface to be cleaned. As a user moves the dispenser 106 across the surface to be cleaned, the spherical dispenser rotates, exposing the back surface that was just in contact with the reservoir to the surface being cleaned while the surface that was just in contact with the surface being cleaned rotates to be in contact with the reservoir to refill that portion of the dispenser 106 with cleaning fluid.

FIGS. 37H, 37J, and 37L illustrate that a dispenser 106 may have both flatter surfaces 912 and longer, skinnier, pointier, or sharper surfaces 910. Such a design may be desirable to allow a sharper surface 910 to get into hard to reach areas such as areas between a keyboard's keys or the edge of a computer monitor screen. A flatter surface 912 may be advantageous for having a larger surface contact area in applying cleaning fluid to a larger surface area. Note that, while FIGS. 37H and 37J illustrate side views of a dispenser 106, FIG. 37L illustrates a top view of a dispenser 106. FIG. 37K illustrates a dispenser 106 having both a rounded surface and a sharper edge 910. The configurations shown in FIGS. 37H, 37J, and 37L, while being described with respect to dispensers may also be utilized with wipers in some embodiments.

FIGS. 37M, 37N, and 37P illustrate front views of embodiments of dispensers 106 comprising retention features. The embodiment shown in FIG. 37M comprises recessed indentations or holes 3742 configured to mate with protrusions within a cavity of a housing to help retain the dispenser 106 within the housing and/or to resist movement of the dispenser 106 when a user presses the dispenser 106 against a surface being cleaned. Although the embodiment shown in FIG. 37M also comprises flat surfaces 303, as described above in reference to FIG. 3A, some embodiments of dispensers 106 do not have flat surfaces 303. The embodiment shown in FIG. 37N comprises notches 3752 configured to mate with locking surfaces 3754 of within a cavity of a housing. For example, a housing may be configured to allow the dispenser 106 to be slid into a cavity in the housing, and to have the dispenser 106 be locked in place when the notches 3752 move beyond the locking surfaces 3754. The embodiment shown in FIG. 37P comprises retaining slots 3762. The dispenser 106 of FIG. 37P comprises two portions, an internal portion 522 and an external portion 524. The retaining slots 3762 can be configured to mate with a retaining feature within a cavity of a housing, such as a ledge or rib, to help retain the internal portion 522 within the housing. For example, the housing may be configured to allow the internal portion 522 to be slid into the housing until the retaining slots 3762 mate with a retaining feature within the housing. Then, for example, a dispenser retainer may be used to substantially lock the internal portion 522 in place within the housing. The external portion 524 may then be slid into the opposite end of the housing to come into fluid communication with the internal portion 522. The embodiment illustrated in FIG. 37Q also comprises an internal portion 522 and external portion 524. However, the internal portion 522 does not have any retaining slots. Instead, in this embodiment, the internal portion 522 may be configured to be retained, for example, by contacting various other surfaces of the internal portion 522 with retaining features of the housing. Although FIGS. 37A-37Q have been described with respect to dispensers, several of the features shown and described in FIGS. 37A-37Q as applying to dispensers may also apply to wipers.

FIGS. 37R and 37S illustrate front views of embodiments of dispensers of a cleaning device. FIGS. 37R and 37S illustrate that a dispenser 106 may comprise a cutout or divot 3770. A cutout or divot 3770 may be advantageous to, for example, allow a dispenser 106 to contact an object being cleaned using more than one dispensing surface simultaneously and/or to at least partially conform the dispensing surface to the surface or surfaces of the object being cleaned. For example, in some embodiments, a cutout or divot 3770 can be configured to at least partially conform to a shape of a side of a smartphone. In these embodiments, for example, a user can slide one or more sides of a smartphone through the cutout or divot 3770 to clean multiple surfaces of the smartphone simultaneously. Although the embodiments shown in FIGS. 37R and 37S comprise cutouts or divots 3770 having generally flat walls, a cutout or divot 3770 can be formed in various other shapes, such as rounded, angled, jagged, etc.

In some embodiments, the dispensers 106 shown in FIGS. 37R and 37S can comprise at least one fabric or cloth layer positioned at least partially over the cutout or divot 3770. In some embodiments, however, the dispensers 106 do not comprise a fabric or cloth layer. In some embodiments, the fabric or cloth layer substantially conforms to the cutout or divot 3770. In other embodiments, the fabric or cloth layer does not substantially conform to the cutout or divot 3770 and, in some embodiments, can be configured to at least partially stretch or otherwise displace into the cutout or divot 3770 when the fabric or cloth layer is placed into contact with a surface or surfaces being cleaned. In some embodiments, a dispenser comprises more than one cutout or divot. In some embodiments, FIGS. 37R and 37S illustrate side views of embodiments of dispensers of a cleaning device, rather than front views. The configurations shown in FIGS. 37R and 37S, while being described with respect to dispensers, may also be utilized with wipers in some embodiments.

Figure 38A:
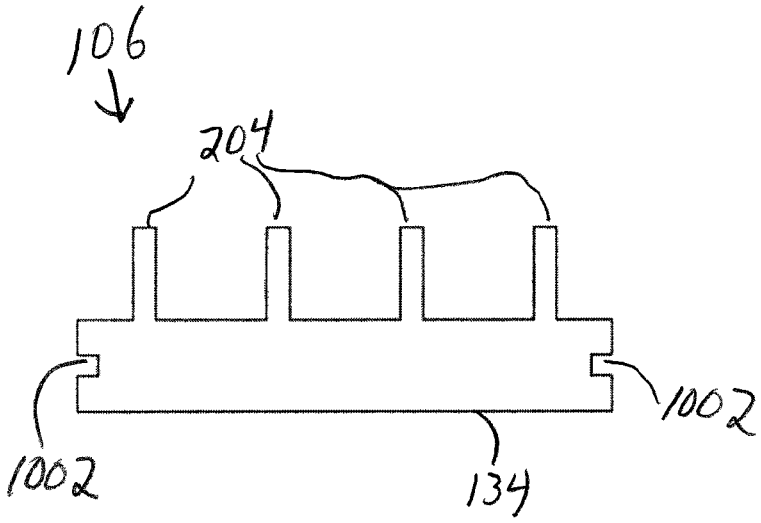
FIG. 38A illustrates a front view of an embodiment of a dispenser of a cleaning device.
Figure 38B:
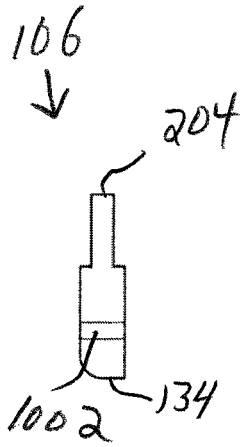
FIG. 38B illustrates a side view of the dispenser of FIG. 38A.

FIGS. 38A and 38B illustrate an embodiment of a dispenser 106 of a cleaning device. FIG. 38A illustrates a front view of the dispenser 106 and FIG. 38B illustrates a side view of the dispenser 106. The dispenser 106 of FIGS. 38A and 38B comprises protruding members 204 and retaining slots 1002. The protruding members 204 are configured to protrude at least partially into an internal cavity of a housing to be in fluid communication with cleaning fluid positioned within an interior cavity of the housing. The protruding members 204 are in fluid communication with the dispensing surface 134 to allow cleaning fluid to be transferred from the protruding members 204 through the body of the dispenser 106 to the dispensing surface 134. In this embodiment, the dispenser 106 is configured to be retained at least partially within a housing by positioning the retaining slots 1002 adjacent to a mating lip or ledge of the housing. The dispenser 106 may be configured to be removable or substantially permanently installed within the housing 102.

Disposable Dispensers

Figure 39:
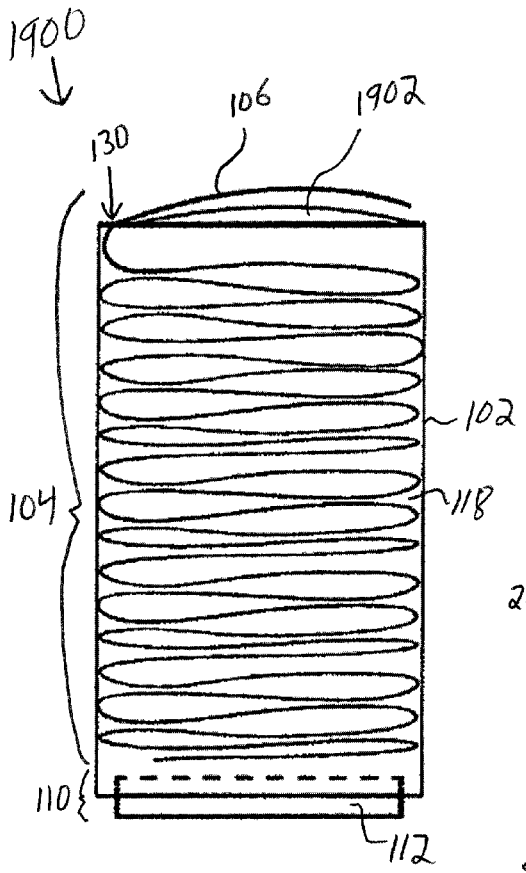
FIG. 39 illustrates a front view of an embodiment of a cleaning device.
Figure 40:
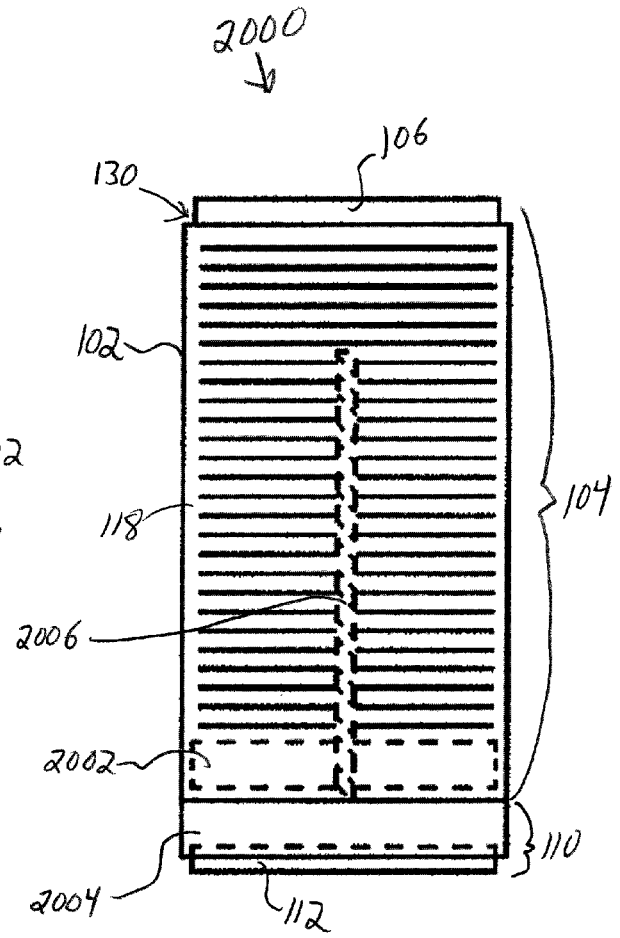
FIG. 40 illustrates a front view of an embodiment of a cleaning device.

FIGS. 39 and 40 illustrate embodiments of cleaning devices comprising multiple disposable dispensers 106. Although dispenser covers and wiper covers are not shown in FIGS. 39 and 40, either embodiment may include a dispenser cover and/or wiper cover. FIG. 39 illustrates a cleaning device 1900 comprising a housing 102, a wiper 112, disposable dispensers 106 and a dispenser backing 1902. In the embodiment shown in FIG. 39, the disposable dispensers 106 comprise fabric or paper or the like disposable sheets impregnated with a cleaning fluid. The disposable dispensers 106 are stacked or folded within the housing 102, and the housing 102 is configured to allow a user to pull one of the dispensers 106 through an opening in the housing 102 to use the dispenser 106. In some embodiments, the disposable dispensers 106 are connected to one another along an edge to enable the second disposable dispenser 106 to be pulled through the opening by pulling a first disposable dispenser 106. The dispensers 106 may be connected at a perforated or similar section to allow easy separation of one dispenser 106 from another. In some embodiments, the dispenser 106 can comprise a single continuous sheet to allow a user to pull as much as the user desires through the opening and then cut the dispenser 106 using scissors, a knife, a cutting feature or knife-like mechanism integrated into the housing 102, etc. In some embodiments, the dispenser 106 being used is configured to be at least partially attached to the dispenser backing 1902 during use. The dispenser backing 1902 may be configured to have a sticky surface and/or a Velcro type surface and/or the like to retain the dispenser 106 in contact with the dispenser backing 1902. In other embodiments, a mechanical feature of the housing 102 may be configured to hold the dispenser 106 against the dispenser backing 1902. For example, a mechanical latch may clamp an end of the dispenser 106 and hold it generally taut against the dispenser backing 1902. Additionally, in other embodiments, the housing 102 and dispenser backing 1902 may be configured to not have any features to retain the dispenser 106 against the dispenser backing 1902. Rather, in those embodiments, a user may hold an end of the dispenser 106 against the dispenser backing 1902 as the user is using the cleaning device 1902 to dispense cleaning fluid.

In use, to clean a surface with the cleaning device 1900, a user can pull a fresh dispenser 106 from the housing 102 of the cleaning device 1900. The user can then attach the dispenser 106 to the dispenser backing 1902 as described above. The user can then rub the dispenser 106 against the surface to be cleaned, releasing at least a portion of the cleaning fluid contained within the dispenser 106. In some embodiments, the dispenser backing 1902 is a substantially solid portion that forces the dispenser 106 to substantially conform to the shape of the dispenser backing 1902. In other embodiments, the dispenser backing 1902 comprises a deformable material, such as a rubber material, a sponge material, a foam material, and the like. In these embodiments, the dispenser backing 1902 allows the dispenser 106 to substantially conform to the contours of a surface being cleaned while a user is dispensing cleaning fluid onto that surface. In some embodiments, the dispenser backing 1902 is in fluid communication with the internal cavity 118 and is configured to transfer at least a portion of the fluid within the internal cavity 118 to a dispenser 106 positioned adjacent to the dispenser backing 1902. After a user has dispensed cleaning fluid using the dispenser 106 a user may choose to use the wiper 112 to wipe and/or buff or polish the surface.

In some embodiments, the cleaning device 1900 further comprises a dispensing surface retainer, such as the dispensing surface retainer 704 shown in FIG. 35A. The dispensing surface retainer is configured to hold a dispenser 106 in position over the dispenser backing 1902. In some embodiments, the dispensing surface retainer is configured to be removed and replaced when pulling a new dispenser 106 from the housing 102. In some embodiments, the dispensing surface retainer is configured to have one or more openings through which a user can pull a dispenser 106 from the internal cavity of the housing 102. For example, the dispensing surface retainer can be configured to have a first opening at a first end, the first opening being positioned adjacent to the dispenser opening 130, and a second opening at a second end. The second opening can be positioned such that pulling a dispenser 106 through the second opening also pulls the dispenser 106 through the dispenser opening 130 and positions at least a portion of the dispenser 106 over the dispenser backing 1902. In some embodiments, the dispensing surface retainer can comprise a cutting mechanism, a knife, perforated hard plastic, and/or the like near, for example, the second opening, to allow a user to cut through or separate an old dispenser 106 as or after it is pulled through the retainer to position a fresh dispenser 106 within the retainer.

FIG. 40 illustrates a cleaning device 2000 comprising a housing 102, a twist handle 2004, a wiper 112 and several disposable dispensers 106. In the embodiment shown in FIG. 40, several disposable dispensers 106 are stacked on top of each other within the housing 102. The stack of disposable dispensers 106 is slidably positioned within the housing 102. The dispensers 106 are stacked on top of an elevating surface of an elevator 2002 wherein the elevator 2002 is attached to a screw 2006 attached to the twist handle 2004. In operation, a user can turn the twist handle 2004 with respect to the housing 102, causing the screw 2006 to turn and raise the elevator 2002 with respect to the twist handle 2004. As the elevator 2002 raises, the stack of disposable dispensers 106 is also raised and caused to extend at least partially outside of the housing 102. When a dispenser 106 is exposed outside of the housing 102, a user may use that dispenser 106 to dispense cleaning fluid that is impregnated in the dispensers 106 onto a surface to be cleaned. After that disposable dispenser 106 is used up or at least partially used (e.g., out of cleaning fluid, low on cleaning fluid, has become dirty or contaminated, etc.) a user can remove the disposable dispenser 106 and then turn the twist handle 2004 to cause the next disposable dispenser 106 to protrude from the housing 102. In both of the embodiments shown in FIGS. 39 and 40, the embodiments may or may not include a dispenser cover and/or wiper cover to cover the dispensers and wipers. In some embodiments, the cleaning devices may or may not include a dispensing surface retainer, such as the dispensing surface retainer 704 illustrated in FIG. 35A. The dispensing surface retainer can be configured to, for example, allow a dispenser 106 to at least partially protrude through an opening in the dispensing surface retainer to form a dispensing surface, while at least a portion of the dispenser 106 is retained in place with respect to the housing 102 by, for example, the sides of the dispensing surface retainer.

Various other embodiments of cleaning devices may comprise features similar to the cleaning device 2000 shown in FIG. 40, but utilize different elevating mechanisms. For example, an externally accessible handle can be connected to the elevator 2002 to allow a user to directly push the elevator up or down within the housing 102, rather than requiring the user to rotate the twist handle 2004.

Embodiments Comprising a Light Source

Figure 41:
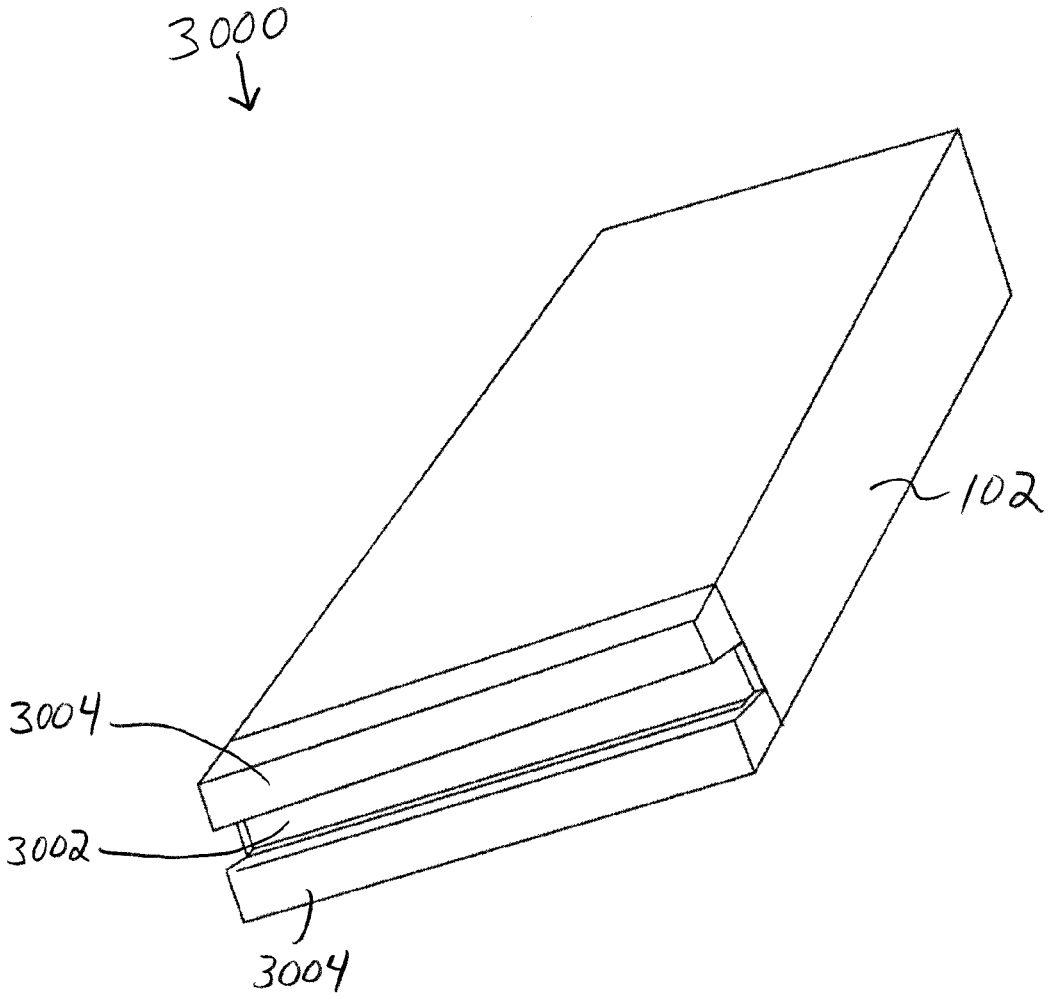
FIG. 41 illustrates a perspective view of an embodiment of a cleaning device.

FIG. 41 illustrates a perspective view of an embodiment of a cleaning device 3000 comprising a housing 102, protruding members 3004, and an ultraviolet light source 3002. The cleaning device 3000 may include cleaning fluid stored in a reservoir or internal cavity of the housing 102 that is dispensed from at least one of the protruding members 3004 as a user moves the protruding member 3004 along the surface to be cleaned. Alternatively, the cleaning device 3000 may use no cleaning fluid and use the ultraviolet light source as the primary source of cleaning and/or sanitizing, for example to kill bacteria by exposing the bacteria to ultraviolet light. The surfaces of the protruding members 3004 may be merely wiping surfaces that clean smudges, dirt, etc. from a surface as that surface is being disinfected by ultraviolet light from the ultraviolet light source 3002. The housing 102 may contain an energy source, such as a battery, to power the ultraviolet light source 3002. The energy source can be configured to be charged using, for example, a wall outlet or a computer's USB port. The device may additionally be configured to incorporate solar charging and/or kinetic charging capabilities, to enable charging when a power outlet is not available. Some embodiments are configured to allow a user to charge another item using the cleaning device's energy source. For example, a user can connect his or her smartphone to a USB port on the cleaning device to transfer energy from the cleaning device's internal source to the smartphone. The housing 102 may comprise a switch to turn the ultraviolet light source 3002 on and off. In some embodiments, the protruding members 3004 may comprise or contact a pressure sensing switch that automatically causes the ultraviolet light source 3002 to turn on when pressure is detected when the cleaning device 3000 is pressed against a surface to be cleaned. In some embodiment, the ultraviolet light source 3002 and/or protruding members 3004 are configured to be replaceable.

In some embodiments, as shown in FIG. 42, a side wall or multiple side walls 3102 may connect the protruding members 3004 to form a seal to not allow or to substantially not allow ultraviolet light from the ultraviolet light source 3002 to be seen by a user utilizing the cleaning device. Ultraviolet light produced by an ultraviolet light source can be dangerous to human eyes in some situations. Therefore, forming a seal around the ultraviolet light source 3002 may be desirable in some embodiments. In some embodiments, one unitary protruding member 3004 may encircle the ultraviolet light source 3002, eliminating any need for separate side walls 3102. In various embodiments of cleaning devices, including those illustrated in FIGS. 41 and 42, one or more protruding members 3004 can comprise one or more fabric layers and/or compressible portions, as described above in reference to various embodiments of wipers and/or dispensers. For example, the protruding members 3004 can comprise a microfiber fabric layer or other suitable material configured to wipe, buff, or polish a surface. The protruding members 3004 can be used in combination with the ultraviolet light source 3002 or independent of the ultraviolet light source 3002.

In some embodiments, an ultraviolet light source can be positioned within an opening of the housing, rather than along an end of the housing. For example, the cleaning device 3000 or 3100 can include a u-shaped opening (or any other shape of opening), similar to the opening shown in FIG. 10 accessed by removing the access cover 3202. The cleaning device can be configured to, for example, allow a user to slide an object to be cleaned through the opening, with ultraviolet light being applied to the object from all sides of the opening.

In some embodiments, the light source is a UV-C light. In some embodiment, the light source is not an ultraviolet light source, but rather a light that brightens plastic or any type of light source that has the ability to kill germs and/or sanitize or clean a surface.

While the embodiments illustrated in FIGS. 41 and 42 illustrate a recessed light source 3002, other embodiments may include a light source that is flush with an outer surface of the housing 102 or protruding members 3004, or a light source that protrudes from an outer surface of the housing 102 or protruding members 3004. In some embodiments, the protruding members 3004 can be located in different locations. For example, the protruding members 3004 can be located on the opposite end of the housing 102 as the light source 3002, or anywhere else on the housing 102. In some embodiments, the cleaning devices illustrated in FIGS. 41 and 42 can additionally comprise a wiper, such as the wiper 112 illustrated in FIG. 1A and various other embodiments, located anywhere along the housing 102.

The concepts disclosed herein relating to cleaning devices comprising a light source can be combined with any other embodiments of cleaning devices described herein.

Embodiments Comprising Accessories

Figure 43:
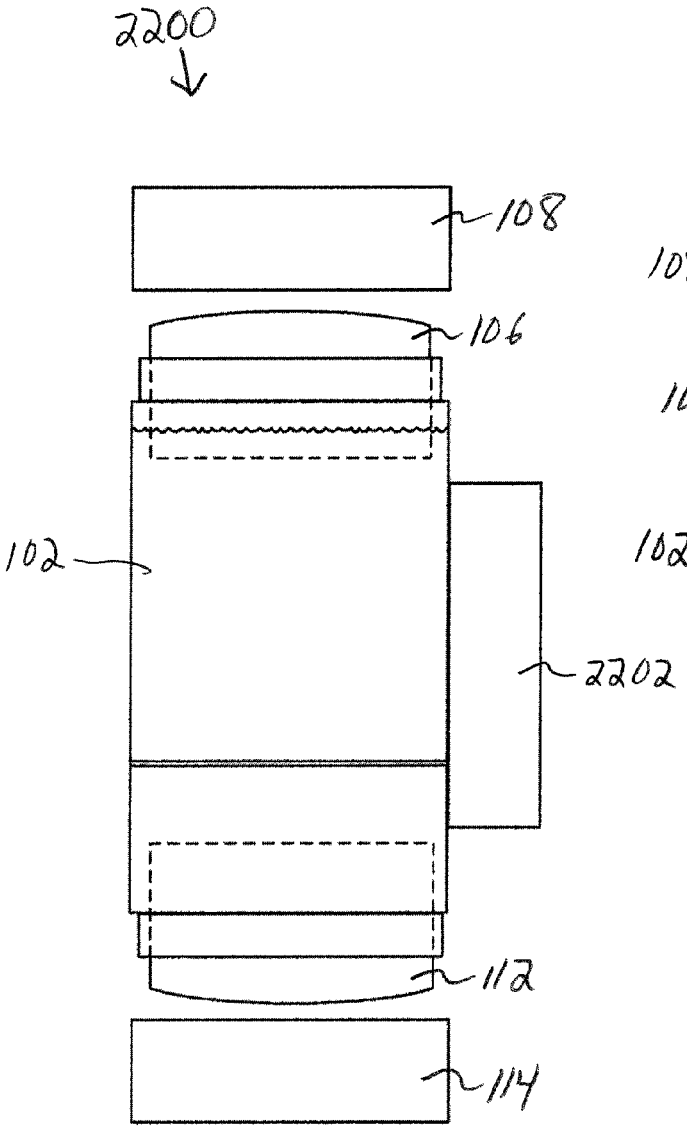
FIG. 43 illustrates a front view of an embodiment of a cleaning device.

FIG. 43 illustrates a front view of an embodiment of a cleaning device 2200. The cleaning device 2200 comprises a housing 102 having a dispenser 106 and wiper 112. The cleaning device 2200 additionally comprises a dispenser cover 108 and a wiper cover 114. Additionally, the cleaning device 2200 comprises an accessory 2202. The accessory 2202 can be a mirror, a fan, a cell phone charger, a compartment for holding personal items such as sanitizer sheets, etc. The embodiment shown in FIG. 43 may be advantageous because, if a user is carrying his or her cleaning device at all times, he or she can also have the accessory 2202 with him or her at all times. While the accessory 2202 is shown positioned on a side surface or end of the cleaning device 2200, the accessory 2202 may be positioned in various other locations, such as on a front or back surface of the cleaning device 2200, on the same end as either the dispenser 106 or the wiper 112, and/or on one of the covers such as the dispenser cover 108 or wiper cover 114. The accessory 2202 can be integral to the housing 102 or be attached to the housing 102, either permanently or non-permanently, using various means, such as Velcro, adhesives, interlocking lips, screws, other mechanical fasteners, etc.

Figure 44:
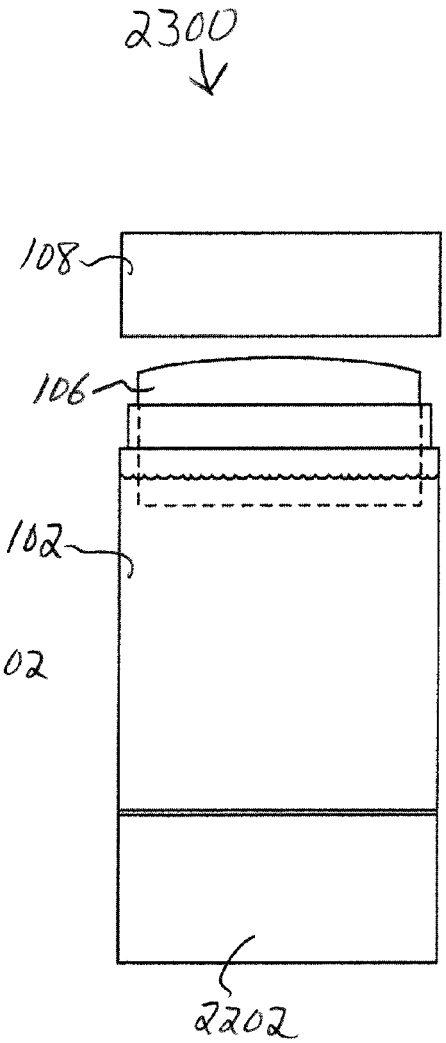
FIG. 44 illustrates a front view of an embodiment of a cleaning device.

FIG. 44 illustrates a front view of an embodiment of a cleaning device 2300 comprising a housing 102 having a dispenser 106, a dispenser cover 108, and an accessory 2202. In this embodiment, the accessory 2202 is positioned at an end of the housing 102 approximately 180° or opposite to an end comprising the dispenser 106. The accessory 2202 shown in FIG. 44 may be positioned in various locations on the housing 102, and the accessory 2202 may be one or more items such as a fan, a battery charger, a compartment to hold personal items, etc.

Accessories 2202 may further comprise a battery, and/or a solar charger, and/or a kinetic charger to enable charging of electronics when no power outlet is available.

Filling Devices

Figure 45A:
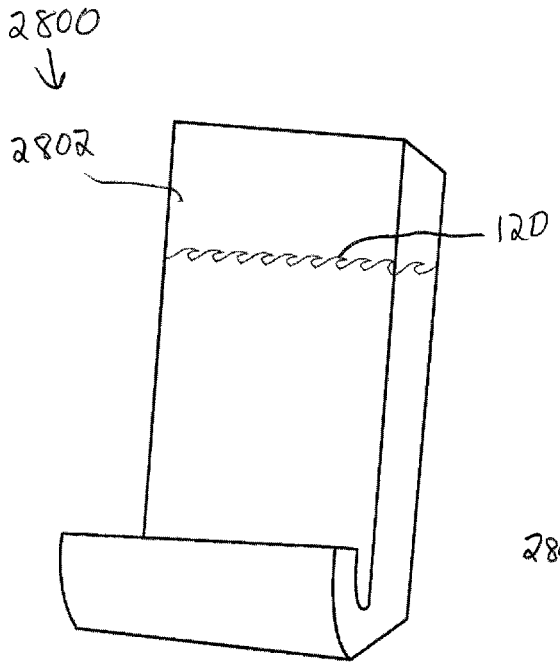
FIG. 45A illustrates a perspective view of a filling device.
Figure 45B:
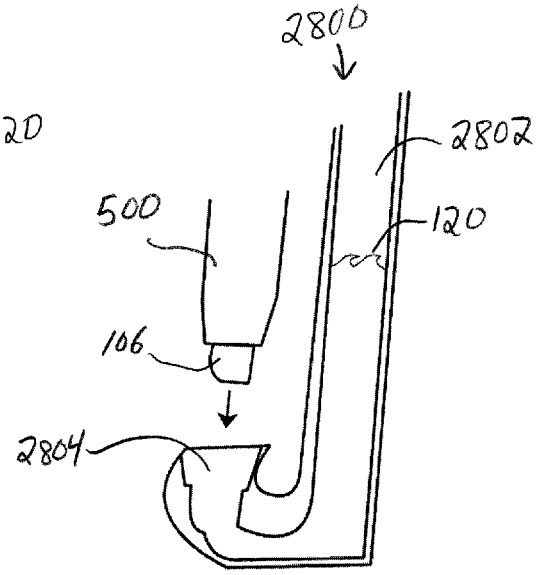
FIG. 45B illustrates a side cross sectional view of the filling device of FIG. 45A.

In some embodiments, a dispenser 106 is configured to be refillable with cleaning fluid without removing the dispenser 106 from the housing 102. For example, a filling device 2800 as illustrated in FIGS. 45A and 45B may be utilized to refill the dispenser 106 of the cleaning device 500. FIG. 45A is a perspective view of the filling device 2800. FIG. 45B is a side cross sectional view of the filling device 2800 showing a cleaning device 500 preparing to be refilled using the filling device 2800. The filling device 2800 includes a housing having an internal cavity 2802, with a volume of cleaning fluid 120 positioned within the internal cavity, and a filling port 2804. The filling port 2804 is in fluid communication with the internal cavity 2802. In use, a user positions a dispenser 106 at least partially within the filling port 2804 to bring the dispenser 106 into fluid contact with the cleaning fluid 120 within the filling device 2800. The dispenser 106 absorbs cleaning fluid 120 from the filling device 2800 thereby refilling the cleaning fluid in the dispenser 106. In some embodiments, the filling port 2804 is configured to substantially conform to a shape of the dispenser 106. In some embodiments, the filling port 2804 comprises a gasket to aid in forming a seal with the dispenser 106. Some embodiments include a valve positioned between the internal cavity 2802 and the filling port 2804 to selectively enable and disable fluid communication between the internal cavity 2802 and filling port 2804.

Figure 46:
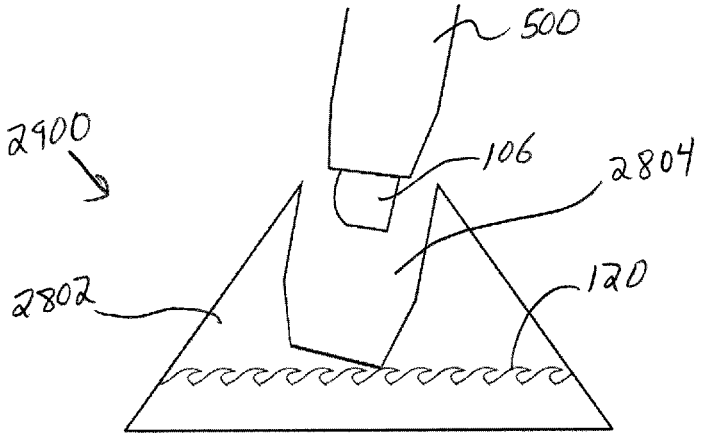
FIG. 46 illustrates a side view of an embodiment of a filling device.

FIG. 46 illustrates a side view of another embodiment of a filling device 2900. The filling device 2900 includes an internal cavity 2802 containing cleaning fluid 120 and a filling port 2804. A user can position a dispenser 106 of a cleaning device within the filling port 2804 of the filling device 2900 to absorb cleaning fluid 120 into the dispenser 106. In some embodiments, a filling device is configured to allow a user to store a cleaning device attached to the filling port 2804. For example a user may keep a filling device, such as a filling device 2800, on his or her desk with a cleaning device 500 attached to the filling port 2804. Then, when the user desires to clean a surface, such as his or her computer screen, the user can remove the cleaning device 500 from the filling device with the cleaning device 500 having a fresh charge of cleaning fluid for cleaning the surface. In various embodiments of filling devices configured to allow a user to store a cleaning device attached to the filling port 2804 (such as the filling devices shown in FIGS. 45A, 45B, and 46 and various other embodiments) the cleaning device can act as a cap or cover for the filling device when it is stored attached to the filling device. This can be advantageous to, for example, help to retain cleaning fluid when the filling device is transported, carried, picked up, dropped, shaken, etc. This can also be advantageous to help retain cleaning fluid by reducing evaporation of fluid within the filling device.

In various embodiments of filling devices, the filling device can comprise one or more removable caps or covers configured to at least partially cover an opening in the housing to help retain cleaning fluid within the filling device. For example, a cap or cover can help to retain cleaning fluid when the filling device is transported, carried, picked up, dropped, shaken, etc. A cap or cover can also be configured to help retain cleaning fluid by reducing evaporation of fluid within the filling device. A cap or cover can also be configured to be removable to allow a user to fill the filling device with fluid or to empty the filling device of fluid.

In some embodiments, a filling device comprises a pressurized internal cavity. In these embodiments, a cleaning device may be attached to a filling port of the filling device and then the pressurized internal cavity may force cleaning fluid into the dispenser 106. In some embodiments, a filling device may also include an evacuation feature or pump. For example, if a user has expired cleaning fluid within a dispenser 106 of, for example the cleaning device 500, the user may wish to at least partially evacuate the old cleaning fluid from the dispenser 106 prior to filling the dispenser 106 with new fluid. The filling device may include a vacuum function to suck at least a portion of any fluid remaining in the dispenser 106 from the dispenser 106 prior to adding new cleaning fluid 120 to the dispenser 106.

In some embodiments, a filling device may comprise one or more accessories. For example, a filling device may comprise a charger (such as to charge smartphones, other portable electronics, etc.), a clock, a radio, an alarm, etc. In some embodiments the charger is a wireless charger configured to charge electronic devices through, for example, inductive charging. In some embodiments, the filling device further comprises a battery and/or solar powered capability to enable charging of electronics when no electrical outlet is available.

Although several embodiments described herein are described with reference to cleaning fluid and/or sanitizing fluid, it should be understood that the embodiments described herein could be used with various products, fluids, and chemicals. For example, some embodiments could be used to dispense ink, paint, water, foams, creams, ointments, fragrant chemicals, serums, pharmaceuticals or other medicaments, etc.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. For all of the embodiments described herein the steps of the methods need not be performed sequentially. Thus, it is intended that the scope of the present inventions herein disclosed should not be limited by the particular disclosed embodiments described above

What is claimed is:

1. A cleaning device configured to selectively dispense a fluid to a surface being cleaned, the cleaning device comprising:

a housing comprising a first end and a second end, wherein at least one of the first end and the second end comprises an opening, the housing at least partially defining an internal cavity, the internal cavity being in fluid communication with the opening;

wherein the housing is configured to be grasped and manipulated by a user during a cleaning procedure;

a dispenser at least partially covering the opening of the housing, wherein the dispenser comprises a porous or fluid permeable material;

wherein the dispenser comprises an exterior surface configured to contact a surface being cleaned and to selectively deliver fluid thereto;

wherein the dispenser is configured to regulate, at least in part, a flow of fluid from the internal cavity to an exterior of the housing through the dispenser;

a dispenser cap removably coupled to the housing, wherein the dispenser cap at least partially covers the dispenser;

at least one wiper comprising an inner portion and a fabric, the fabric forming a wiping surface, the wiping surface configured to wipe dispensed fluid from a surface being cleaned, wherein the at least one wiper is removable and repositionable relative to the housing to enable a different portion of the fabric to form the wiping surface; and a wiper cap removably coupled to the housing, wherein the wiper cap at least partially covers the at least one wiper; wherein the fabric is configured to be repositionable relative to the inner portion such that a different portion of the fabric forms an outermost layer of the at least one wiper, the outermost layer forming the wiping surface of the at least one wiper.

2. The cleaning device of claim 1, wherein the dispenser comprises an outer fabric layer, the outer fabric layer configured to at least partially form the exterior surface of the dispenser.

3. The cleaning device of claim 1, wherein the fabric is wrapped about the inner portion to form multiple fabric layers.

4. The cleaning device of claim 1, wherein the fabric is configured to be rewrappable about the inner portion.

5. The cleaning device of claim 1, wherein at least one of the at least one wiper and the dispenser comprises two or more layers of fabric.

6. The cleaning device of claim 1, wherein the at least one wiper is positioned at the first end of the housing and the dispenser is positioned at the second end of the housing, wherein the first end is located substantially opposite to the second end.

7. The cleaning device of claim 1, wherein the dispenser is configured to be removable from the housing.

8. A cleaning device configured to selectively dispense a fluid to a surface being cleaned, the cleaning device comprising:

a housing comprising a first end and a second end, the first end comprising a first opening adjacent a first internal cavity of the housing and the second end comprising a second opening adjacent a second internal cavity of the housing;

wherein the housing is configured to be grasped and manipulated by a user during a cleaning procedure;

a dispenser at least partially covering the first opening of the housing, wherein the dispenser comprises a porous or fluid permeable material;

wherein the dispenser comprises a first outer fabric layer, the first outer fabric layer comprising an exterior surface configured to contact a surface being cleaned and to selectively deliver fluid thereto;

wherein the dispenser is configured to regulate, at least in part, a flow of fluid from the first internal cavity to an exterior of the housing through the dispenser; and at least one wiper comprising a second outer fabric layer, the at least one wiper configured to be positioned within the second cavity such that a wiping surface of the second outer fabric layer is accessible to the user during the cleaning procedure, the wiping surface configured to wipe dispensed fluid from a surface being cleaned, wherein the at least one wiper is configured to be removable from the second cavity and reinsertable into the second cavity in a different configuration such that a different portion of the second outer fabric layer can be used as the wiping surface during the cleaning procedure; wherein the at least one wiper comprises a fabric positioned about an inner portion, the fabric being separable from and repositionable relative to the inner portion.

9. The cleaning device of claim 8, wherein the at least one wiper comprises two or more fabric layers.

10. The cleaning device of claim 8, wherein the dispenser comprises two or more fabric layers.

11. The cleaning device of claim 8, wherein the at least one wiper comprises a fabric that is wrapped about the inner portion to form a plurality of fabric layers, the plurality of fabric layers comprising the second outer fabric layer.

12. The cleaning device of claim 8, wherein the dispenser is configured to be removable from the housing.

13. The cleaning device of claim 8, further comprising:

a dispenser cap removably coupled to the housing, wherein the dispenser cap at least partially covers the dispenser.

14. The cleaning device of claim 8, further comprising:

a wiper cap removably coupled to the housing, wherein the wiper cap at least partially covers the at least one wiper.

15. A cleaning device configured to selectively dispense a fluid to a surface being cleaned, the cleaning device comprising:

a housing comprising a first end and a second end, the second end positioned substantially opposite the first end, wherein the first end comprises a first cavity and the second end comprises a second cavity;

a dispenser positioned at least partially within the first cavity, the dispenser comprising a porous or fluid permeable material;

wherein the dispenser comprises a dispensing portion at least partially protruding from the first cavity, the dispensing portion configured to contact a surface being cleaned and to selectively deliver fluid thereto;

wherein the dispensing portion comprises a length and a width, the length being at least twice the width; and a wiper positioned at least partially within the second cavity, the wiper comprising an inner member and an outer member, the outer member forming a wiping surface configured to wipe dispensed fluid from a surface being cleaned, wherein the wiper is reconfigurable to enable a different portion of the outer member to form the wiping surface, wherein the wiper is configured to be removed from the second cavity of the housing; wherein the outer member is separate from the inner member.

16. The cleaning device of claim 15, wherein the dispensing portion comprises at least one fabric layer.

17. The cleaning device of claim 15, wherein the outer member of the wiper comprises a fabric, the fabric being wrapped about the inner member to form a plurality of fabric layers, an outermost layer comprising the wiping surface.

18. The cleaning device of claim 15, wherein the length of the dispensing portion is at least four times the width of the dispensing portion.

19. The cleaning device of claim 1, further comprising:

a dispenser cap removably coupled to the housing, wherein the dispenser cap at least partially covers the dispenser; and a wiper cap removably coupled to the housing, wherein the wiper cap at least partially covers the wiper.

* * * * *